US007022444B2

(12) United States Patent
Kawada et al.

(10) Patent No.: US 7,022,444 B2
(45) Date of Patent: Apr. 4, 2006

(54) COLOR IMAGE FORMING METHOD AND APPARATUS, AND MICROCAPSULE TONER FOR USE THEREWITH

(75) Inventors: Kazumasa Kawada, Higashiyamato (JP); Shigeru Shimizu, Iruma (JP); Isao Ebisawa, Hamura (JP); Shuichi Yamasaki, Fussa (JP); Yoshiyuki Matsuoka, Tokorozawa (JP); Naoto Yoshida, Fussa (JP); Koichi Kamei, Hino (JP); Noriki Ono, Higashiyamato (JP); Masafumi Nakahara, Tachikawa (JP); Kenichiro Asako, Kokubunji (JP); Kenji Kobayashi, Hino (JP); Kosuke Sugama, Tokyo (JP)

(73) Assignees: Casio Computer Co., Ltd., Tokyo (JP); Casio Electronics Manufacturing Co., Ltd., Saitama-ken (JP)

( * ) Notice: Subject to any disclaimer, the term of this patent is extended or adjusted under 35 U.S.C. 154(b) by 200 days.

(21) Appl. No.: 10/617,243

(22) Filed: Jul. 9, 2003

(65) Prior Publication Data

US 2004/0076897 A1 Apr. 22, 2004

(30) Foreign Application Priority Data

| | | |
|---|---|---|
| Jul. 10, 2002 | (JP) | 2002-201855 |
| Dec. 16, 2002 | (JP) | 2002-363341 |
| Dec. 27, 2002 | (JP) | 2002-378829 |
| Mar. 5, 2003 | (JP) | 2003-059128 |

(51) Int. Cl.

| | |
|---|---|
| ***G03G 15/01*** | (2006.01) |
| ***G03G 9/093*** | (2006.01) |
| ***G03G 13/01*** | (2006.01) |

(52) U.S. Cl. ..... 430/45; 430/47; 430/110.2; 430/3; 399/320; 399/339

(58) Field of Classification Search ..... 430/45, 430/47, 110.2, 3; 399/320, 339
See application file for complete search history.

(56) References Cited

U.S. PATENT DOCUMENTS

| | | | | |
|---|---|---|---|---|
| 4,149,887 | A | | 4/1979 | Levy |
| 4,734,704 | A | | 3/1988 | Mizutani et al. |
| 4,814,808 | A | * | 3/1989 | Sangyoji et al. ..... 396/586 |
| 4,884,501 | A | * | 12/1989 | Izaki et al. ..... 100/176 |
| 5,185,226 | A | * | 2/1993 | Grosso et al. ..... 430/47 |
| 5,516,621 | A | * | 5/1996 | Tsuda et al. ..... 430/138 |

FOREIGN PATENT DOCUMENTS

| | | |
|---|---|---|
| DE | 39 29 639 A1 | 5/1990 |
| EP | 0 282 353 A2 | 9/1988 |
| JP | 8-106172 A | 4/1996 |
| JP | 11-058832 A | 3/1999 |
| JP | 11-058833 A | 3/1999 |

* cited by examiner

*Primary Examiner*—John L Goodrow
(74) *Attorney, Agent, or Firm*—Frishauf, Holtz, Goodman & Chick, P.C.

(57) ABSTRACT

A color image forming method and apparatus using larger microcapsules each of which contains a plurality of kinds of smaller microcapsules scattered within the larger microcapsule, reacting substances that are mixed with each other to perform a coloring reaction being scattered inside and outside the smaller microcapsule. A protective wall of each smaller microcapsule is broken with a corresponding predetermined ultrasonic stimulus depending upon color component information to thereby cause the reacting substances to diffuse with each other to perform a coloring reaction and hence image printing. The conditions for breaking the protective walls of the respective smaller microcapsules that contain a color former component vary from smaller microcapsule to smaller microcapsule, or are determined depending upon the outer shapes, materials and thickness of the protective walls of the smaller microcapsules.

14 Claims, 33 Drawing Sheets

| | MAGENTA CAPSULE | CYAN CAPSULE | YELLOW CAPSULE |
|---|---|---|---|
| CAPSULE RADIUS Ro | 1.0 μm | 1.0 μm | 1.5 μm |
| SHELL PARAMETER Sp | 0.5 | 2 | 0.5 |
| MAX AMPLITUDE FREQ f | 7.0MHz | 11MHz | 4.0MHz |

(Ro,Sp)- FREQUENCY CHARACTERISTIC

| | MAGENTA CAPSULE | CYAN CAPSULE | YELLOW CAPSULE | BLACK CAPSULE |
|---|---|---|---|---|
| CAPSULE RADIUS Ro | 1.0 μm | 1.0 μm | 1.5 μm | 0.5 μm |
| SHELL PARAMETER Sp | 1 | 0.5 | 1.5 | 2.0 |
| MAX AMPLITUDE FREQ f | 9.0MHz | 18MHz | 6.0MHz | 30MHz |

(Ro,Sp,P)- FREQUENCY CHARACTERISTIC

| | YELLOW CAPSULE | MAGENTA CAPSULE | CYAN CAPSULE |
|---|---|---|---|
| CAPSULE RADIUS Ro | 2.0 μm | 1.5 μm | 1.0 μm |
| SHELL PARAMETER Sp | 0 | 0 | 0 |
| APPLIED ULTRASONIC PRESSURE P | 70kPa | 90kPa | 130kPa |
| MAX AMPLITUDE FREQ f | 1.6MHz | 2.2MHz | 3.5MHz |

(Ro,Sp,P)- FREQUENCY CHARACTERISTIC

| | YELLOW CAPSULE | MAGENTA CAPSULE | CYAN CAPSULE | BLACK CAPSULE |
|---|---|---|---|---|
| CAPSULE RADIUS Ro | 1.5 μm | 1.0 μm | 0.5 μm | 2.0 μm |
| SHELL PARAMETER Sp | 0 | 0 | 0 | 0 |
| APPLIED ULTRASONIC PRESSURE P | 90kPa | 130kPa | 260kPa | 70kPa |
| MAX AMPLITUDE FREQ f | 2.2MHz | 3.5MHz | 8.3MHz | 1.6MHz |

FIG. 44

(Ro,Sp,P)- FREQUENCY CHARACTERISTIC

| | YELLOW CAPSULE | MAGENTA CAPSULE | CYAN CAPSULE |
|---|---|---|---|
| CAPSULE RADIUS Ro | 1.0 μm | 0.5 μm | 0.5 μm |
| SHELL PARAMETER Sp | 2.0 | 0.5 | 0.5 |
| APPLIED ULTRASONIC PRESSURE P | 1000kPa | 375kPa | 975kPa |
| MAX AMPLITUDE FREQ f | 12MHz | 18MHz | 30MHz |

FIG. 45

(Ro,Sp,P)- FREQUENCY CHARACTERISTIC

| | YELLOW CAPSULE | MAGENTA CAPSULE | CYAN CAPSULE | BLACK CAPSULE |
|---|---|---|---|---|
| CAPSULE RADIUS Ro | 1.0 μm | 0.5 μm | 0.5 μm | 1.0 μm |
| SHELL PARAMETER Sp | 2.0 | 0.5 | 2.0 | 0.5 |
| APPLIED ULTRASONIC PRESSURE P | 1000kPa | 375kPa | 975kPa | 400kPa |
| MAX AMPLITUDE FREQ f | 12MHz | 18MHz | 30MHz | 7MHz |

FIG. 46

COLOR IMAGE FORMING METHOD AND APPARATUS, AND MICROCAPSULE TONER FOR USE THEREWITH

BACKGROUND OF THE INVENTION

1. Field of the Invention

The present invention relates to a color image forming method and apparatus using new microcapsule toner breakable with external stimulus.

2. Description of the Related Art

When it comes to color prints, silver (salt) photographs are cited since this technique has been the mainstream for a long time. However, as computers have spread as information devices including personal computers as their core, printers as the peripheral devices of the computers also have spread. As the printers, various color printers have been proposed. Especially, printers of electrophotographic, thermal transfer, inkjet types have made remarkable progress. Color images created by those printers match silver salt photographs taken by analog cameras used in the past in terms of beautifulness and resolution, so that the printers tends to supersede the analog cameras.

FIG. 49 illustrates a prior-art so-called tandem type color image forming apparatus of an electrophotographic system. As shown in FIG. 49, this color image forming apparatus includes four image forming sections 1M, 1C, 1Y and 1K for magenta (M), cyan (C), yellow (Y) and black (K) with corresponding developing devices 2M, 2C, 2Y and 2K.

Recording paper P is carried in a direction of a broken arrow b as a conveyer belt 5 moves counterclockwise as shown by an arrow a in a circulating manner. During this time, optical write heads 3M, 3C, 3Y and 3K of the image forming sections 1M, 1C, 1Y and 1K optically write image data to photosensitive drums 4M, 4C, 4Y and 4K to form corresponding static latent images. The developing devices 2M, 2C, 2Y and 2K develop the latent images as the respective color toner images on the corresponding photosensitive drums.

Then, the photosensitive drum 4M on which the corresponding toner image has been developed transfers a magenta toner image to recording paper P. Then, the cyan, yellow and black toner images are superposed onto the recording paper P in this order. Then, a heat fixing device 6 fixes the resultant toner image to the recording paper, which is then discharged out of the apparatus.

In contrast to the prior-art color image forming apparatus of the electrophotographic system, new-system image forming apparatus are known that applies light/heat corresponding to image information to dedicated recording paper coated with an ink layer containing microcapsules sensitive to external stimulus such as light/heat to thereby form an image, for example, as shown in U.S. Pat. No. 4,734,704.

As in the above patent Published Unexamined Patent Application Hei 11-58832 has proposed an image forming apparatus that uses dedicated recording paper which beforehand contains a developer and four kinds of microcapsules which produce yellow, magenta, cyan and black, and breaks predetermined ones of the four kinds of microcapsules by vibrating the respective microcapsules with ultrasonic vibrating energy of corresponding resonant frequencies to be colored without using light/heat as the external stimulus.

Published Unexamined Patent Application Hei 8-106172 has proposed photoreactive color toner that enables color printing on general paper, the color toner containing three or more kinds of coloring matter capsules coated with different light settable resins which will be set with irradiation of light of corresponding wavelengths, the color toner being transferred to general paper, which is then irradiated with light of three or more kinds of image data different in wavelength to thereby produce a full color image, and a printing method using such color toner.

Published Unexamined Patent Application Hei 11-58833 has proposed a method of forming an image comprising the steps of uniformly coating a surface of a rotating carrier with four hollow yellow, magenta, cyan and black-colored grains having different resonant frequencies, charging the four differently colored hollow grains electrically, vibrating the selected colored hollow grains with ultrasonic vibration energy of the corresponding resonant frequency to thereby produce a corresponding color, and transferring the colored hollow grains to general paper to thereby form an image.

The prior-art electrophotographic color image forming apparatus are excellent in that general paper is usable as recording paper P, but require respective various color inks and toners. Thus, management of the consumption articles is complicated. In addition, high accuracy is required for causing the respective color images to coincide in position.

In addition, a plurality of (for example, four) developing devices and image forming devices need be provided in the single color image forming apparatus. Thus, the number of components of the apparatus increases and the apparatus itself becomes large-sized. High accuracy is also required for causing printed colors to coincide in position. Thus, assembling the apparatus in a factory requires much time, which would lead to a reduction in the work efficiency. The structure also becomes complicated and is disadvantageous in view of reducing the apparatus weight.

In the U.S. Pat. No. 4,734,704 and Published Unexamined Patent Application Hei 11-58832 use dedicated recording paper coated with an ink layer containing microcapsules, the whole surface of the recording paper is basically coated with ink, which increases the cost. In addition, general paper cannot be used in this patent. Further more, since a plurality of color printing steps is repeated, so that a discrepancy in position between color image is difficult to correct and complication of the composition of the apparatus cannot be avoided.

While the invention disclosed in Published Unexamined Patent Application Hei 8-106172 is improved in that general paper is usable. However, use of optical stimulus is required as a premise. Thus, the transparency of light to coloring matter capsules contained in the toner is low. The coating resin is set with the light energy, so that the responsiveness is low. Therefore, this method cannot satisfy recent high-speed printing.

In the Published Unexamined Patent Application Hei 11-58833 that can use general paper, the ultrasonic vibration energy is used and the responsiveness is high. However, the four kinds of coloring hollow grains are dispersed in the receiving section, so that management of a quantity of each of the four kinds of coloring hollow grains when the quantity changes is complicated. Thus, further improvement is required for practical use.

SUMMRY OF THE INVENTION

The present invention has been made in view of the above problems. It is an object of the present invention to provide a method and apparatus simple in structure and excellent in high speed response for forming a color image easily on general paper, by using larger microcapsules each of which contains scattered smaller microcapsules, each containing a color former inside a protective wall breakable by a stimulus of ultrasonic vibrations.

In order to achieve the above object, according to the present invention there is provided a color image forming method using microcapsule toner which includes a plurality of larger microcapsules each of which contains a plurality of kinds of smaller microcapsules dispersed therein, each smaller microcapsule having a protective wall breakable with an ultrasonic wave of a corresponding predetermined resonant frequency, each smaller microcapsule containing inside its protective wall one of two reacting substances that react with each other when mixed to thereby cause a coloring reaction and the other of the two reacting substances being disposed outside the protective wall, the method comprising the steps of forming a toner image on an image carrier by applying the microcapsule toner to the image carrier in accordance with image information or forming a toner image pattern on the image carrier depending on the image information and then applying the microcapsule toner to the toner image pattern to thereby form a toner image, transferring the toner image, formed on the image carrier, directly or through an intermediate transfer medium to paper, irradiating the toner image applied to the image carrier with an ultrasonic wave of a predetermined resonant frequency corresponding to a color component item of the image information between the time when the toner image was formed by applying the microcapsule toner to the image carrier and the time when the toner image was transferred to the paper such that the protective wall of a relevant one of the plurality of kinds of smaller microcapsules is broken by the ultrasonic wave of the predetermined resonant frequency to thereby cause the reacting substances to mix and react with each other to color the toner image, fixing the colored toner image to the paper whereby a color image based upon the toner image is formed on the paper.

Briefly, the present invention is the method of forming the color image using microcapsule toner that comprises forming on the image carrier the toner image of the microcapsule toner whose composition is described above, transferring the toner image directly or through an intermediate transfer medium such as the intermediate transfer belt to paper, irradiating the transferred toner image with the ultrasonic wave in accordance with the image information between the time when the toner image was formed on the image carrier and the time when the toner image is transferred to the paper to thereby selectively break the microcapsule toner to be colored, and fixing the toner image to the paper to thereby form the colored image on the paper.

By such composition, a color image can be formed on general paper, using the microcapsule toner.

In order to achieve the above object, according to the present invention there is also provided a method of forming a color image using microcapsule toner that includes larger microcapsules each of which contains a plurality of kinds of smaller microcapsules dispersed therein, each smaller microcapsule having a protective wall breakable with an ultrasonic wave having a corresponding predetermined resonant frequency, each smaller microcapsule containing one of two reacting substances that react with each other when mixed to thereby cause a coloring reaction and the other of the two reacting substances being disposed outside the protective wall thereof, the method comprising the steps of: electrically charging the image carrier to a predetermined voltage level, forming a static latent image of a voltage level pattern in accordance with image information on the image carrier charged in the charging step, applying the microcapsule toner to the latent image formed on the image carrier, irradiating the microcapsule toner applied to the latent image with an ultrasonic wave of a predetermined resonant frequency corresponding to a color component item of the image information to break the protective wall of a relevant one of the plurality of kinds of smaller microcapsules such that the two reacting substances mix and react with each other to thereby color the toner image, transferring the colored toner image directly or through an intermediate medium to paper, fixing the transferred microcapsule toner to the paper whereby a colored image based upon the colored toner is formed on the paper.

Briefly, the present invention is also the method of forming the color image using microcapsule toner that comprises charging the image carrier to the predetermined voltage level, forming the static latent image of the voltage level pattern in accordance with the image information, applying the microcapsule toner to the latent image to form the toner image, irradiating the toner image on the image carrier with the ultrasonic wave in accordance with the image information such that the microcapsule toner of the toner image is selectively broken to color the toner image, transferring the colored toner directly or through the intermediate transfer medium to paper, and fixing the transferred toner to the paper.

By such composition, a color image is easily formed using the microcapsule toner and a so-called electrophotographic system.

In order to achieve the above object, according to the present invention there is also provided a color image forming method using microcapsule toner which includes a plurality of larger microcapsules each of which contains a plurality of kinds of smaller microcapsules dispersed therein, each smaller microcapsule having a protective wall breakable with an ultrasonic wave of a corresponding predetermined resonant frequency, each smaller microcapsule containing inside its protective wall one of two reacting substances that react with each other when mixed to thereby cause a coloring reaction and the other of the two reacting substances being disposed outside the protective wall, the method comprising the steps of electrically charging the image carrier to a predetermined voltage level, forming a static latent image of a voltage level pattern in accordance with image information on the image carrier charged in the charging step, applying the microcapsule toner to the latent image formed on the image carrier to thereby form a toner image, transferring the toner image on the image carrier to an intermediate transfer medium, irradiating the transferred toner image with an ultrasonic wave of a predetermined resonant frequency corresponding to a color component item of the image information to break the protective wall of a relevant one of the plurality of kinds of smaller microcapsules such that the two reacting substances mix and react with each other to thereby color the toner image, transferring the colored toner image to the paper, and fixing the transferred toner image to the paper whereby a color image based upon the colored toner is formed on the paper.

Briefly, the present invention is also the method of forming the color image using microcapsule toner that comprises charging the image carrier to the predetermined voltage level, forming the static latent image of the voltage level pattern in accordance with the image information, applying the microcapsule toner to the latent image to form a toner image, temporarily transferring the toner image to an intermediate transfer medium such as the intermediate transfer belt, irradiating the toner image on the intermediate transfer medium with the ultrasonic wave in accordance with the image information such that the toner image is selectively broken to be colored, and transferring and fixing the colored toner image to the paper.

By such composition, a color image is easily formed using the microcapsule toner and a so-called electrophotographic system. The arrangement in which after the toner image was temporarily transferred to the intermediate transfer medium, the toner image on the intermediate transfer medium is irradiated with the ultrasonic wave is desirable because the ultrasonic wave can easily be transmitted securely to the toner image directly and not through air.

In order to achieve the above object, according to the present invention there is also provided a color image forming apparatus using microcapsule toner which includes a plurality of larger microcapsules each of which contains a plurality of kinds of smaller microcapsules dispersed therein, each smaller microcapsule having a protective wall breakable with an ultrasonic wave of a corresponding predetermined resonant frequency, each smaller microcapsule containing inside its protective wall one of two reacting substances that react with each other when mixed to thereby cause a coloring reaction and the other of the two reacting substances being disposed outside the protective wall, the apparatus comprising toner image forming means for forming a toner image on an image carrier by applying the microcapsule toner to the image carrier in accordance with image information or forming a toner image pattern on the image carrier depending upon the image information and for applying the microcapsule toner to the toner image pattern to thereby form a toner image, transferring means for transferring the toner image formed, on the image carrier, directly or through an intermediate transfer medium to paper, coloring means for irradiating the toner image on the image carrier with an ultrasonic wave of a predetermined resonant frequency corresponding to a color component item of the image information between the time when the toner image was formed on the image carrier and the time when the toner image was transferred to the paper such that the protective wall of a relevant one of the plurality of kinds of smaller microcapsules is broken by the ultrasonic wave of the predetermined resonant frequency to thereby cause the reacting substances to mix and react with each other to thereby color the toner image, and fixing means for fixing the colored toner image to the paper whereby a color image based upon the toner image is formed on the paper.

Briefly, the present invention is the apparatus for forming the color image using microcapsule toner. The toner image forming means forms on the image carrier the toner image. The toner image is transferred directly or through an intermediate transfer medium such as the intermediate transfer belt to the paper and then fixed to the paper. The coloring means irradiates the toner image with the ultrasonic wave in accordance with the image information between the time when the toner image was formed on the image carrier and the time when the toner image was transferred to the paper to selectively break the microcapsule toner of the toner image to color the toner image, and fixes the colored toner image to paper to thereby form the color image on the paper.

By such composition, a small color image forming apparatus is provided which is capable of forming the color image on general paper, using the microcapsule toner.

In this inventive color image forming apparatus, the toner image forming means may comprise charging means for charging the image carrier to a predetermined voltage level, static latent image forming means for forming a static latent image of a voltage level pattern in accordance with image information on the image carrier charged by the charging means, and developing means for applying the microcapsule toner to the latent image formed on the image carrier to thereby develop the latent image. The coloring means is disposed at a position where it colors the toner image between development of the latent image by the developing means and the transfer of the toner image by the transferring means.

According to such arrangement, the color image forming apparatus is provided that uses the microcapsule toner and a so-called electrophotographic system.

In the inventive color image forming apparatus, the transferring means may comprise intermediate transfer means for transferring the microcapsule toner on the image carrier to an intermediate transfer medium. The coloring means may be disposed at a position where it colors the toner image transferred to the intermediate transfer medium. The coloring means may irradiate the toner image transferred to the intermediate transfer medium with the ultrasonic wave of the predetermined resonant frequency from the side of the toner image. Preferably, the coloring means irradiates the transferred toner image with the ultrasonic wave of the predetermined frequency through an ultrasonic transmission material of a liquid- or solid-phase material and not through a gas-phase material.

In the invention, the position where the coloring means is disposed is specified, and can be selected freely depending on the space within the apparatus. The coloring means may perform the coloring process in a state where the microcapsule toner has been transferred temporarily to the intermediate transfer medium to thereby achieve sure ultrasonic transmission.

In the inventive color forming apparatus, the coloring means may, for example, comprise an ultrasonic line head of a multiplicity of ultrasonic elements arranged in a primary scan direction supplied with ultrasonic output signals based upon image information from a plurality of individual applying electrodes to irradiate the plurality of kinds of smaller microcapsules of the toner image with ultrasonic waves of different resonant frequencies corresponding to the respective color components indicated by the image information.

In such composition, the ultrasonic waves are focused in the secondary scan direction to thereby form a color image of high resolution.

The focused width of the ultrasonic wave in the primary scan direction output from any particular ultrasonic element and focused on the toner image corresponds to that of one pixel. The ultrasonic waves produced by those of the plurality of ultrasonic elements disposed in any adjacent limited range of each side of the particular ultrasonic element are focused at the same timing on the same position as the ultrasonic waves produced by the particular ultrasonic element, which is performed by sequentially shifting the timing of outputting the ultrasonic waves based upon the distance between the focusing position and each of the ultrasonic elements.

In such composition, the ultrasonic output with which one pixel is irradiated is increased to the energy that can break the outer shell of the microcapsule.

In this color image forming apparatus, the ultrasonic element may comprise a piezoelectric element, for example.

The image information corresponding to the toner image formed by the toner image forming means may comprise ORed items of image information about the respective colors. The image information delivered to the coloring means may comprise items of image information about the respective colors.

By such composition, the toner image is formed by the microcapsule toner on the image carrier based upon the ORed items of the image information about the respective colors. Then, the microcapsule toner is selectively colored by the coloring means to thereby form the color image.

In order to achieve the above object, according to the present invention there is also provided a color image forming apparatus comprising converting means for converting video data to print data, OR operation means for performing an OR operation on items of image information about the respective colors contained in the print data, ultrasonic output signal producing means for producing an ultrasonic output signal of a resonant frequency based upon each of the items of the image information about the respective colors, and coloring means for producing an ultrasonic wave in accordance with the ultrasonic output signal of the resonant frequency and for irradiating the microcapsule toner with the ultrasonic wave to thereby color the microcapsule toner.

In the present invention, the OR operation may be constituted as a circuit means for forming a static latent image on the image carrier. The ultrasonic output signal producing means may be constituted as a circuit for coloring the microcapsule toner selectively. These means may constitute an important part of the color image forming apparatus.

In the inventive color image forming apparatus, the microcapsule toner may include a plurality of larger microcapsules each of which contains a plurality of kinds of smaller microcapsules dispersed therein, each smaller microcapsule having a protective wall breakable with an ultrasonic wave of a corresponding predetermined resonant frequency, each smaller microcapsule containing inside its protective wall one of two reacting substances that react with each other when mixed to thereby cause a coloring reaction and the other of the two reacting substances being disposed outside the protective wall such that the protective wall of a relevant one of the plurality of kinds of smaller microcapsules is broken with irradiation of the ultrasonic wave of the corresponding resonant frequency to thereby cause the two reacting substances to mix and react with each other to perform a coloring reaction.

The ultrasonic output signal producing means may produce an ultrasonic wave of a resonant frequency signal that produces a relevant color of magenta, cyan, yellow and black or otherwise no resonant frequency signal and hence no color.

By such composition, as long as no smaller microcapsule is broken, no color is applied to any one of the image carrier, intermediate transfer medium and paper. Thus, even when a toner image is formed by the microcapsule toner, no coloring process has been performed. Thus, even if a microcapsule toner which is not colored adheres to the final paper, there arise no problems.

In the inventive color image forming apparatus, the ultrasonic output signal producing means produces image information smaller in pixel number than the ORed data produced by the OR operation means, and delivers the produced image information to the coloring means. For example, the ultrasonic output signal producing means delivers to the coloring means information on an image smaller in length and breadth than the toner image formed on the image carrier. The coloring means irradiates the toner image with ultrasonic waves indicative of the image information to thereby form an image smaller than the toner image.

By such composition, even when the respective color images do not coincide in position with the toner image formed based upon the ORed data, such discrepancy in position is eliminated in a certain range.

In order to achieve the above object, according to the present invention there is also provided a microcapsule toner which includes a plurality of larger microcapsules each of which contains a plurality of kinds of smaller microcapsules dispersed therein, each smaller microcapsule having a protective wall breakable with an irradiating ultrasonic wave of a corresponding predetermined resonant frequency, each smaller microcapsule containing inside its protective wall one of two reacting substances that react with each other when mixed to thereby cause a coloring reaction and the other of the two reacting substances being scattered outside the protective wall such that the protective wall of a specified one of the plurality of kinds of smaller microcapsules is broken by irradiation of the ultrasonic wave of the corresponding predetermined resonant frequency to thereby cause the two reacting substances to mix and react with each other to produce a coloring reaction;

The smaller microcapsules contained in the larger microcapsule may be supported dispersively by a supporting material such as resin within the lager microcapsule.

The smaller microcapsule is resonated with irradiation of the ultrasonic wave of the corresponding resonant frequency and selectively cracked and broken. As a result, the coloring material contained in the smaller microcapsule mixes and reacts with the developer to produce a corresponding color, which contributes to forming a color image.

In this microcapsule toner, one of the two reacting substances may be a color former and the other may be a developer. Thus, the color former mixes and reacts with the developer to produce a corresponding color selectively. If there are other materials that can produce a color, the color former and development need not be used.

In this microcapsule toner, the other reacting substance may be dispersed, for example, in a holding material within the larger microcapsule. The holding material may be made of a resin and the smaller microcapsules may be dispersed in the holding material.

Such composition simplifies the structure of the capsule toner to thereby facilitate mass production of the capsule toners.

In this microcapsule toner, each of the plurality of kinds of smaller microcapsules may contain at least two different ones of color formers that produce magenta, cyan, yellow and black.

A larger microcapsule can be produced so as to contain smaller microcapsules of any two or more selected color formers.

In the invention, the plurality of kinds of smaller microcapsules preferably comprises color formers of magenta, cyan, yellow and black.

Thus, color printing can be performed in a tandem image forming apparatus using larger microcapsules of two colors.

While the image forming apparatus can perform color printing, using three color formers of magenta, cyan and yellow, the arrangement may be modified such that an ordinary black toner used in the past may be used when ebony color printing is required.

In the inventive microcapsule toner, the plurality of kinds of smaller microcapsules contain an air bubble.

In such arrangement, the bubble can change the acoustic impedance to thereby change the resonant frequency of the ultrasonic wave to break the smaller microcapsule. Thus, the resonant frequency can be set more accurately and finely in a wider range.

In this microcapsule toner, the plurality of kinds of smaller microcapsules may be colorless and transparent before the coloring reaction occurs.

In such composition, as long as the smaller microcapsules are broken none of the color carrier, intermediate transfer medium and paper are not colored. Therefore, even when uncolored microcapsule toners adhere, for example, to paper, no problems arise.

In this microcapsule toner, the plurality of kinds of smaller microcapsules are different in at least one of outer diameter, shell thickness and material so as to be broken by ultrasonic waves of different resonant frequencies, respectively. For example, the outer diameter of the smaller microcapsule increases, its resonant vibrations occur at a lower frequency. As the thickness of the outer shell of the smaller microcapsule increases, its resonant frequency increases. As the material of the shell is hardened, its resonant frequency increases. Thus, the resonant frequency can be set more accurately in a wider range.

In this microcapsule toner, when the plurality of kinds of smaller microcapsules contained in each larger microcapsule produce four different colors a, b, c and d, a ratio in number Na:Nb:Nc:Nd of the smaller microcapsules that produce the respective four different colors a, b, c and d may be set so as to satisfy:

$$Na:Nb:Nc:Nd=r_4^3/r_1^3:r_4^3/r_2^3:r_4^3/r_3^3:1$$

where a, b, c and d are the four kinds of colors to be produced by the plurality of kinds of smaller microcapsules contained in each larger microcapsule, and $r_1$, $r_2$, $r_3$, and $r_4$ are the respective radii of the smaller microcapsules that produce the corresponding four kinds of colors and have a relationship $r_1 \leqq r_2 \leqq r_3 \leqq r_4$ In this microcapsule toner the larger microcapsule may be constructed so as to satisfy the following expression:

$$(q/0.4)\times Br^3/r_1^3 \leqq Na \leqq Hr^3/(r_1^3\times 6.4)$$

where a, b, c and d are the four kinds of colors to be produced by the plurality of kinds of smaller microcapsules contained in each larger microcapsule, $r_1$, $r_2$, $r_3$, and $r_4$ are the respective radii of the smaller microcapsules that produce the corresponding four kinds of colors a, b, c and d and have a relationship $r_1 \leqq r_2 \leqq r_3 \leqq r_4$, q is a percent of a total volume of all the color formers occupied in a whole volume of the larger microcapsule, 2Br and 2Hr are the outer and inner diameters, respectively, of the larger microcapsule, and Na is the number of smaller microcapsules of the minimum radius $r_1$.

In such arrangement, the number of smaller microcapsules of a different diameter and a different color is set such that the total coloring densities of the respective colors are the same in the larger microcapsule and hence the smaller microcapsules of one color is equal in total volume to those of another color. Thus, correction of the respective coloring densities is not required in software in the image forming apparatus and the coloring process can be performed directly based upon the image data concerned.

In the microcapsule toner, the number of kinds of colors to be produced by the plurality of kinds of smaller microcapsules is four, and each of the smaller microcapsules that produce the four different colors comprises a grain size with a common error.

By such composition, a bandwidth of resonant frequencies of ultrasonic waves required for the respective smaller microcapsules of four different colors is reduced as a whole to thereby reduce the energy of the ultrasonic output greatly.

BREIF DESCRIPTION OF THE DRAWINGS

The aspect and other features of the present invention will be understood when taken with reference to the accompanying drawings, in which.

Figure 7:
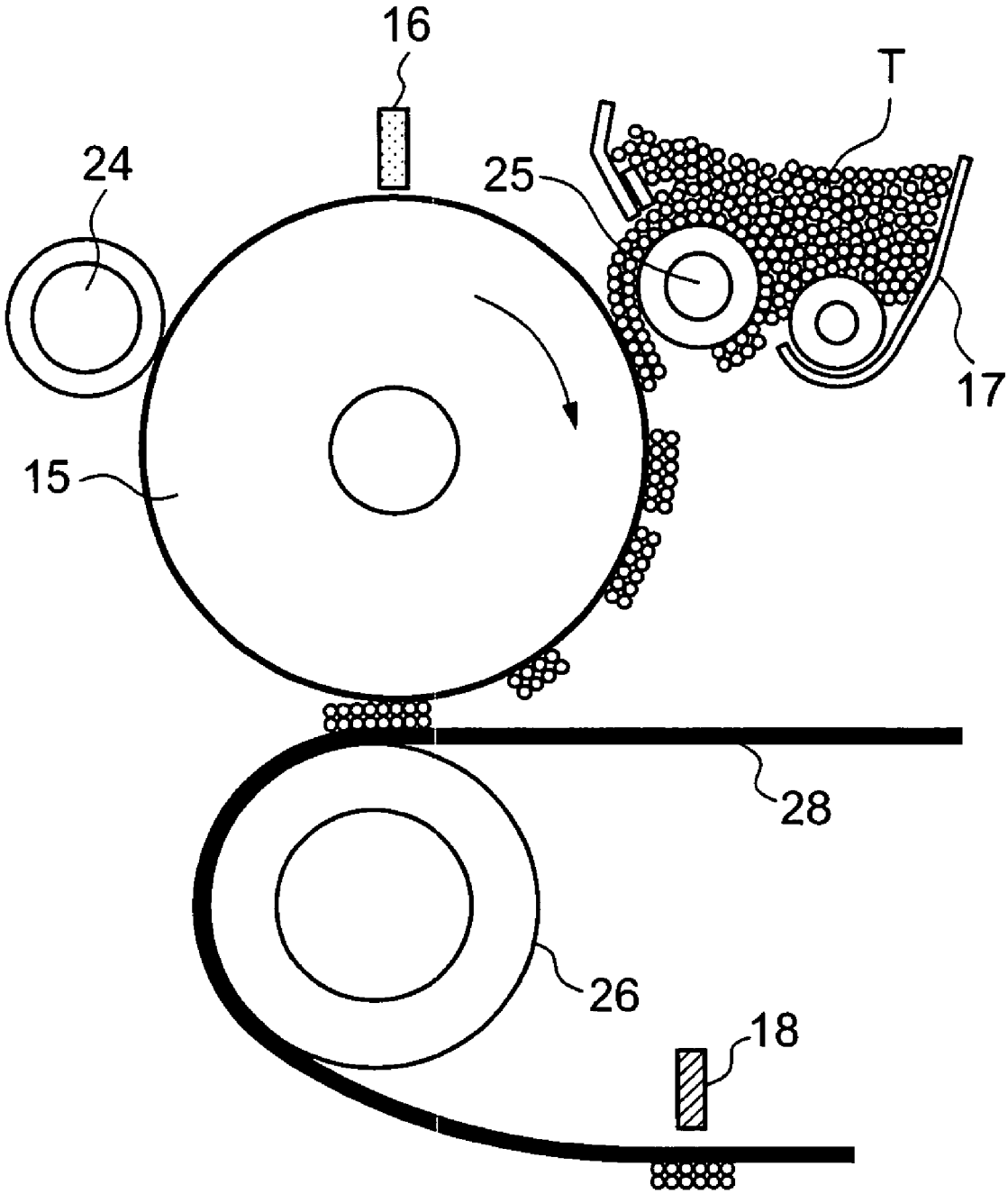
Figure 8A:
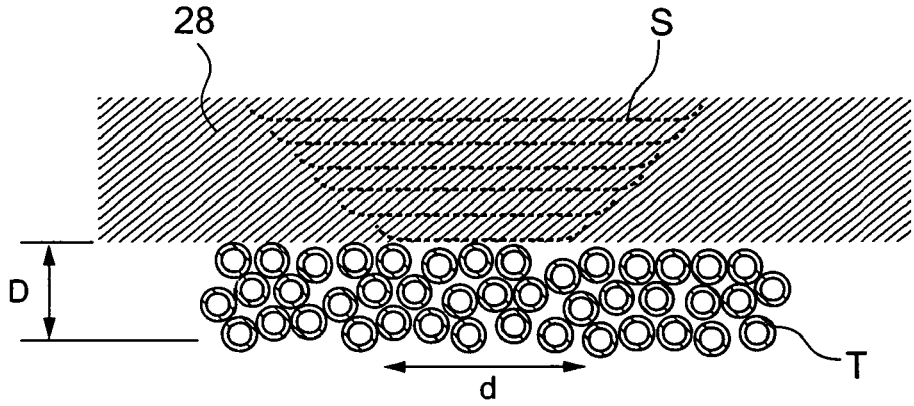
Figure 8B:
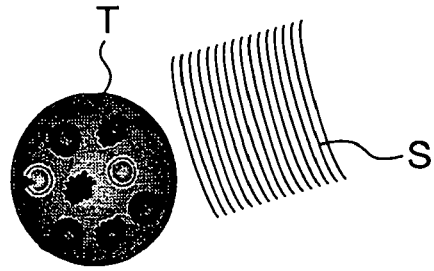
Figure 8C:
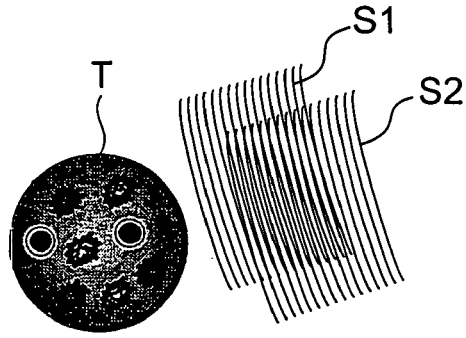
Figure 9:
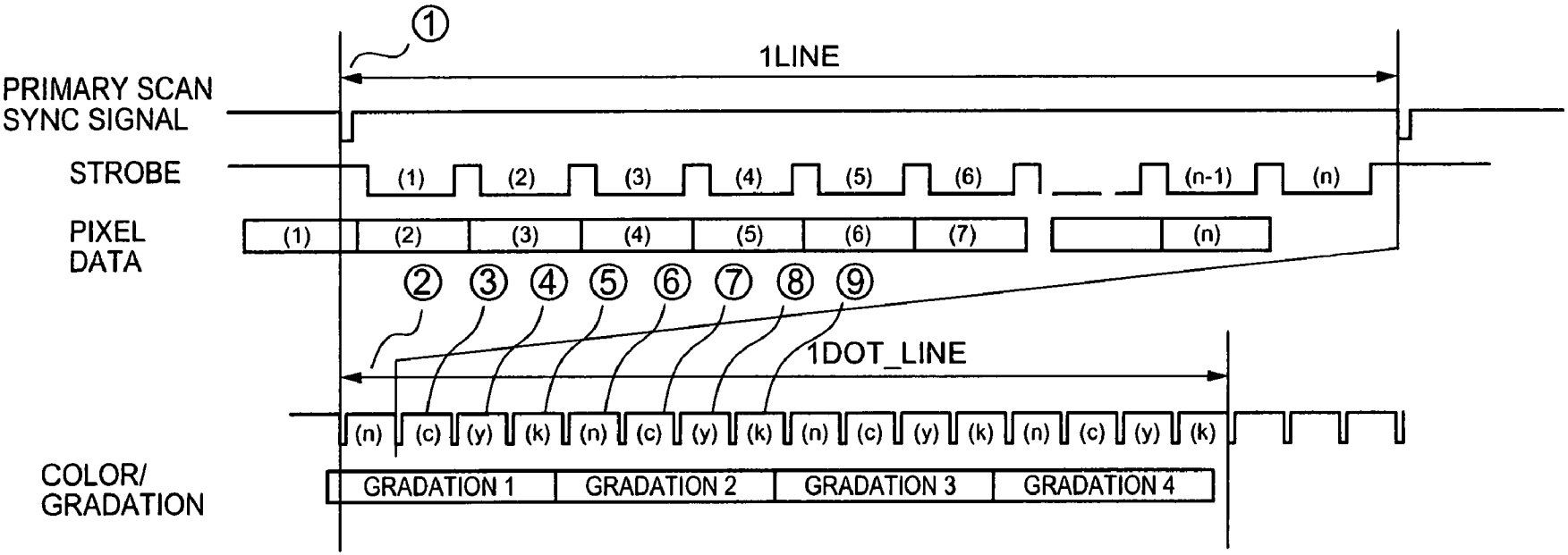
Figure 10C:
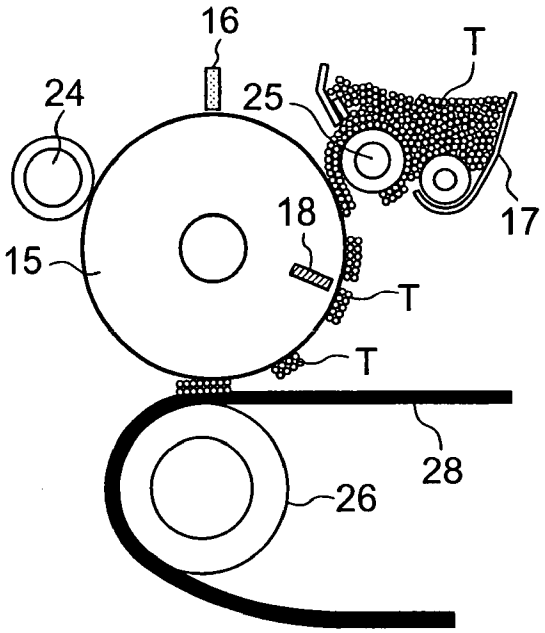
Figure 10B:
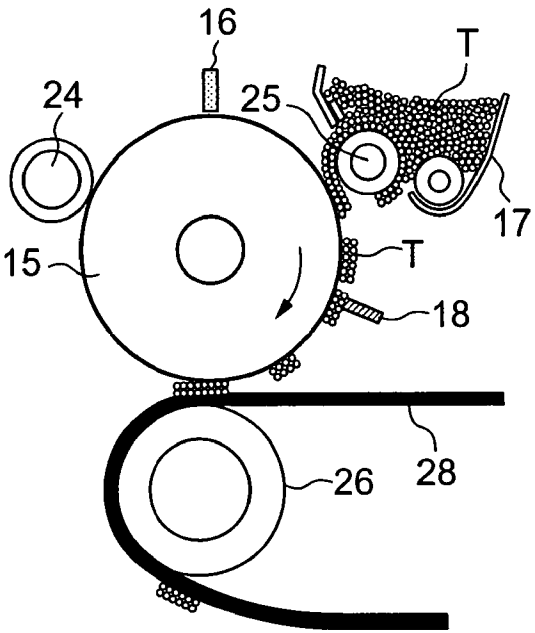
Figure 10A:
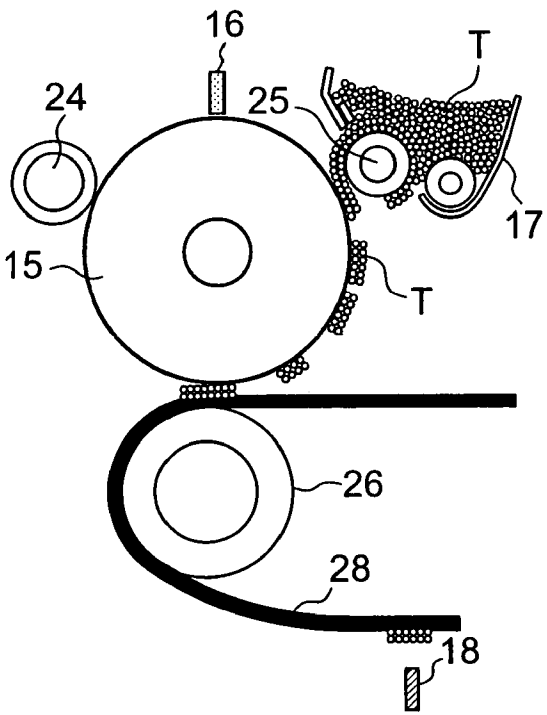
Figure 11:
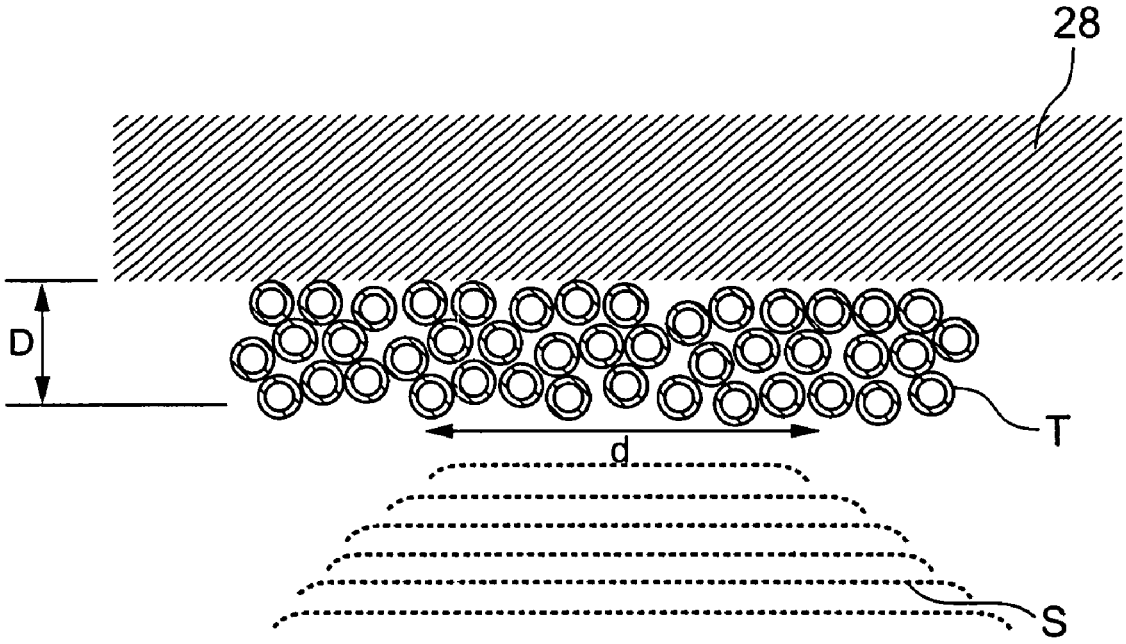
Figure 12:
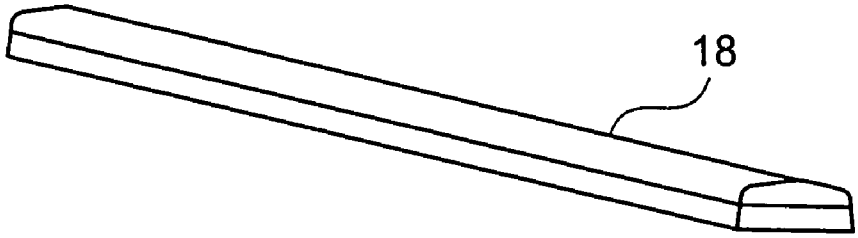
Figure 13A:
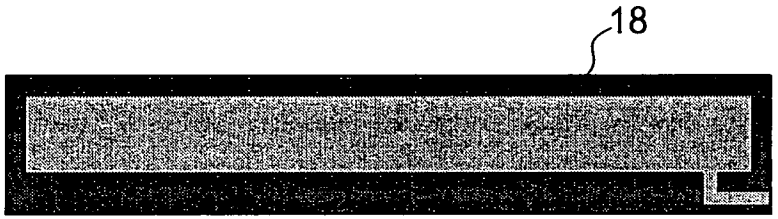
Figure 13B:
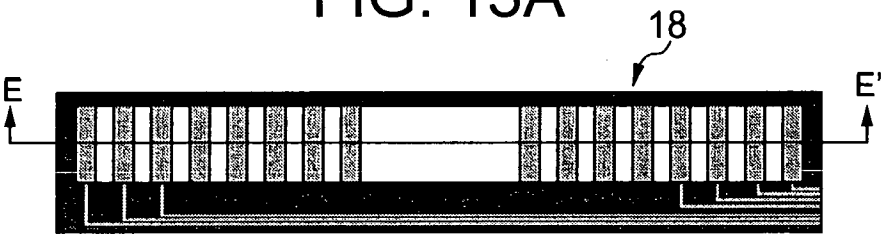
Figure 13C:
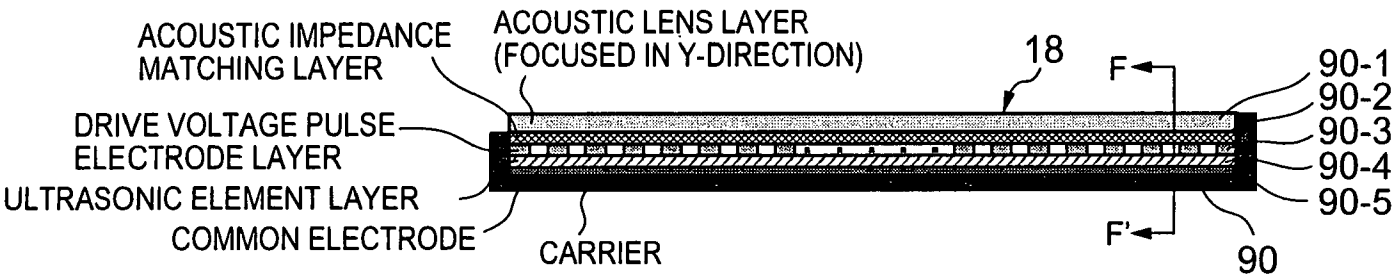
Figure 13D:
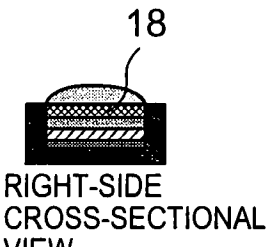
Figure 14:
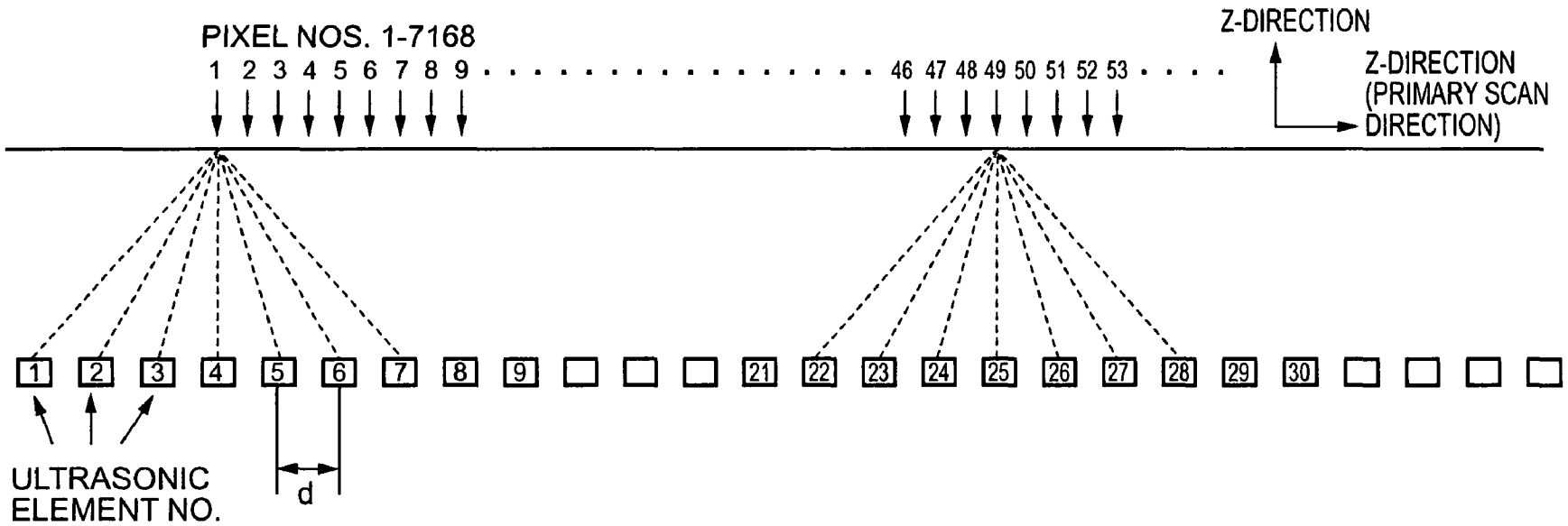
Figure 15:
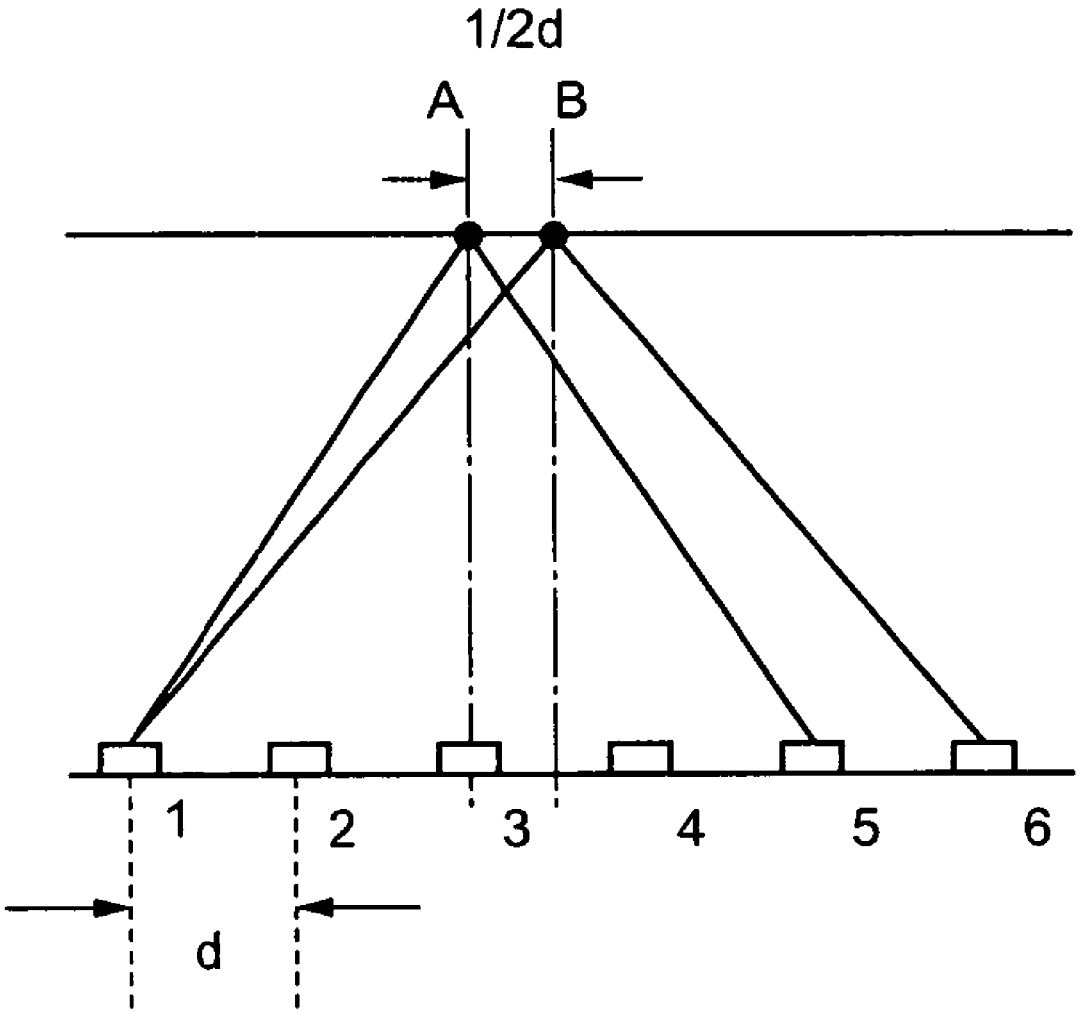
Figure 16:
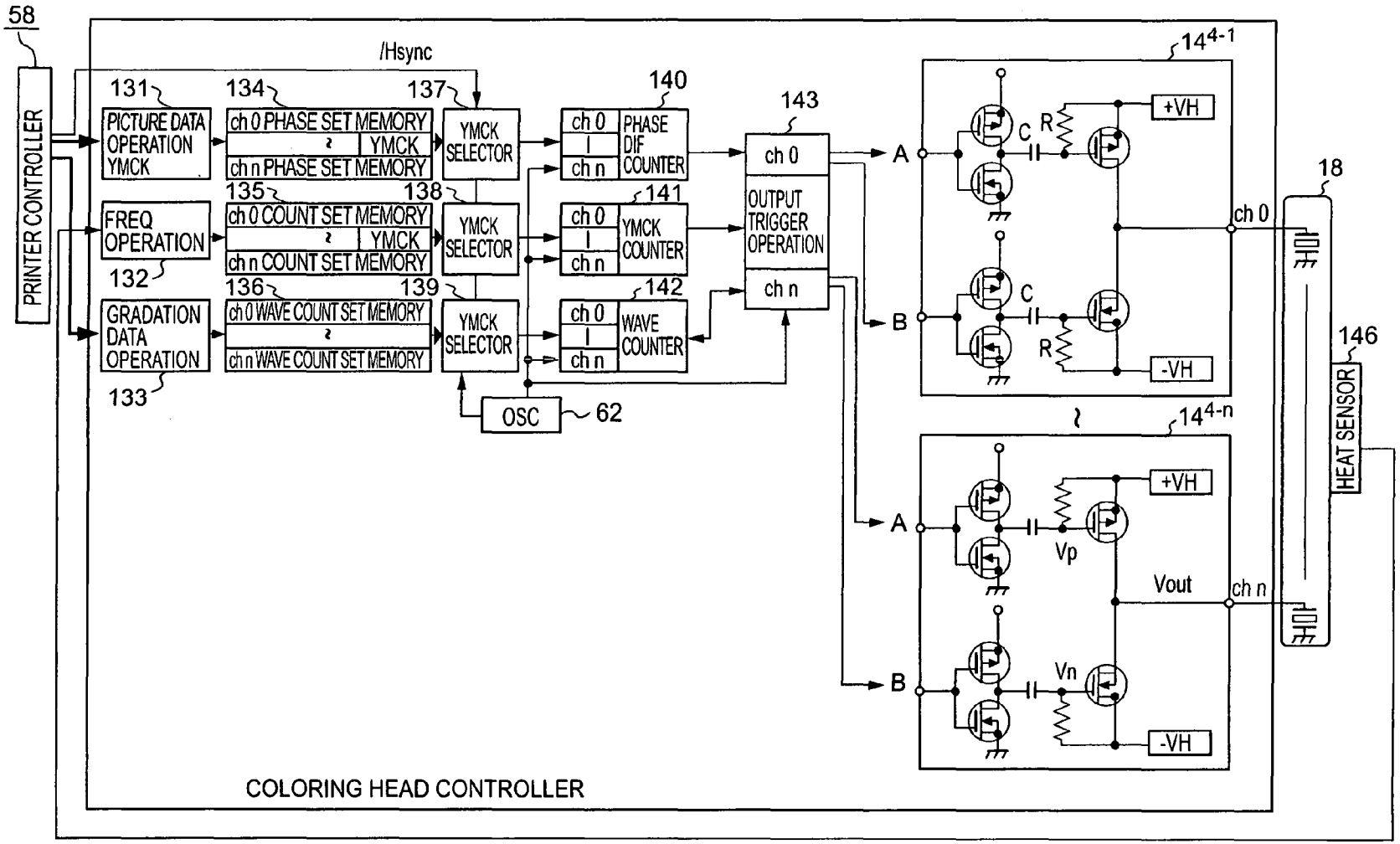
Figure 18:
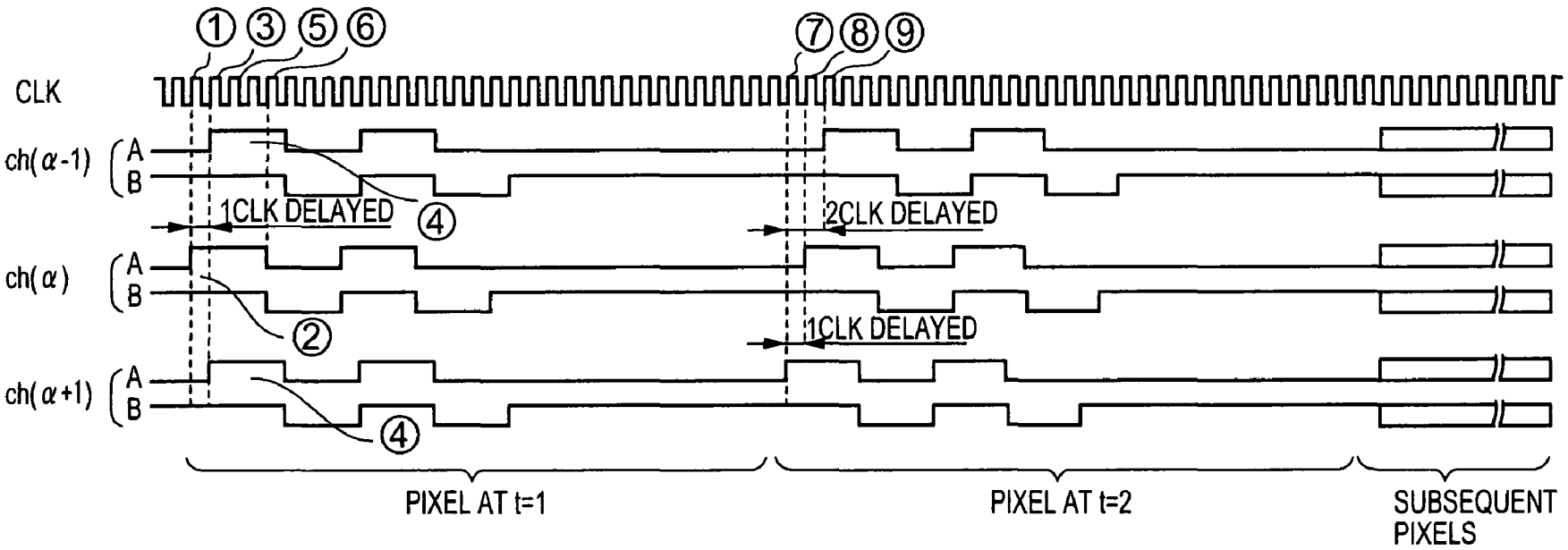
Figure 19:
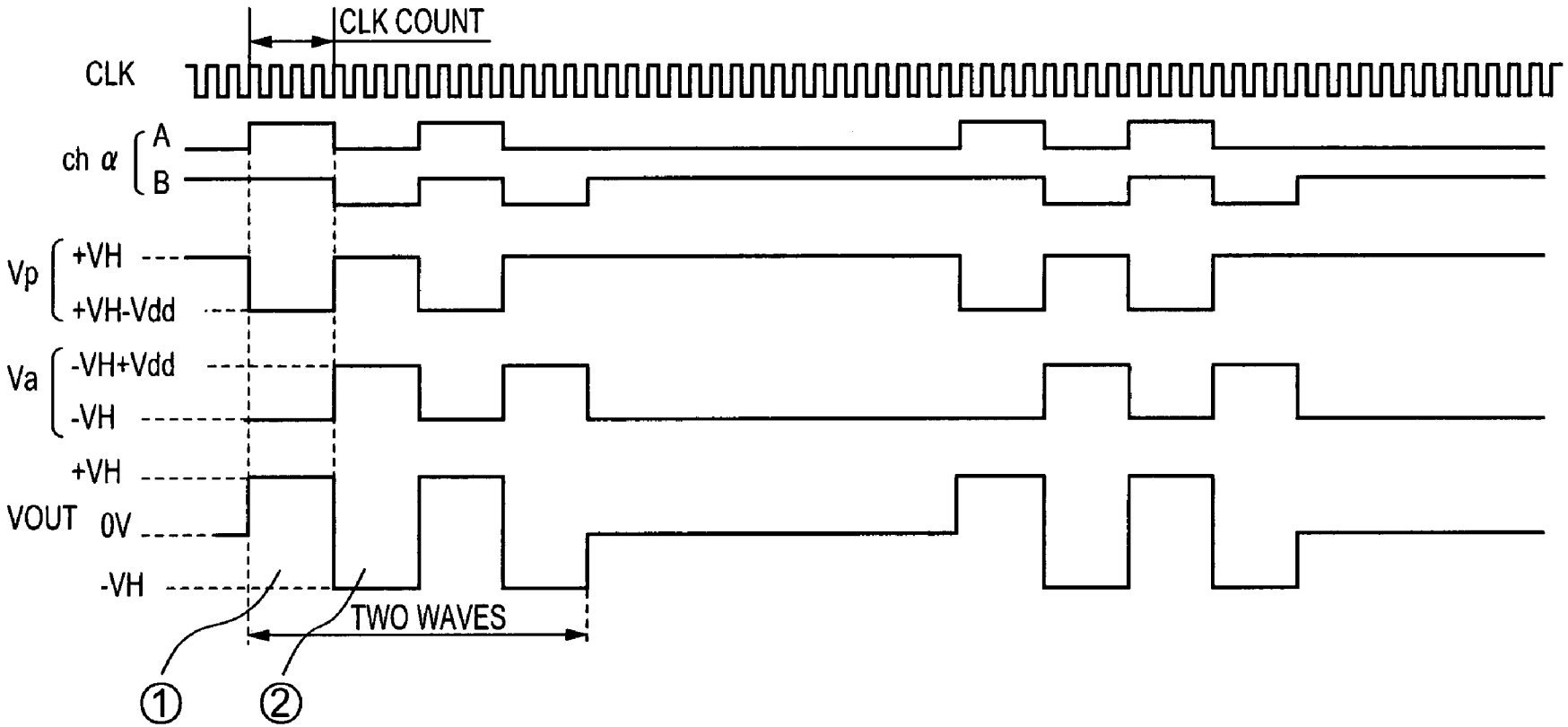
Figure 20:
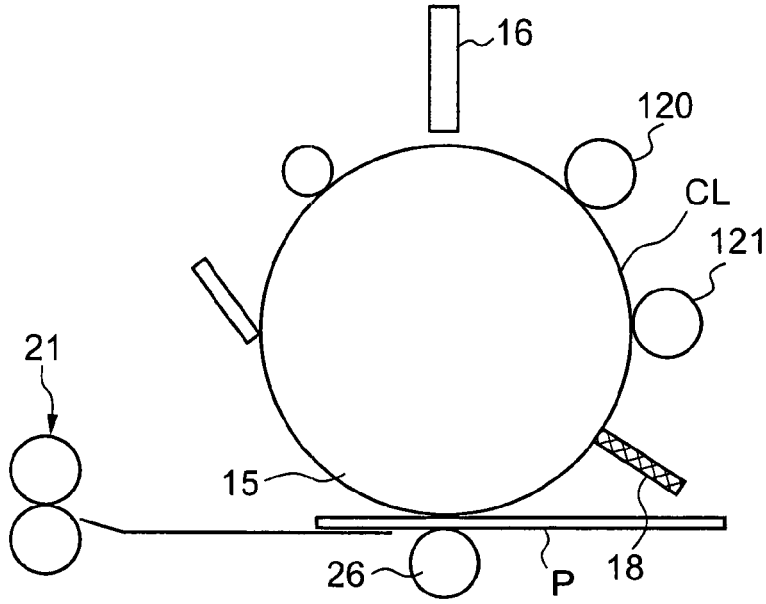
Figure 21:
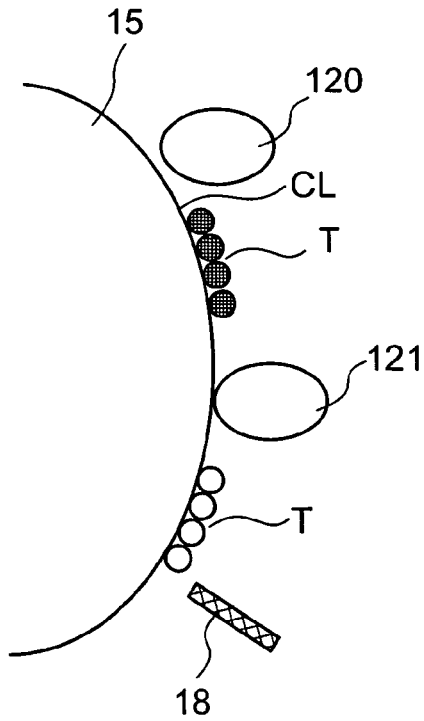
Figure 22:
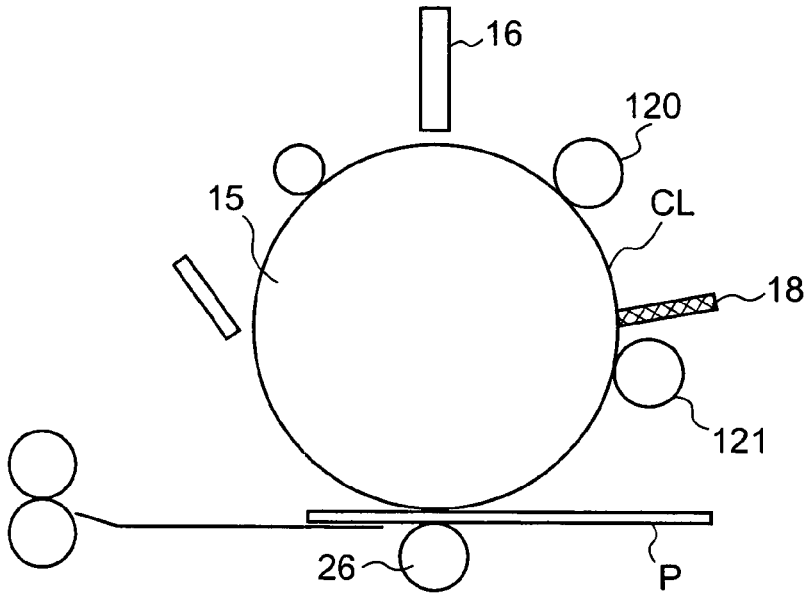
Figure 23:
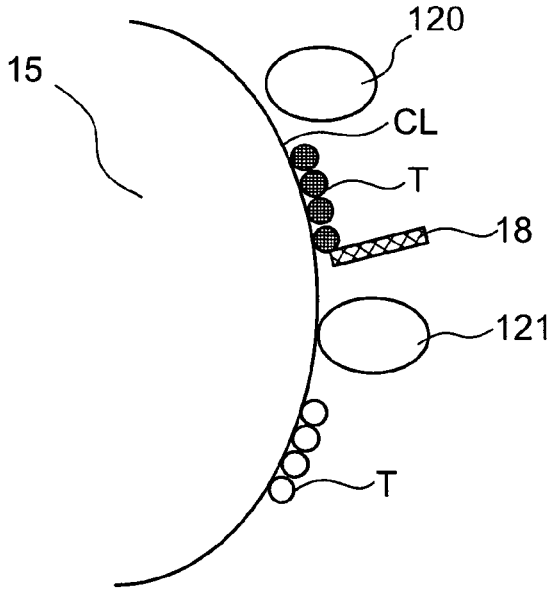
Figure 24:
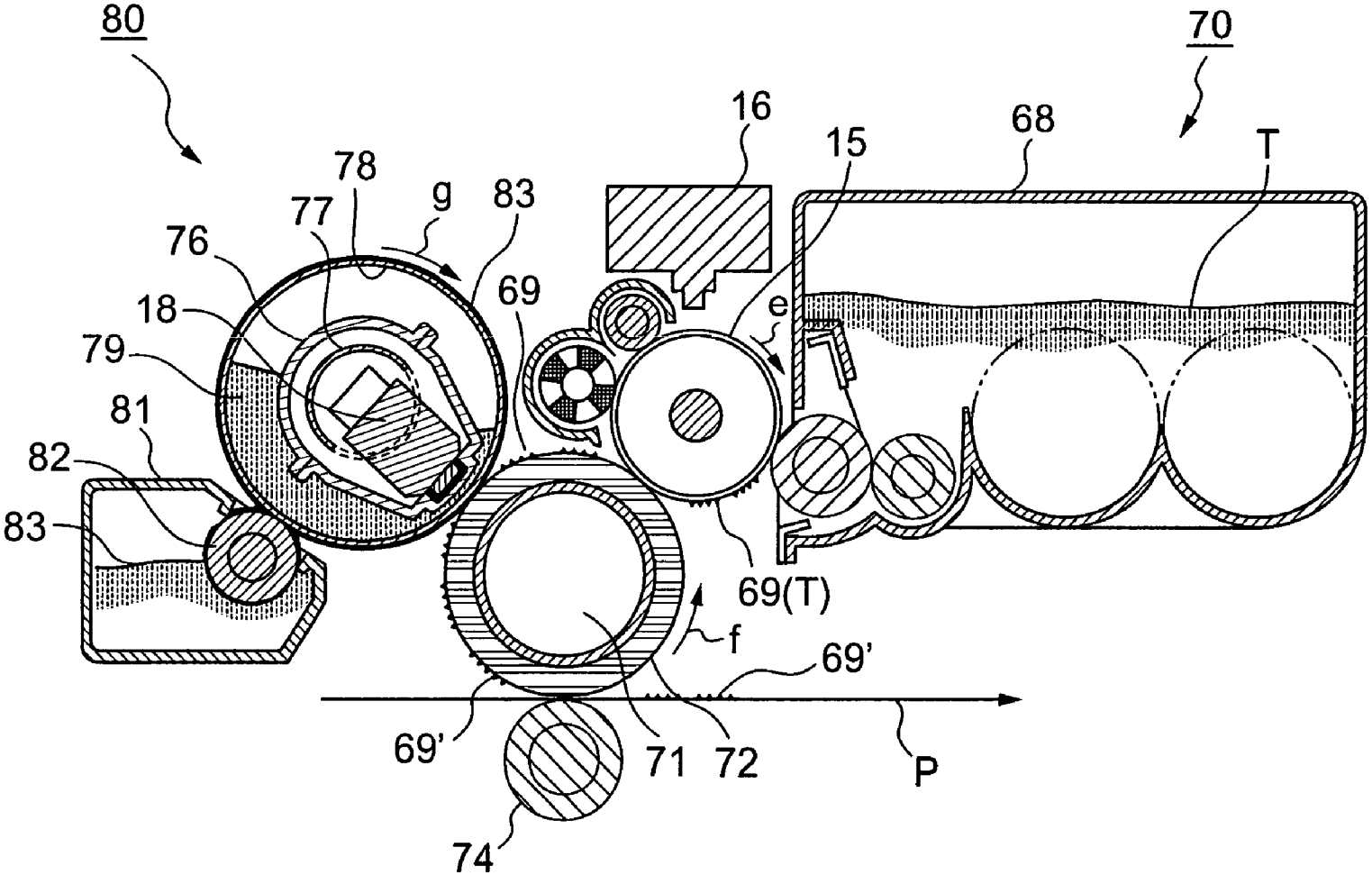
Figure 25:
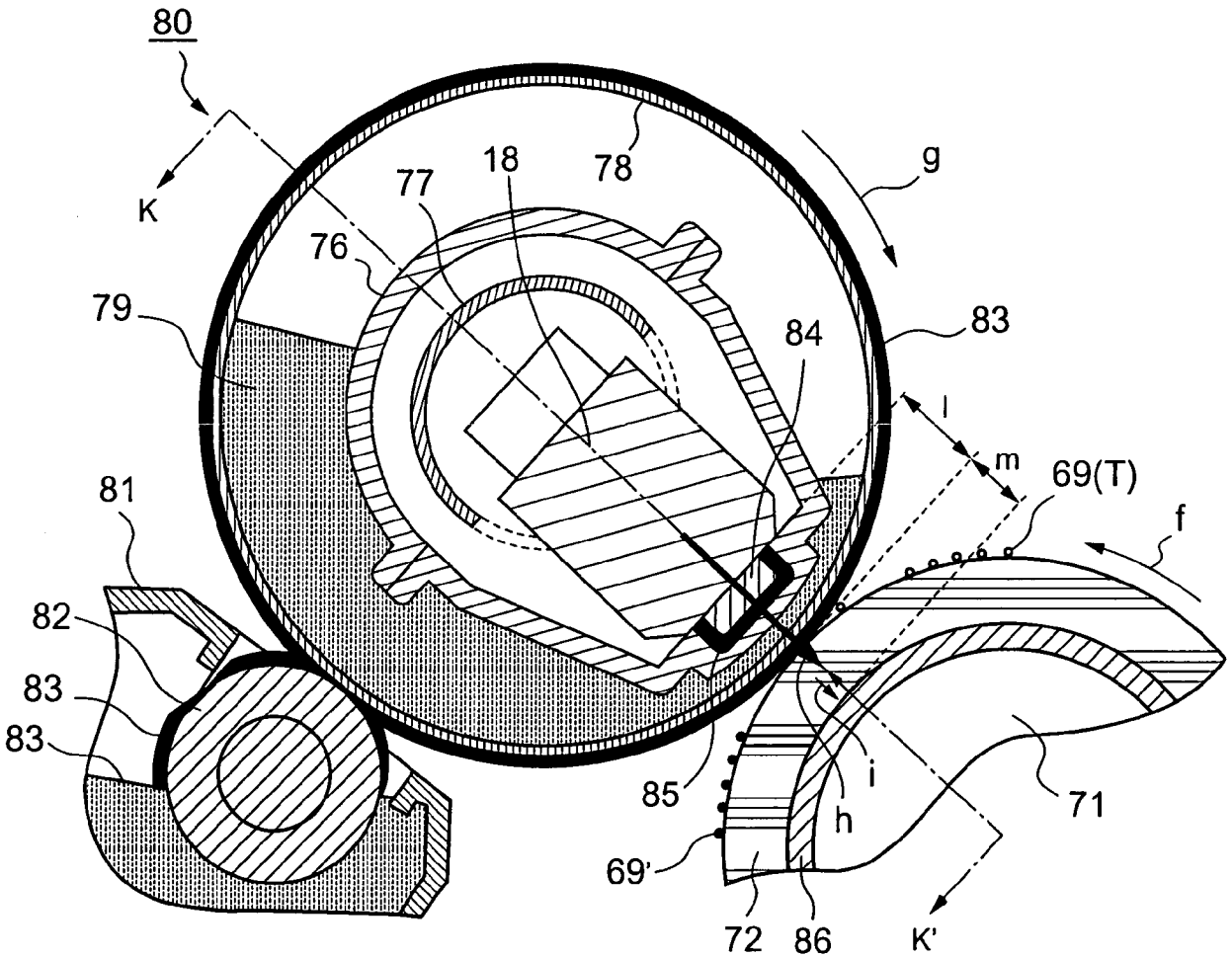
Figure 26:
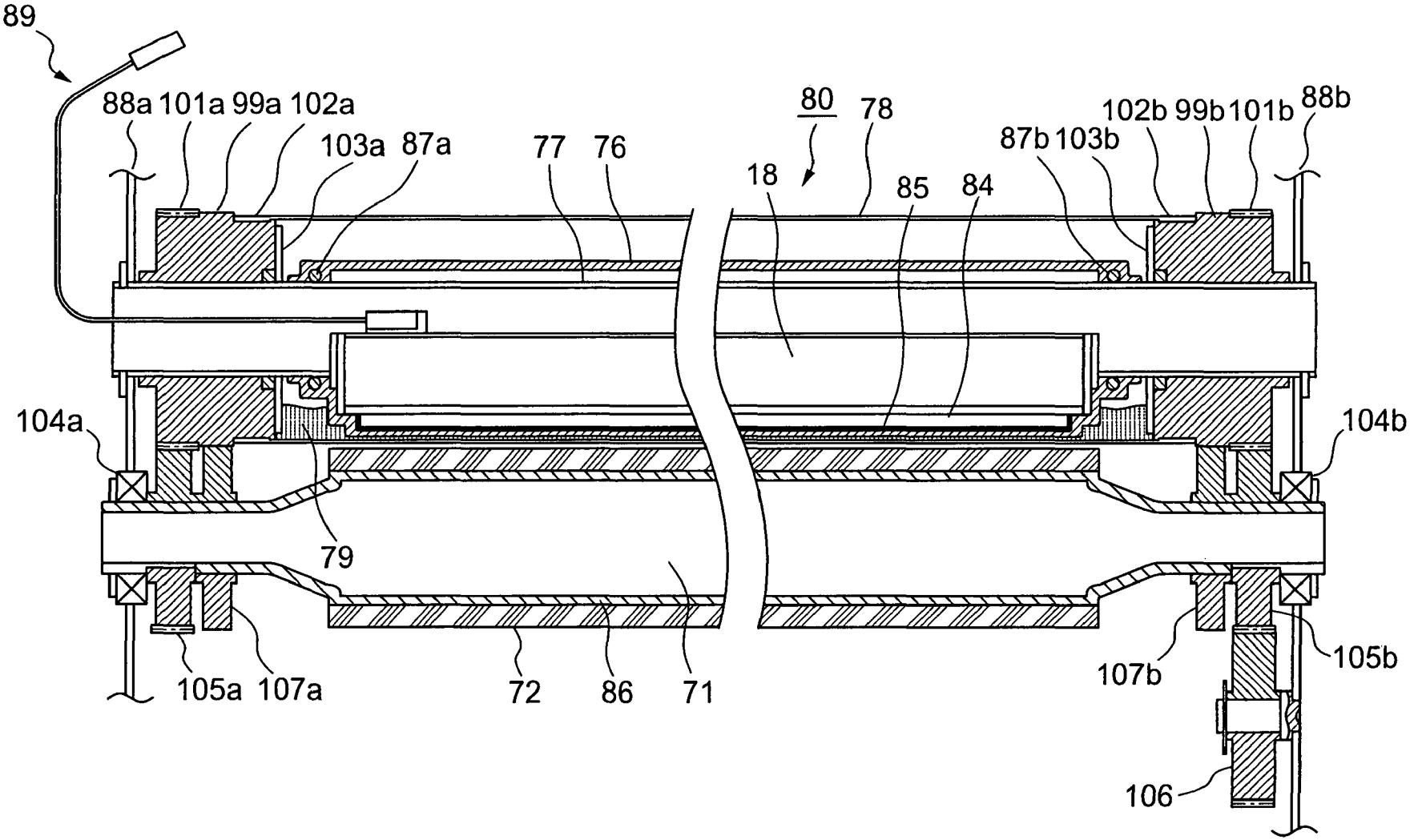
Figure 27:
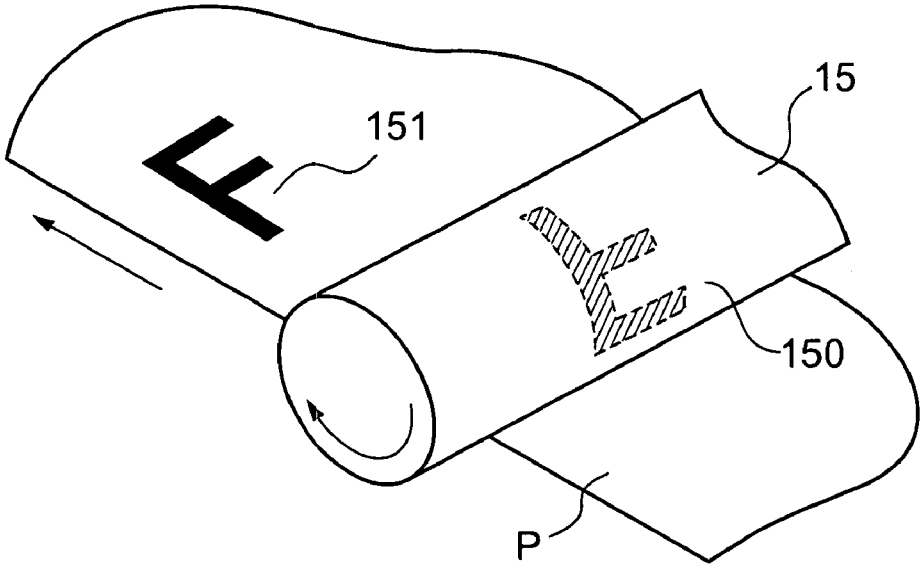
Figure 28A:
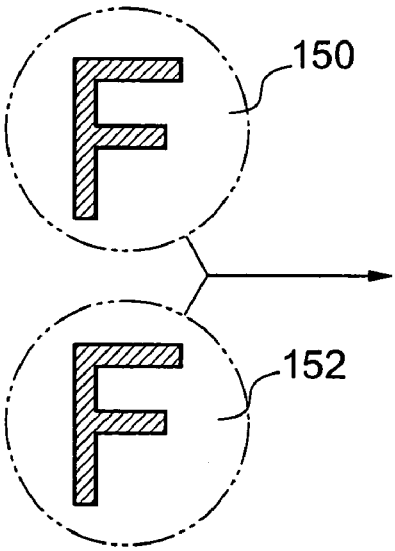
Figure 28B:
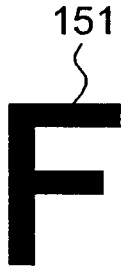
Figure 28C:
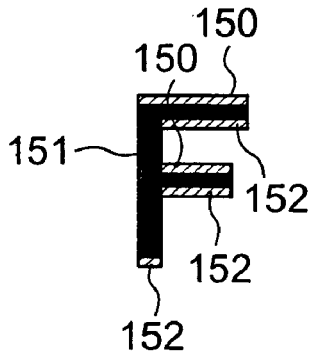
Figure 29A:
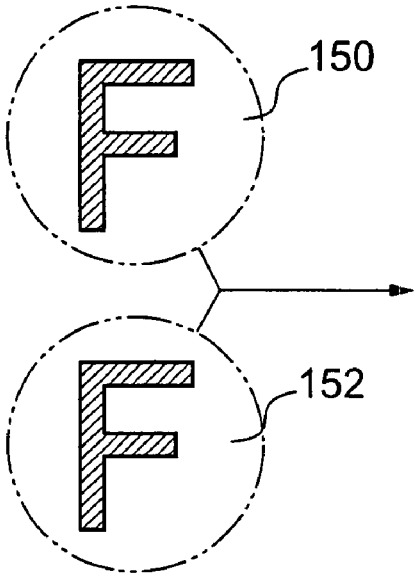
Figure 29B:
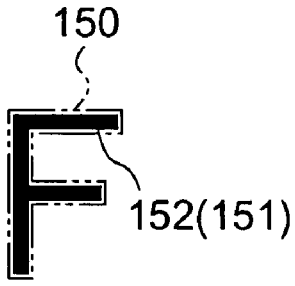
Figure 29C:
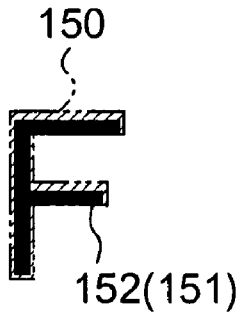
Figure 30:
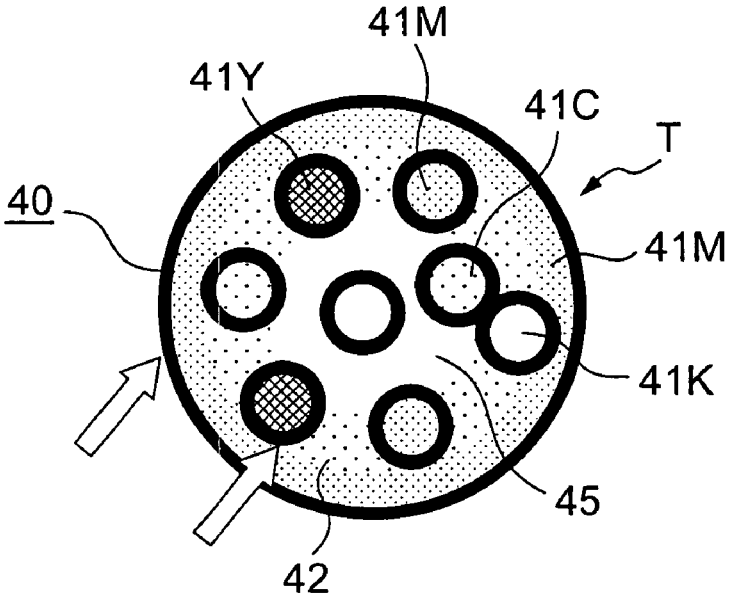
Figure 31A:
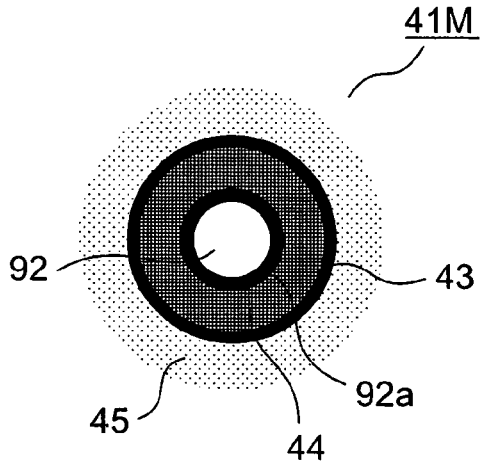
Figure 31B:
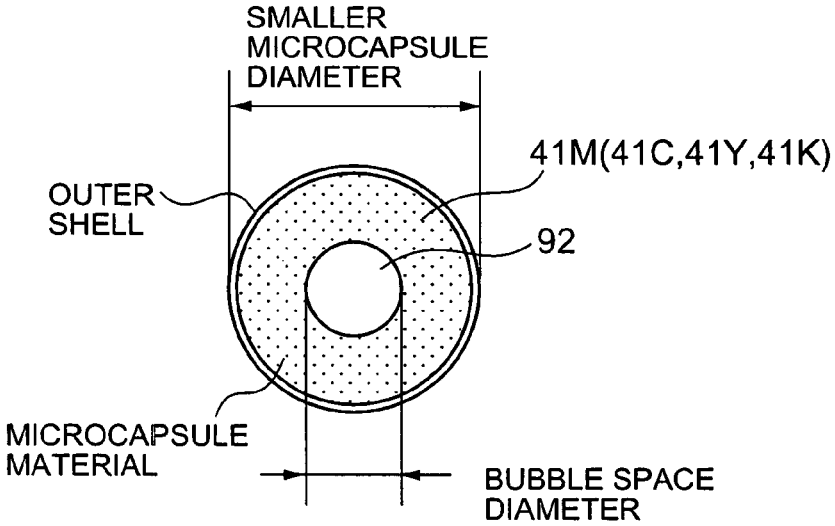
Figure 32:
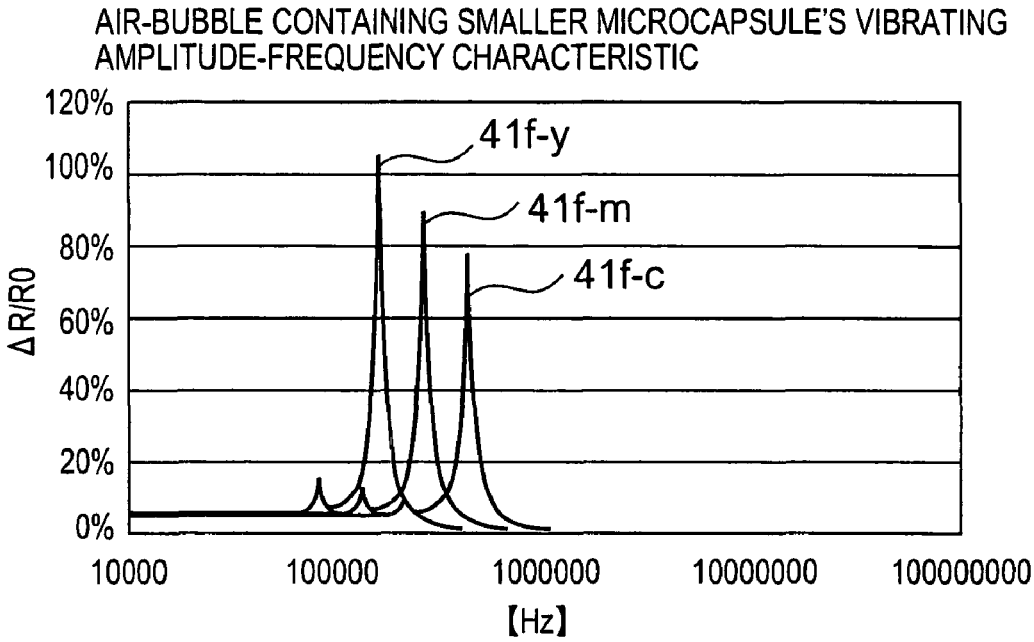
Figure 33:
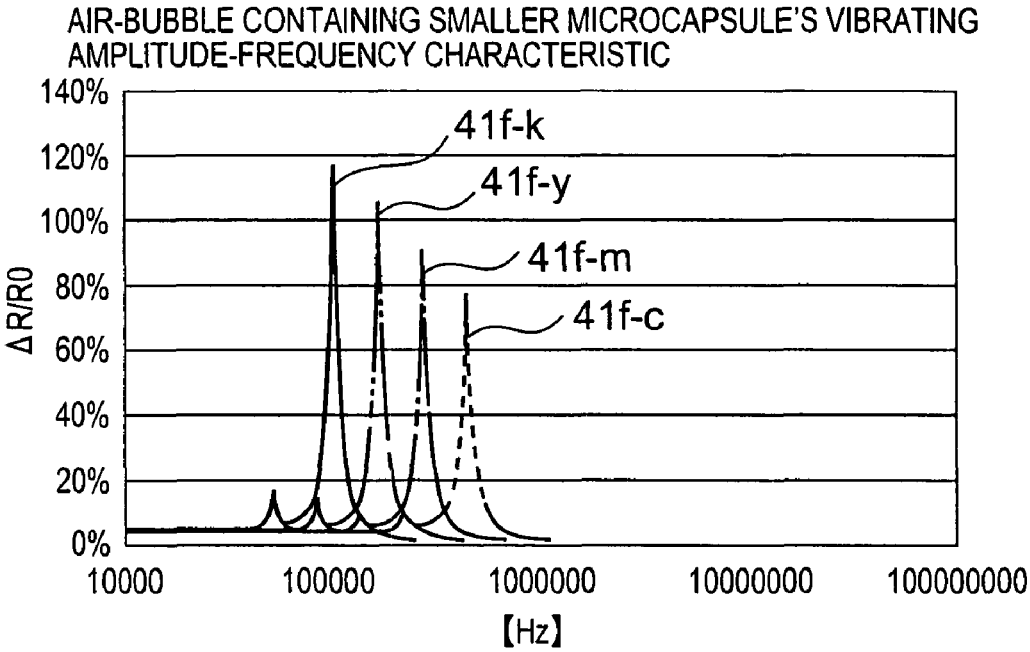
Figure 34:
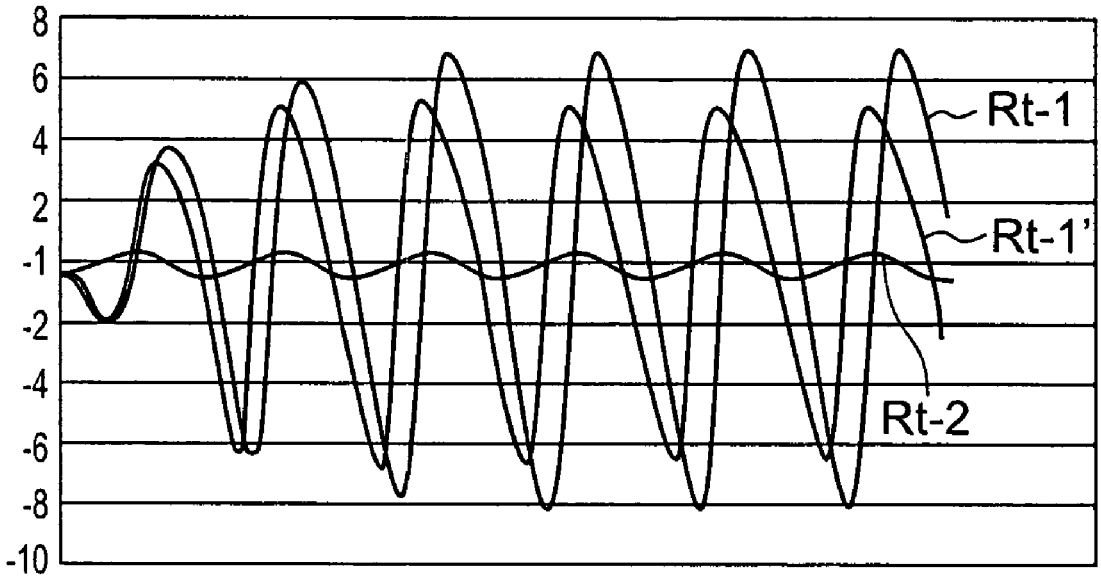
Figure 35:
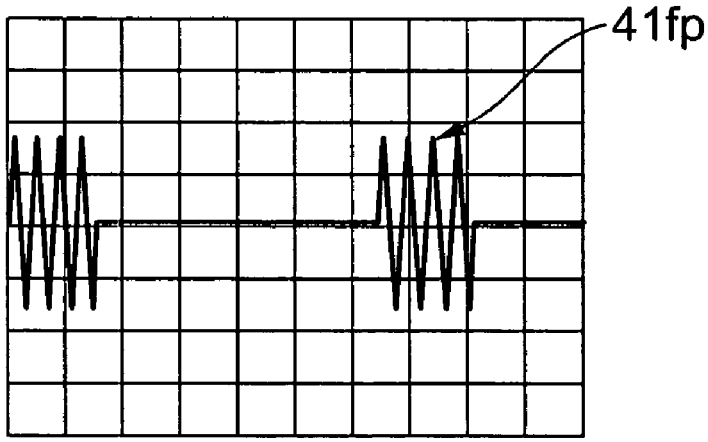
Figures 36, 37:
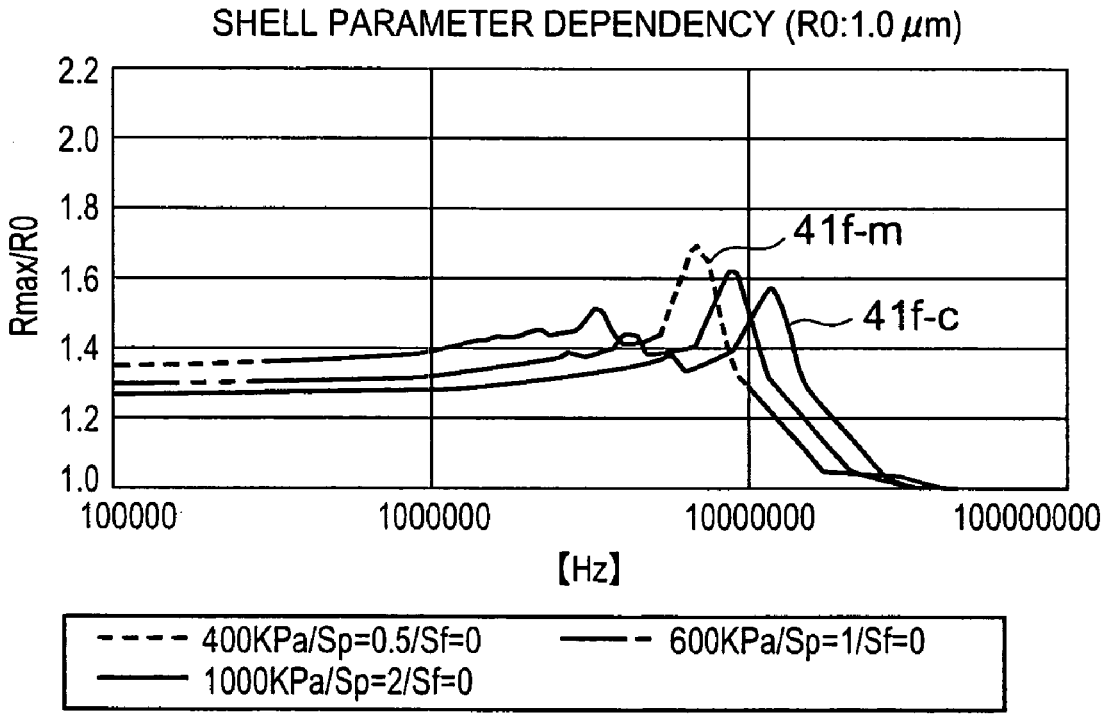
Figures 38, 39:
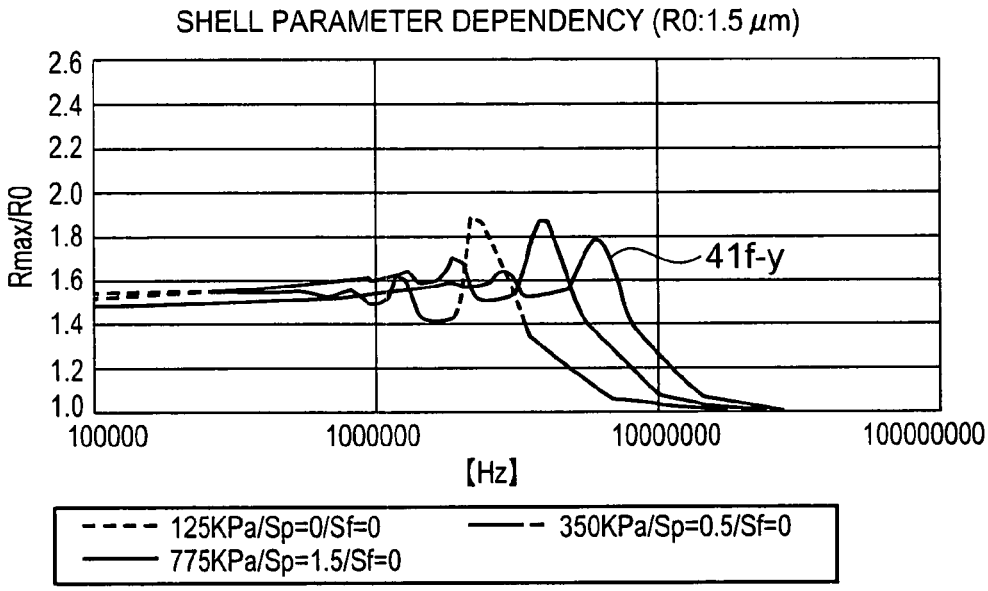
Figures 40, 41:
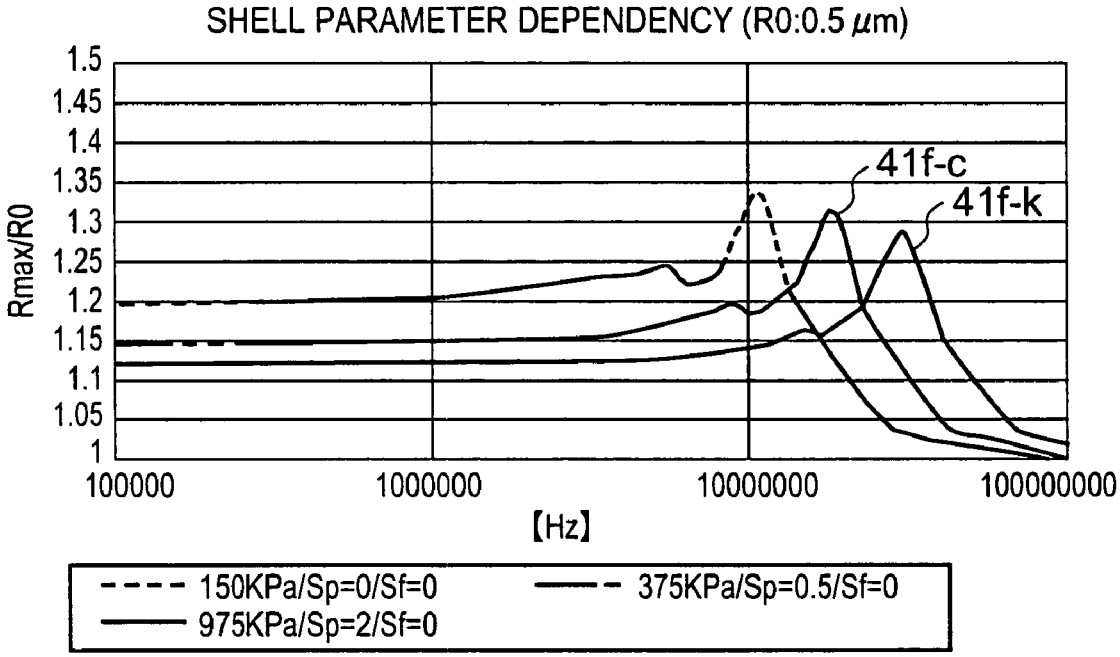
Figure 42:
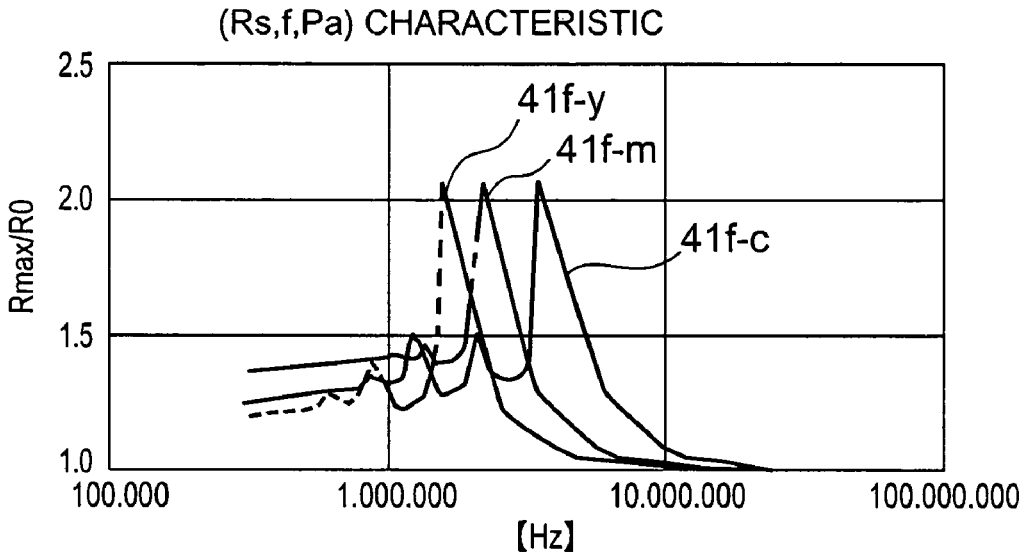
Figure 43:
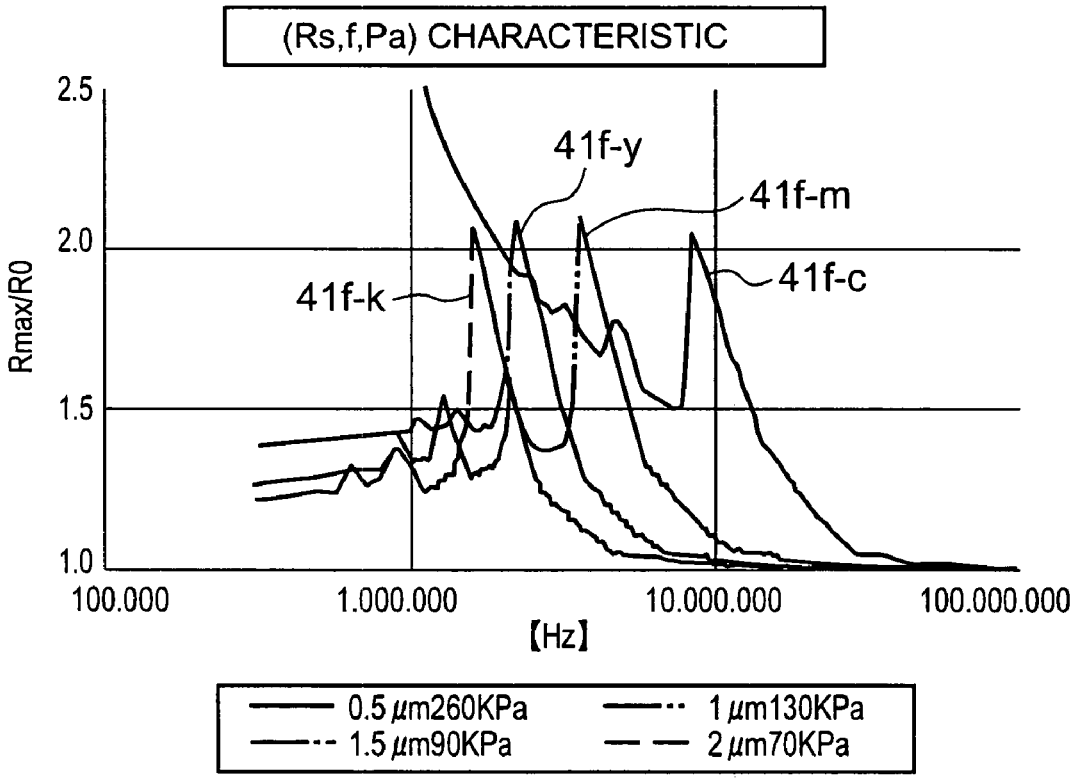
Figure 47A:
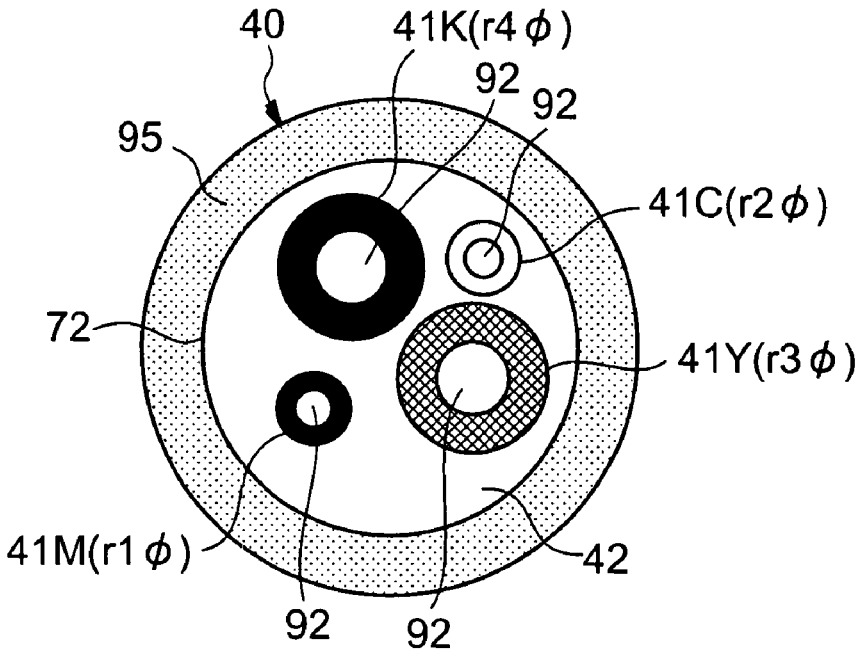
Figure 47B:
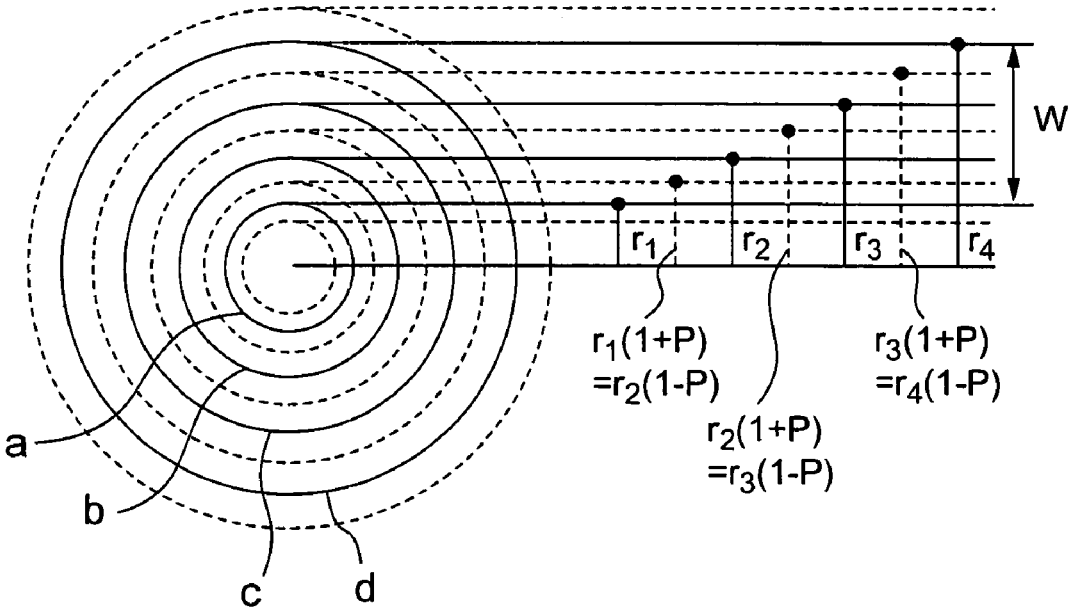
Figure 48:
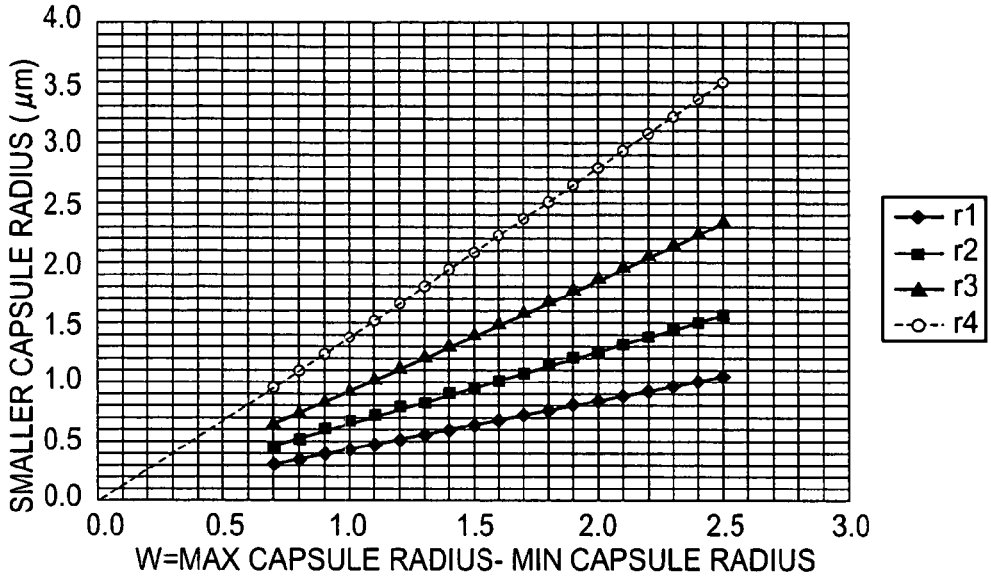
Figure 49:
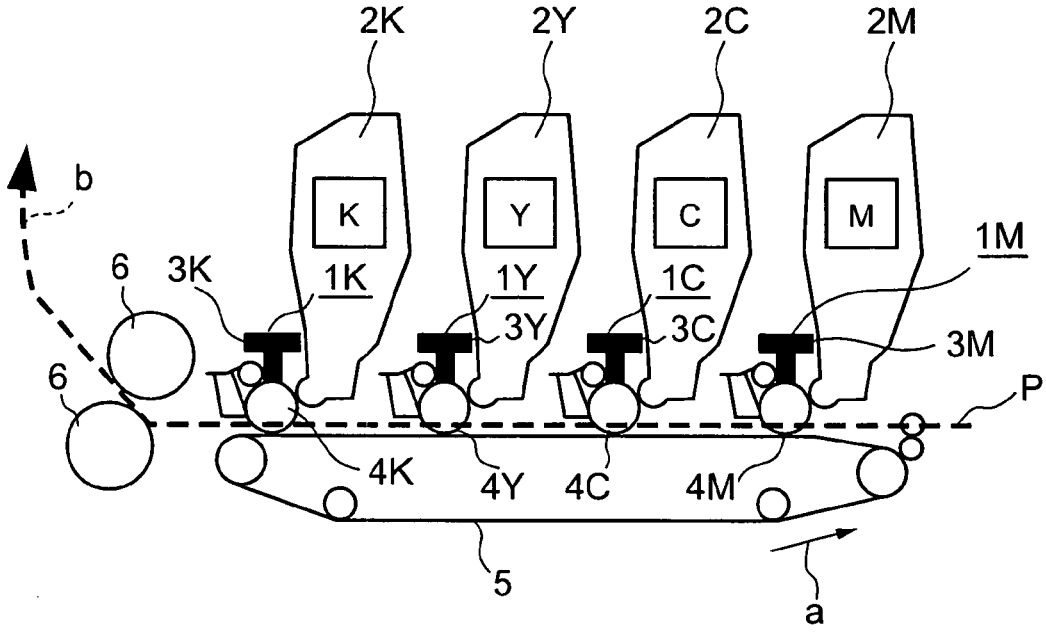
FIG. 49 (PRIOR ART)

FIG. 7 schematically illustrates a developing process and subsequent processes to be performed in the embodiment of the invention;

FIGS. 8A, 8B and 8C illustrate a principle in which the capsule toners T are selectively colored in the embodiment of the invention; FIG. 8A illustrates that capsule toners are being irradiated with ultrasonic waves in a coloring section; FIG. 8B illustrates that a capsule toner T is being irradiated with ultrasonic waves S of a single resonant frequency from an ultrasonic line head; and FIG. 8C illustrates that a capsule toner T is being irradiated with two ultrasonic waves S1 and S2 of different resonant frequencies from the ultrasonic line head;

FIG. 9 is a timing chart at which ultrasonic waves are produced by the ultrasonic line head in the embodiment of the invention;

FIGS. 10A, 10B and 10C show the ultrasonic line heads disposed at different positions in the embodiment of the invention;

FIG. 11 shows that the ultrasonic line head set on the side of a surface to which capsule toners T adhere irradiates the capsule toners with ultrasonic waves;

FIG. 12 shows appearance of the ultrasonic line head;

FIG. 13A is a plan view of the ultrasonic line head, FIG. 13B is a plan view of an arrangement of individual voltage-applying electrodes, FIG. 13C is a cross-sectional view taken along a line E–E' of FIG. 13B, and FIG. 13D is a cross-sectional view taken along a line F–F' of FIG. 13C;

FIG. 14 shows a relationship between ultrasonic elements arranged in a primary scan (X) direction and positions where the ultrasonic waves emitted by the ultrasonic elements are focused;

FIG. 15 illustrates in an enlarged view of a focused form of ultrasonic waves formed by a part of the arrangement of ultrasonic elements;

FIG. 16 is a circuit block diagram of a coloring head control unit as one example of the invention;

FIGS. 17A, 17B, 17C and 17D illustrate a process to be performed by the ultrasonic line head;

FIG. 18 is a timing chart for illustrating the process to be performed by the ultrasonic line head;

FIG. 19 illustrates operation of a high-voltage pulse driver;

FIG. 20 illustrates a liquid developing system as a second embodiment of the invention;

FIG. 21 is an enlarged view of an essential portion of FIG. 20;

FIG. 22 is a third embodiment in which the ultrasonic line head is disposed between a develop roll and squeeze roll;

FIG. 23 is an enlarged view of an essential portion of FIG. 22;

FIG. 24 is a cross-sectional view of a color image forming apparatus using a liquid developing system in a fourth embodiment of the invention;

FIG. 25 is an enlarged view of an essential portion of the color image forming apparatus, showing the ultrasonic head unit of FIG. 24 as a core;

FIG. 26 illustrates a method of driving a sleeve of the ultrasonic head unit of FIG. 24;

FIG. 27 illustrates a deterioration in a printed quality due to a discrepancy in position between developed image and colored image in a fifth embodiment;

FIGS. 28A, 28B and 28C illustrate a deterioration in a printed quality due to a discrepancy in position between transferred image and colored image;

FIGS. 29A, 29B and 29C illustrate one example of eliminating a discrepancy in position between a static latent image formed by an optical write head and a colored image produced by the ultrasonic line head;

FIG. 30 shows a capsule toner T as a sixth embodiment of the invention, wherein the developer is not provided on the outer surface of each smaller microcapsule, but contained in a holding material within the smaller microcapsule;

FIGS. 31A and 31B show a smaller microcapsule containing an air bubble as a seventh embodiment of the invention;

FIG. 32 shows an air bubble radius amplitude-frequency dependency characteristic for yellow, magenta and cyan smaller microcapsules;

FIG. 33 shows another air bubble radius amplitude-frequency characteristic for yellow, magenta, cyan and black smaller microcapsules;

FIG. 34 shows how vibrations of the smaller microcapsules are influenced when irradiated with ultrasonic waves of different resonant frequencies;

FIG. 35 shows output pulses of irradiating ultrasonic waves;

FIG. 36 shows the conditions for breaking magenta, cyan and yellow smaller microcapsules;

FIG. 37 shows a vibration-frequency characteristic depending on a shell parameter Sp;

FIG. 38 is a characteristic of a yellow smaller microcapsule similar to that of FIG. 37 and depending upon a shell parameter Sp;

FIG. 39 shows another example of the conditions for breaking magenta, cyan, yellow and black smaller microcapsules;

FIG. 40 shows a vibration characteristic depending on a shell parameter Sp for the conditions of FIG. 39;

FIG. 41 shows another example of the conditions for breaking yellow, magenta and cyan smaller microcapsules;

FIG. 42 shows a vibration characteristic depending on a shell parameter SP for the breaking conditions of FIG. 41;

FIG. 43 shows a vibration characteristic similar to FIG. 42, additionally including a vibration characteristic of a smaller black microcapsule;

FIG. 44 shows a further example of the conditions for breaking yellow, magenta, cyan and black smaller microcapsules;

FIG. 45 shows still further example of the conditions for breaking yellow, magenta, and cyan smaller microcapsules;

FIG. 46 shows still another example of the conditions for breaking yellow, magenta, cyan and black smaller microcapsules;

FIGS. 47A and 47B show the structures of four smaller microcapsules within a larger microcapsule in tenth-twelfth embodiments of the invention;

FIG. 48 shows a relationship between the radius of each of four-colored smaller microcapsules and the difference in radius between the maximum and minimum smaller microcapsules; and FIG. 49 illustrates a prior-art tandem-type color image forming apparatus.

DESCRIPTION OF THE PRIFERRED EMBODIMENTS

Embodiments of the invention will be described in detail with reference to the accompanying drawings.

First Embodiment

First, a whole composition of the invention will be described as a first embodiment.

Figure 1:
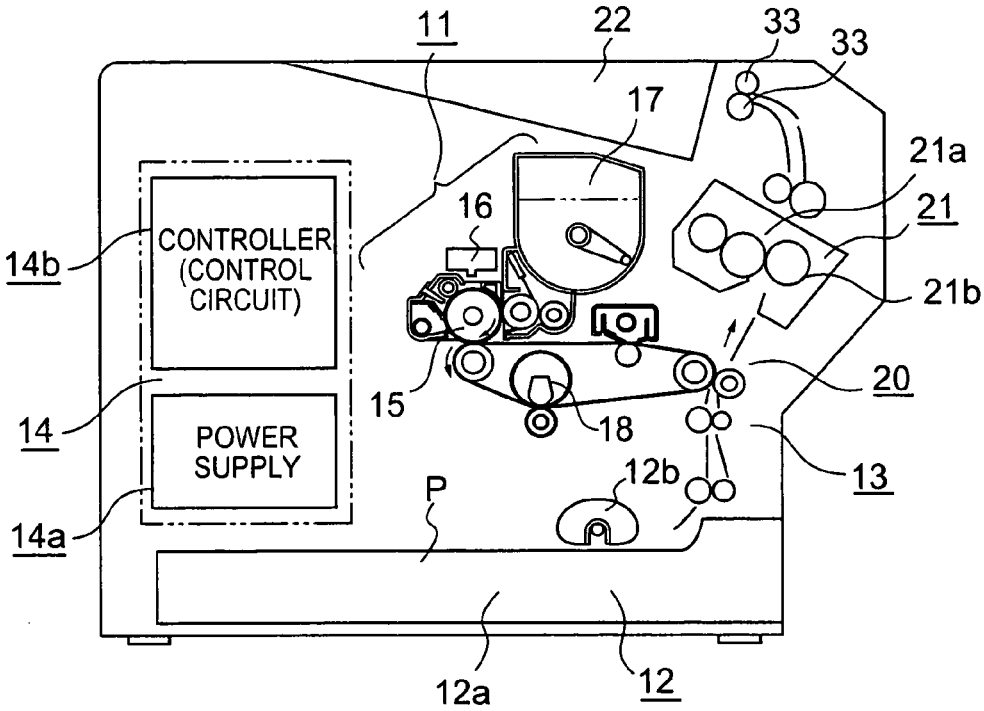
FIG. 1 shows a whole color image forming apparatus as a first embodiment of the present invention.

FIG. 1 illustrates a whole composition of a color image forming apparatus of the first embodiment. The color image forming apparatus is a printer connected to a personal computer as a host device or otherwise to a LAN (Local Area Network), for example, on a peer-to-peer basis.

The color image forming apparatus of FIG. 1 includes an image forming section 11, a paper feeder 12, a paper conveyer 13, and a power supply/control unit 14. The image forming unit 11 includes a photosensitive drum 15, an optical write head 16, a capsule toner hopper 17, and an ultrasonic line head 18.

The paper feeder 12 includes a paper cassette 12*a* and a paper feed roller 12*b*. Recording paper P contained in the paper cassette 12*a* is fed out from the paper cassette 12*a* in accordance with rotation (a single rotation) of the paper feed roller 12*b* and then conveyed to the paper conveyer 13. The paper conveyer 13 conveys the recording paper P fed from the paper cassette 12*a* long a guide plate. A toner image is transferred by a transfer unit 20 to the recording paper P and thermally fixed by a fixer 21 to the recording paper. This fixed paper P is then discharged by a discharge roller 33 onto a discharge stacker 22.

The power supply/control unit 14 includes a power supply 14*a* that provides power to the image forming unit 11 and a control unit (control circuit) 14*b* that produces optical write data to be delivered to the optical write head 16 and also produces image data to be delivered to the ultrasonic line head 18. A specified circuit composition of the control unit (control circuit) 14*b* will be described later.

Figure 2:
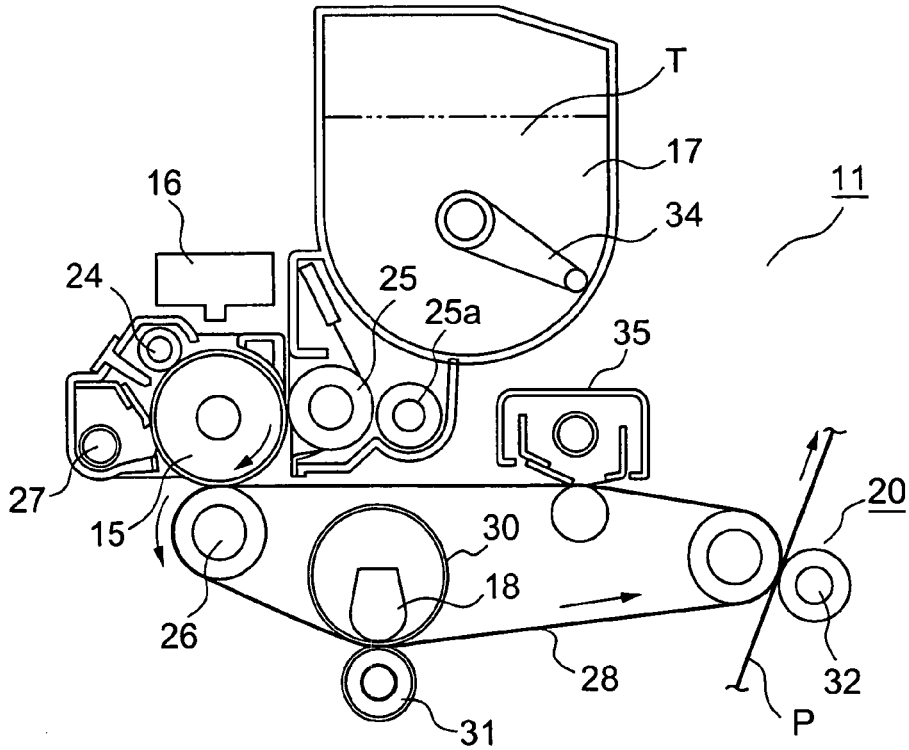
FIG. 2 is an enlarged view of an essential portion of an image forming unit of FIG. 1.

FIG. 2 is an enlarged view of an essential portion of the image forming section 11, which includes the photosensitive drum 15, the optical write head 16, a capsule toner hopper 17, and the ultrasonic line head 18 as main elements, as described above. Disposed in the vicinity of the photosensitive drum 15 are a charging roller 24, the optical write head 16, a capsule toner developing roller 25, an intermediate transfer roller 26 and a cleaner 27.

The control unit (control circuit) 14*b* feeds the optical write data to the optical write head 16 and optically writes the data to a photosensitive surface of the photosensitive drum 15. The photosensitive surface of the photosensitive drum 15 bears uniformly distributed charges given beforehand by the charging roller 24 such that a static latent image is formed by optical write head 16 on the photosensitive surface of the photosensitive drum 15. The static latent image is developed by the capsule toner developing roller 25, capsule toners T adhere to the latent image, which is then conveyed directly above the intermediate transfer roller 26.

Between the photosensitive drum 15 and the intermediate transfer roller 26, an intermediate transfer belt 28 extends which is carried in a held state between the photosensitive drum 15 and the intermediate transfer roller 26. The capsule toners T statically adhering to the photosensitive drum 15 are attracted to the intermediate transfer belt 28 by an electric field acting between the capsule toners T and the intermediate transfer roller 26. The intermediate transfer belt 28 moves in a direction of arrow. The capsule toners T adhering to the intermediate transfer belt 28 arrive directly below the ultrasonic line head 18 as the intermediate transfer belt 28 moves.

The control unit (control circuit) 14*b* delivers image data to the ultrasonic line head 18, which then irradiates the capsule toners T moving between a roller 30 that contains the ultrasonic line head 18 and an opposite roller 31 with ultrasonic waves. At this time, the protective walls of the capsule toners T adhering to the intermediate transfer belt 28 are broken, the inside reactive substances react to produce a color. Reference numeral 35 denotes an intermediate transfer belt cleaner that eliminates toners remaining on the intermediate transfer belt 28.

The colored toners are transferred to recording paper P by the transfer roller 32 in the transfer unit 20. The colored toners transferred to recording paper P are then subjected to thermal fixation in the fixer 21, as described above, and then discharged onto a discharge stacker 22 by a pair of discharge rollers 33.

In the arrangement, the capsule toners T are contained in the capsule toner hopper 17 of FIG. 2. A stirrer 34 provided rotatably within the capsule toner hopper 17 stirs microcapsule toners T (hereinafter referred to as "capsule toners T") and applies minus (−) electric charges to the capsule toners T by frictional charging. Disposed close to or in contact with the capsule toner developing roller 25 is a capsule toner feed roller 25*a*, which feeds the capsule toners T contained in the capsule toner hopper 17 to the capsule toner developing roller 25, which uses the capsule toners T for developing the static latent image. The developing process to be performed by the capsule toner developing roller 25 will be described later.

Figure 3:
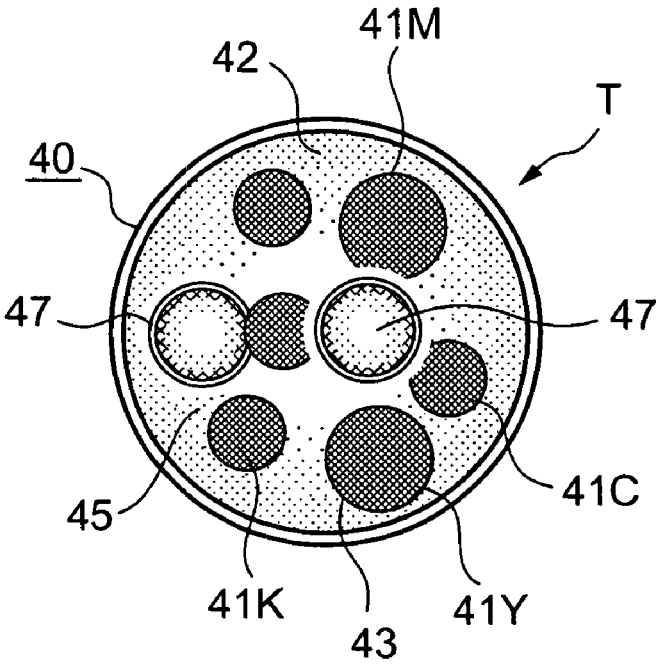
FIG. 3 shows a structure of a capsule toner T in the embodiment of the invention.

FIG. 3 illustrates the structure of the capsule toner T. As shown in FIG. 3, the capsule toner T contains four kinds of smaller (magenta, cyan, yellow and black) microcapsules 41M, 41C, 41Y and 41K within a larger microcapsules 40 and having their respective protective walls 43. The smaller microcapsules 41M, 41C, 41Y and 41K are randomly dispersed within a gel-like holding substance 42 enclosed within the larger microcapsule 40. Reference numeral 47 denotes colored smaller microcapsules in FIG. 3.

The diameter of the larger microcapsule 40 is, for example, 5–10 μm. A single larger microcapsule 40 contains approximately 10 of each of microcapsules 41M, 41C, 41Y and 41K. The diameters of the smaller microcapsules 41M, 41C, 41Y and 41K are, for example, approximately 0.5–2 μm.

Figure 4:
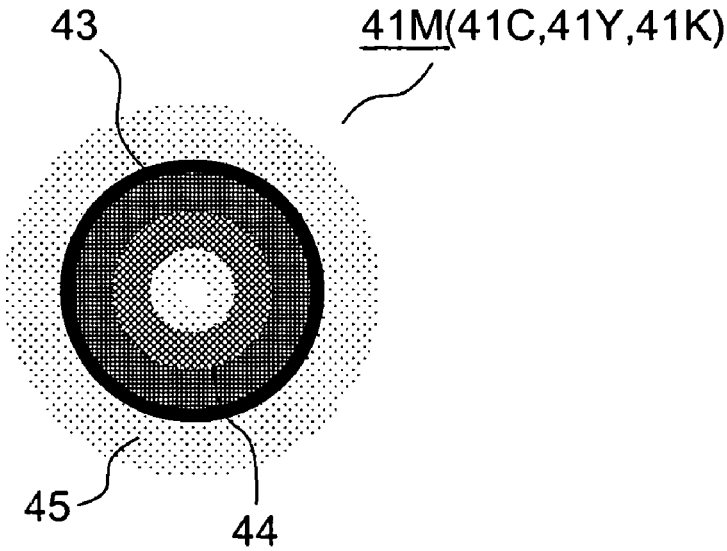
FIG. 4 illustrates the structure of a smaller microcapsule in the embodiment of the invention.

FIG. 4 illustrates the structure of each of the smaller microcapsules. As described above, it is covered with the outer capsule wall 43 within which a color former 44 is contained and the smaller protective wall 43 is covered with a developer 45.

The diameters and thickness of the protective walls of the smaller microcapsules 41M, 41C, 41Y and 41K are different from each other. By such construction, the respective smaller microcapsules are breakable by ultrasonic waves of corresponding different resonant frequencies.

By changing the materials of the respective smaller microcapsule protective walls in addition to their diameters and thicknesses, the breaking resonant frequencies are changed. By adding the material factor to the factors that set an irradiating ultrasonic resonant frequency, a more precise resonant frequency is settable.

For example, the diameter of the smaller microcapsule increases, the ultrasonic resonant frequency decreases. The thickness of the smaller protective wall 43 increases, the resonant frequency increases. The hardness of the material of the smaller protective wall 43 increases, the resonant frequency increases. Therefore, the respective smaller microcapsules 41M, 41C, 41Y and 41K are designed so as to be broken by the ultrasonic waves of corresponding different frequencies depending upon the respective factors mentioned above.

The respective outer protective walls 43 of the smaller microcapsules 41M, 41C, 41Y and 41K are broken selectively in accordance with image data to thereby color the corresponding smaller microcapsules. The percentage of coloring each of the smaller microcapsules 41M, 41C, 41Y and 41K changes depending upon a quantity of ultrasonic energy with which the microcapsule is irradiated. Therefore, by controlling the respective coloring percentage of magenta, cyan, and yellow, any intermediate color is realized.

Figure 5:
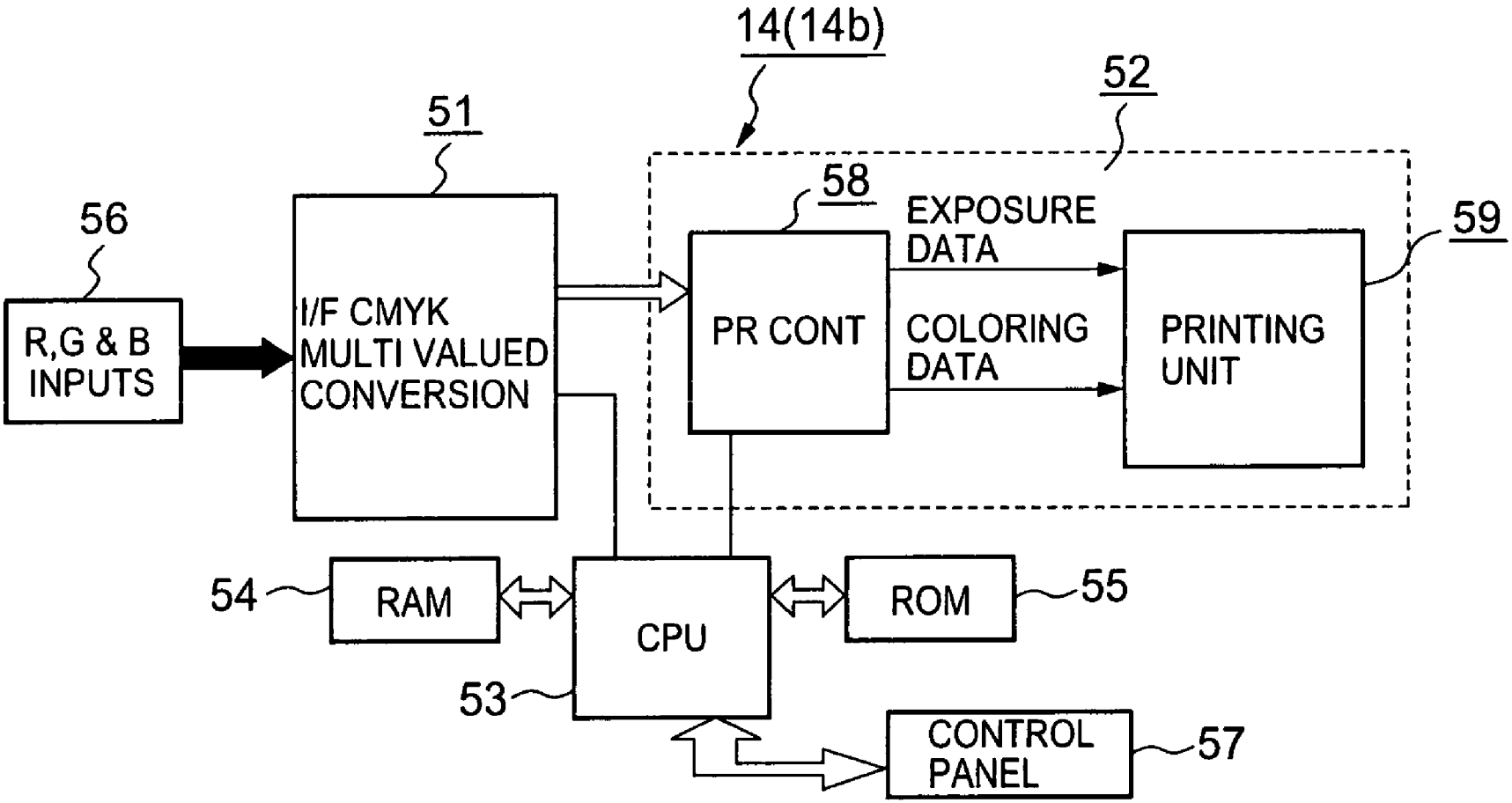
FIG. 5 is a block diagram of a power supply/control unit in the embodiment of the invention.

FIG. 5 is a block diagram of the power supply/control unit 14, especially illustrating the circuit composition of the control unit (control circuit) 14*b*, which includes an interface (I/F) 51, a print control unit 52, a CPU 53, a RAM 54 and a ROM 55. The interface (I/F) 51 is supplied with video data from a RGB (Red, Green, Blue) input unit 56. A control panel 57 delivers an operation signal to the CPU 53.

The interface (I/F) 51 performs a multi-level data value forming process including conversion of video data (R, G and B signals) supplied by the personal computer (PC) as the host device to C, M, Y and K values. In this case, the interface (I/F) 51 has beforehand registered a color conversion table corresponding to the device and converts the R, G and B signals to C, M, Y and K values by referring to the color conversion table. CPU 53 performs processes based upon the programs stored in the ROM 55 and also performs a printing process in accordance with an operation signal received from the control panel 57.

RAM 54 includes a plurality of registers for use as a work area when CPU 53 performs control processes.

CPU 53 delivers control signals to the interface (I/F) 51 and a printer controller 58 of the print control unit 52 to create print data. The print control section 52 includes the printer controller 58 and a printing unit 59.

Figure 6:
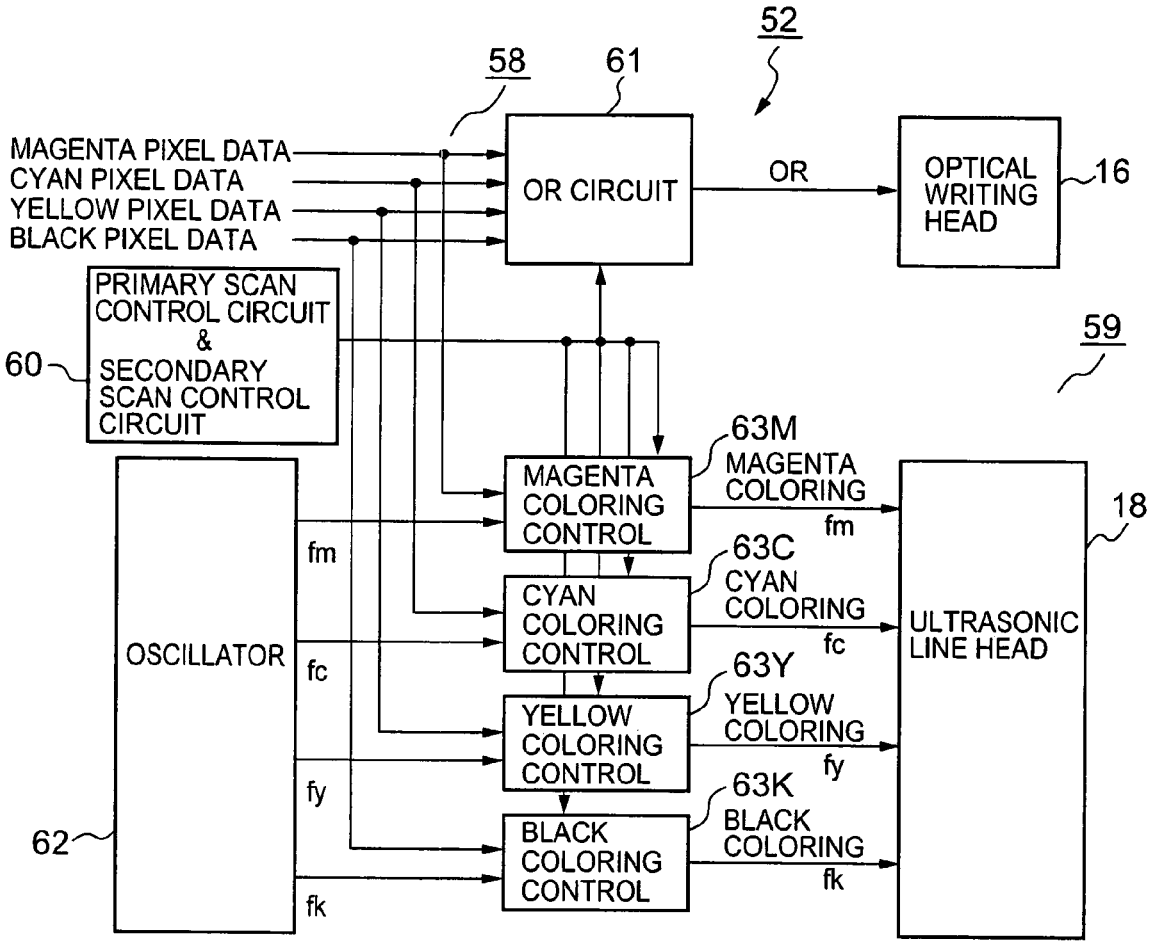
FIG. 6 is a specified circuit block diagram of a print control unit in the embodiment of the invention.

FIG. 6 is a specified circuit block diagram of the print control unit 52. In FIG. 6, the printer controller 58 includes a primary/secondary scan control circuit 60, an OR circuit 61, an oscillation circuit 62, a magenta coloring control circuit 63M, a cyan coloring control circuit 63C, a yellow coloring control circuit 63Y, and a black coloring control circuit 63K. The print unit 59 includes the optical write head 16 and the ultrasonic line head 18.

As described above, the C, M, Y, and K values to which the image data is converted by the interface (I/F) 51 are delivered as magenta, cyan, yellow and black pixel data from the interface (I/F) 51 to the OR circuit 61. The OR circuit 61 performs an OR operation on the C, M, Y, and K values and outputs resulting data to the optical write head 16.

That is, the OR circuit 61 outputs ORed data including all the C, M, Y, and K pixel data to the optical write head 16, which then optically writes the data to the photosensitive drum 15. Therefore, a static latent image is formed based upon the ORed data including all the C, M, Y, and K pixel data on the peripheral surface of the photosensitive drum 15. The primary/secondary scan control circuit 60 delivers primary and secondary scan control signals to the OR circuit 61. The primary and secondary scan control signals are used for control of the primary and secondary scan directions when the ORed data is delivered to the optical write head 16.

The C, M, Y, and K pixel data are also delivered to the magenta, cyan, yellow and black coloring control circuits 63M–63K and then outputted to the ultrasonic line head 18 in synchronism with oscillation signals fm, fc, fi and fk outputted from the oscillation circuit 62. That is, magenta, cyan, yellow and black coloring data are delivered to the ultrasonic line head 18. Thus, the capsule toners T adhering to the intermediate transfer belt 28 are irradiated with the ultrasonic waves of corresponding frequencies (oscillation frequencies to be described later).

Thus, the smaller microcapsules within the capsule toner T vibrating in resonance with the frequency of the irradiating ultrasonic waves are broken and colored. In this case, since the frequencies f of the coloring signals outputted from the magenta, cyan, yellow and black coloring control circuits 63M, 63C, 63Y and 63K are different from one another. Thus, in the capsule toners T irradiated with the ultrasonic waves, only the protective walls 43 of the corresponding smaller microcapsules 41M, 41C, 41Y and 41K are broken. This occurs because the protective wall diameters of the smaller microcapsules 41M, 41C, 41Y and 41K are different from one another and the breaking resonant frequencies are different from one another depending on the smaller microcapsules 41M, 41C, 41Y and 41K, respectively.

For example, the coloring signal fm outputted from the magenta coloring control circuit 63M breaks only the protective walls 43 of the magenta microcapsules 41M within the capsule toner T to thereby produce a magenta color. The coloring signal fc outputted from the cyan coloring control circuit 63C breaks only the protective walls 43 of the cyan microcapsules 41C within the capsule toner T to thereby produce a magenta color. This applies to the smaller yellow and black microcapsules, likewise. That is, the coloring signals fy and fk being outputted from the yellow and black coloring control circuits 63Y and 63K break only the protective walls 43 of the smaller capsules 41Y and 41K to thereby produce yellow and black colors, respectively.

A process to be performed by the present embodiment will be described next.

First, when the photosensitive drum 15 rotates and an optical write signal is delivered from the control unit (control circuit) 14*b* to the optical write head 16 in a state where capsule toners T are contained within the capsule toner hopper 17, the photosensitive drum 15 is optically written with the OR data mentioned above. The photosensitive surface of the photosensitive drum 15 has beforehand born electric charges uniformly by the charging roller 24 and the optically written photosensitive surface has a static latent image formed thereon. This static latent image is based upon all the ORed M, C, Y and K image data and developed by the capsule toner developing roller 25.

FIG. 7 schematically illustrates the developing and subsequent processes. The capsule toners T contained in the capsule toner hopper 17 are stirred by the stirrer 34 and bear minus (–) electric charges produced by frictional changing, as described above. A predetermined bias voltage is applied to the capsule toner developing roller 25 and the capsule toners T electrostatically adhere thin onto the peripheral surface of the capsule toner developing roller 25. In this state, the photosensitive drum 15 and the capsule toner developing roller 25 rub against each other, and the capsule toners T adhering to the capsule toner developing roller 25 statically adhere to the photosensitive surface of the drum 15 onto which the capsule toners T adhere.

The capsule toners T statically adhering to the photosensitive surface of the drum 15 are conveyed to the transfer unit by rotation of the drum 15 and are transferred to the intermediate transfer belt 28 by the intermediate transfer roller 26. In this case, by applying a + (plus) bias voltage to the intermediate transfer roller 26, minus (–) charged capsule toners T field adhere to the intermediate transfer belt 28. Then, the capsule toners T adhering to the intermediate transfer belt 28 are irradiated with the ultrasonic waves by the ultrasonic line head 18 and are colored selectively.

FIGS. 8A, 8B and 8C illustrate a principle in which the capsule toners T are irradiated with ultrasonic waves by the ultrasonic line head 18 to thereby be colored selectively.

FIG. 8A shows a state in which the capsule toners T are irradiated with ultrasonic waves in the coloring section. Reference letter D denotes the thickness of a layer of capsule toners T; S ultrasonic waves (converging ultrasonic waves) emitted; and d a converged size (for example, one pixel) of the ultrasonic waves.

As described above, each capsule toner T contains in its larger capsule 40 four kinds of smaller magenta, cyan, yellow and black microcapsules 41M, 41C, 41Y and 41K. The protective walls 43 of the smaller microcapsules irradiated with ultrasonic waves of a specified resonant frequency are broken and the inside color formers 44 mix and react with the developer 45 to produce a corresponding color.

For example, FIG. 8B shows that a capsule toner T is being irradiated with ultrasonic waves S of a single resonant frequency by the ultrasonic line head 18. Only the smaller microcapsules resonating at this resonant frequency are broken and colored. FIG. 8C illustrates that a capsule toner T is being irradiated with two kinds of ultrasonic waves S1 and S2 of different resonant frequencies by the ultrasonic line head 18. Thus, the smaller microcapsules resonating at resonant frequencies S1 and S2 are broken and colored.

That is, when only the protective wall 43 of the smaller microcapsule 41M is broken, magenta color is produced. This applies also to each of the smaller cyan, red and yellow microcapsules 41C, 41R and 41Y.

FIG. 9 shows a timing chart of ultrasonic production being performed by the ultrasonic line head 18. In this embodiment, four gradations are expressed by corresponding average color densities of dots each of which is divided into four strips in the secondary scan direction with any one, two, three and four of the four strips being colored in the same color. First, when a primary scan sync signal is produced by the primary/secondary scan control circuit 60 (timing ① in FIG. 9), a first strobe signal ((1) in FIG. 9) is delivered from the primary/secondary scan control circuit 60 to the ultrasonic line head 18, the ultrasonic line head 18 performs ultrasonic irradiation based upon the image data (1) fed thereto. More specifically, first, the ultrasonic line head 18 performs ultrasonic irradiation based upon the magenta image data of gradation 1 (at timing ② in FIG. 9). Similarly, for cyan, yellow and black, the ultrasonic line head 18 performs ultrasonic irradiation sequentially based upon cyan, yellow and black image data of gradation 1 (timings ③–⑤ in FIG. 9).

Then, the capsule toners T are irradiated sequentially with ultrasonic waves based upon magenta, cyan, yellow and black image data of gradation 2 (at corresponding timings ⑥–⑨ in FIG. 9). Likewise, the capsule toners T are then irradiated sequentially with ultrasonic waves based upon respective magenta, cyan, yellow and black image data of gradations 3 and 4, respectively.

The capsule toners T irradiated with the ultrasonic waves from the ultrasonic line head 18 and colored in accordance with the print image data are moved to the position of the transfer unit 20 (transfer roller 32) while adhering to the recording paper P, and then transferred to the recording paper P.

Then, the colored toners are fed to the fixer 21, as described above, and then subjected to a thermal fixing process. The fixer 21 comprises a heat roll 21*a* and a compression roll 21*b* between which the recording paper P is conveyed through the fixer 21 during which time the colored toners are melted by heat and pressure and then thermally fixed to the recording paper P.

As described above, according to this embodiment, the capsule toners T each of which contains four kinds of magenta, cyan, yellow, black smaller microcapsules 41M, 41C, 41Y and 41K within a larger microcapsule 40 are used as a developer. The capsule toners T are irradiated with ultrasonic waves by the ultrasonic line head 18 based upon the image information data to selectively break the outer walls 43 of the smaller microcapsules 41M, 41C, 41Y and 41K so that the inside color former 44 and the developer 45 are caused to react with each other to thereby produce a corresponding color and form a color image on the recording paper P.

Therefore, by such composition, the inventive printer is reduced in size to the prior art ones and the positions of yellow, magenta, cyan and black to be printed need not be adjusted.

Capsule toners T need only be supplied to the single capsule toner hopper 17. For example, when a disposable development unit (toner unit) is used, only one unit need be replaced.

While in the embodiment the ultrasonic line head 18 is illustrated as provided on the side of an opposite surface of the intermediate transfer belt 28 from its surface to which the capsule toners T adhere, the position where the ultrasonic line head 18 is disposed is not limited to this particular case.

FIGS. 10A, 10B and 10C show various modifications in each of which the ultrasonic line head 18 is disposed at a different position.

FIG. 10A shows the ultrasonic line head 18 disposed on the side of a surface of the intermediate transfer belt 28 to which the capsule toners T adhere.

FIG. 11 illustrates irradiation of ultrasonic waves S produced by the ultrasonic line head 18 disposed on the side of the surface of the intermediate transfer belt 28 to which the capsule toners T adhere. As in FIG. 8A, reference character D denotes the thickness of a layer of capsule toners T; S ultrasonic waves (converging ultrasonic waves) emitted, and d a converged size of the ultrasonic waves. In this case, the capsule toners T are directly irradiated with ultrasonic waves without any intervening object such as the intermediate transfer belt 28. Thus, the smaller microcapsules can be broken more efficiently. Preferably, the ultrasonic line head 18 is placed in cross contact with the layer of the capsule toners T adhering to the intermediate transfer belt 28. In such arrangement, the acoustic impedance is prevented from being adversely affected by a gas phase.

Returning to FIG. 10, while in FIG. 10A uncolored capsule toners T are illustrated as transferred to the intermediate transfer belt 28, the ultrasonic line head 18 may be provided in the vicinity of the photosensitive surface of the photosensitive drum 15, as shown in FIG. 10B, such that the capsule toners T adhering electrostatically to the photosensitive surface of the drum are irradiated with ultrasonic waves. Also, in this case the ultrasonic line head 18 is preferably placed in cross contact with the layer of the capsule toners T adhering to the photosensitive surface of the drum such that the acoustic impedance may not be adversely affected by the gas phase.

In this case, the smaller microcapsules 41M, 41C, 41Y and 41K are broken and colored on the photosensitive drum surface of the drum 15 and the colored toners are transferred by the transfer roll 26 to the intermediate transfer belt 28.

As shown in FIG. 10C, the ultrasonic line head 18 may be provided at a position where the line head 18 is close to the inner periphery of the photosensitive drum 15. Also, in this case the photosensitive drum 15 is irradiated with ultrasonic waves from inside in a state where the capsule toners T adhere to the photosensitive surface of the drum to thereby cause the capsule toners T to be colored. In such arrangement, the acoustic impedance is not adversely affected by a gas phase material which should otherwise intervene.

While in FIGS. 10B and 10C the intermediate transfer belt 28 is illustrated as used, arrangement may be such that the colored capsule toners T are directly transferred to the recording paper P. In this arrangement, provision of the intermediate transfer belt 28 is omitted.

FIG. 12 is a perspective view of the ultrasonic line head 18. The line head 18 has a length in the primary scan direction and has a width in the secondary scan direction. The ultrasonic elements are arranged in the primary scan direction, which will be described next.

First, FIG. 13A is a plan view of the ultrasonic line head 18. FIG. 13B is a plan view of an arrangement of individual applying electrodes, FIG. 13C is a cross-sectional view taken long a line E–E' of FIG. 13B, and FIG. 13D is a cross-sectional view taken long a line F–F' of FIG. 13C. As shown in FIGS. 13C and 13D, the ultrasonic line head 18 to be used in this embodiment is composed of five layers contained in a carrier 90 with the lowest (fifth) layer having a common electrode (grounding) layer 90-5 arranged thereon. A fourth layer includes a plurality of ultrasonic elements 90-4 of a piezoelectric element. A third layer includes a plurality of strip-like electrode layers 90-3 arranged in the primary scan direction. A second layer has an acoustic impedance matching layer 90-2 that reduces the difference in acoustic impedance between the ultrasonic element 90-4 and an ultrasonic transmission medium. A first layer includes an acoustic lens 90-1.

The plurality of ultrasonic element 90-4 is connected to the plurality of individual electrodes 90-3, respectively, and a single common (grounding) electrode 90-5 so as to be supplied with the corresponding ultrasonic output signals. When the ultrasonic elements 90-4 receive the ultrasonic signals, they are distorted to thereby produce ultrasonic vibrations at a predetermined frequency.

The ultrasonic vibrations produced by the ultrasonic element 90-4 are refracted through the acoustic impedance matching layer 90-2 by the acoustic lens 90-1 and then focused on a specified position (at a specified distance). As described above, the acoustic impedance matching layer 90-2 functions to reduce the difference in acoustic impedance between the ultrasonic element 90-4 and the ultrasonic transmission medium.

In order to focus an ultrasonic waves of a pixel size on the specified position, the ultrasonic waves from the plurality of the ultrasonic elements 90-4 need be focused in the primary and secondary scan directions. This is because the ultrasonic element 90-4 are difficult to work so as to have a minute size and an ultrasonic pressure needed to break the protective walls 43 of the smaller microcapsules is difficult to obtain with a single ultrasonic element 90-4.

By constructing the ultrasonic line head 18, as mentioned above, an ultrasonic pressure necessary for breaking the protective wall 43 of the smaller microcapsule wall 43 is obtained, as will be described later.

FIG. 14 illustrates a relationship between the ultrasonic elements 90-4 disposed in the primary scan direction (X-direction) and positions on which the ultrasonic waves produced by the ultrasonic elements 90-4 are focused. In FIG. 14, for convenience of explanation the ultrasonic elements 90-4 are numbered 1, 2, 3, . . . from the left of FIG. 14. The positions of FIG. 14 on which the ultrasonic waves are focused are given corresponding pixel numbers (for example, 1-7168). These positions are, for example, on the intermediate transfer belt 28 to which the capsule toners T adhere. At these positions, the capsule toners T adhering to the intermediate transfer belt 28 face the ultrasonic line head 18 in FIGS. 10A, 10B and 10C.

FIG. 15 illustrates a part of the arrangement of the ultrasonic elements 90-4, for example, ultrasonic elements "1"–"6" in an enlarged view. The ultrasonic elements 90-4 are disposed at intervals of d. M ultrasonic elements 90-4 are driven with the corresponding time delays. For example, a point A on capsule toners T on the intermediate transfer belt 28 corresponding to the center "3" of arrangement of m (odd number, for example, of 5) ultrasonic elements 90-4 ("1"–"5") is irradiated with ultrasonic waves from the five ultrasonic elements 90-4 which are driven with corresponding time delays. For example, the distance between the point A and the ultrasonic elements "1", the distance between the point A and the ultrasonic element "2", and the distance between the point A and the ultrasonic element "3" are different little by little from one another. Based upon such distance differences and the transmission speed of the ultrasonic waves, the respective ultrasonic elements 90-4 are driven to produce ultrasonic waves at respective required shifted timings to thereby irradiate the point A with the strong focused ultrasonic waves.

By adjusting the timings of outputting the ultrasonic waves from the ultrasonic elements 90-4, these ultrasonic waves produced by the ultrasonic elements 90-4 can be focused on a point spaced from the point A by a distance smaller than the intervals at which the ultrasonic elements 90-4 are arranged (for example, on a point B spaced by ½d from the point A). That is, a point B on the capsule toner facing the center of an arrangement of m (even number, for example, of 6) ultrasonic elements 90-4 is irradiated with strong ultrasonic waves from the six ultrasonic elements 90-4 with respective time delays. Thus, by setting at intervals of one pixel (d) in the primary scan direction the positions where the ultrasonic beams are focused, a strong ultrasonic beam can be focused on the capsule toners T at the intervals of one pixel to thereby break the protective walls 43 of the smaller microcapsule to produce desired colors at the intervals of one pixel.

In the secondary scan direction, the refraction of the acoustic lens 90-1 may be used to reduce the focused width of the ultrasonic waves. Therefore, an image of higher resolution is formed by reducing the widths of focused pixels in the secondary direction. For example, by reducing the pixel size to ¼, one pixel can be irradiated four times with the focused ultrasonic waves to thereby control the color in four gradations, as described above.

FIG. 16 is a more detailed circuit block diagram of the coloring head controller, illustrating a driver of the ultrasonic line head 18 (ultrasonic elements 90-4) specifically. The coloring head controller is shown in a broken-line frame in FIG. 16 and includes an image data operating unit 131, a frequency operating unit 132, a gradation data operating unit 133, a channel phase setting value memory 134, a channel count setting value memory 135, and a wave count setting value memory 136.

The print controller 58 of FIG. 16 receives print data from a host device such as the personal computer (PC), determines whether or not there is data for each pixel (printing dot), and creates corresponding gradation data. This data is sent to the coloring head controller. That is, first, the print (image) data is inputted to the image data operating unit 131, which calculates an ultrasonic output time and a phase difference of each of the ultrasonic elements 90-4 or channels (ch) 0-n composing the ultrasonic line head 18 based upon one line of the pixel data. A result of this calculation is then sent to and recorded in the phase difference setting value memory 134.

The gradation data operating unit 133 receives gradation data from the printer controller 58 and operates on the gradation data to thereby provide data on an ultrasonic output time and wave count of from each of the ultrasonic elements 90-4. This data is then recorded in the wave count setting value memory 136.

A heat sensor 146 senses a temperature on a peripheral surface of the ultrasonic line head 18 and delivers information on the sensed temperature to the frequency operating unit 132. That is, the heat sensor 146 senses the temperature of the ultrasonic line head 18 raised by the heat that has been produced by its peripheral elements and ultrasonic vibrations. The frequency operating unit 132 adjusts the number of clocks so as to prevent the ultrasonic elements from providing uneven output frequencies due to a rise in the temperature. Such adjusted data is then recorded in the clock setting value memory 135.

Data recording in each of the phase difference, clock and wave count setting value memories 134, 135 and 136 is performed for each of colors; i.e., yellow (Y), magenta (M), cyan (C) and black (K).

Selectors 137–139 select corresponding outputs from the memories 134–136 and deliver them to the corresponding counters 140–142. For example, the selector 137 delivers phase difference data outputted from the phase difference setting value memory 134 in accordance with color information to the phase difference counter 140. This applies to the other selectors 138 and 139. The selector 138 delivers a clock signal outputted from the clock setting value memory 135 to the clock counter 141. The selector 139 sends a wave count signal outputted from the wave count setting value memory 136 to the wave counter 142.

An output trigger operating unit 143 delivers a drive signal to a respective one of high-voltage pulse drivers 144-1, 144-2, . . . for each channel. The high-voltage pulse drivers 144-1, 144-2, . . . are each push-pull high-voltage pulse drivers set for the respective channels. The drivers 144-1, 144-2, . . . are driven by signals applied to their inputs A and B.

For example, when low and high (hereinafter, referred to as "L" and "H", respectively) signals are inputted to the inputs A and B, respectively, the high-voltage pulse drivers 144-1, 144-2, . . . output 0 volts. When a "H" signal is inputted to both the inputs A and B, the drivers 144-1, 144-2, . . . output +VH. When an "L" signal is inputted to the inputs A and B, the drivers 144-1, 144-2, . . . output−VH.

The ultrasonic line head 18 (ultrasonic elements 90-4) is driven based on the above-mentioned outputs to output ultrasonic vibrations to the microcapsules.

In the arrangement, operation of the coloring head controller will be described next.

FIG. 17 (FIGS. 17A, 17B, 17C and 17D) illustrates a part of the ultrasonic line head 18 to be used to explain the process in this embodiment. First, in FIG. 18A, reference characters P1, P2, . . . denote the ultrasonic elements of the ultrasonic line head 18 with 32 ultrasonic elements being disposed in one block T. For example, 224 blocks T are disposed and hence 7,168 ultrasonic elements are disposed in the whole ultrasonic line head 18. At the focus points of FIG. 17, the respective pixels are formed and there are microcapsules (not shown) adhering.

FIG. 18 illustrates a timing chart used for explaining the operation of this embodiment, especially, the timings of operation of any particular ultrasonic element (ch α) of FIG. 17 and its both adjacent ultrasonic elements (ch α+1) and (ch α−1). The ultrasonic element (ch α) is provided at a position where it faces a focal point with a pixel at t=1 in FIG. 17A. A set clock value for the ultrasonic element (ch α) is, for example, "4" and the set wave count is, for example, 2.

Figure 17A:
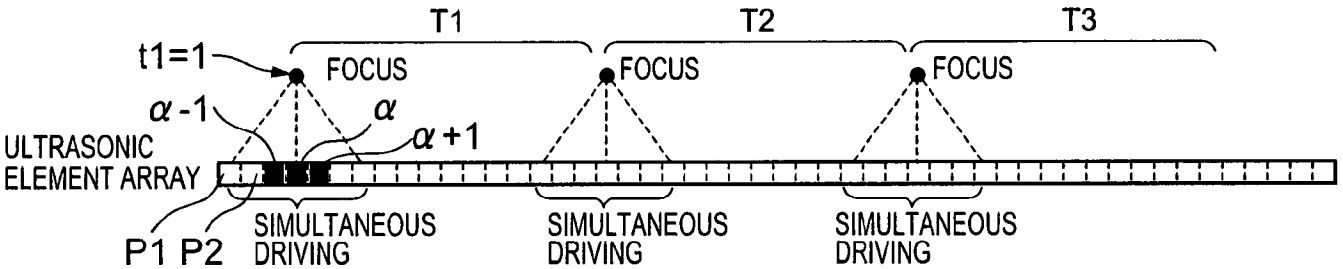
Figure 17B:
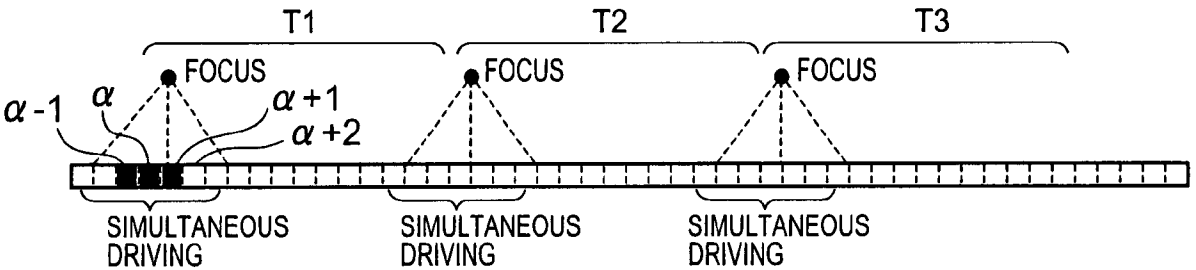

The ultrasonic element (ch α−1) to the left of the ultrasonic element (ch α) in FIG. 17A is different one clock (or one clock delayed) in phase from the ultrasonic element (ch α), its set clock value is "4", and its set wave count is "2". The ultrasonic element (ch α+1) to the right of the ultrasonic element (ch α) is different one clock (or one clock delayed) in phase from the ultrasonic element ch a, its set clock value is "4", and its set wave count is "2".

In a standstill, the inputs A and B are "L" and "H", respectively. The phase difference counter 140 performs a counting process from a starting point in accordance with the phase difference values set in the phase difference set value memory 134, starting with the pixel at t=1. The output trigger operating unit 143 drives the high-voltage pulse drivers 144-1, 144-2 . . . in accordance with data outputted from the phase difference counter 140, 141, 142.

For example, the output trigger operating unit 134 provides a "H" output shown by (2 in FIG. 18 to the inputs A and B of the ultrasonic element (ch α) in synchronism with a rise edge in a clock ① in FIG. 18. This signal is delivered to the high-voltage pulse driver 144 (144- α) to thereby drive the ultrasonic element (ch α), at which timing the corresponding microcapsule is irradiated with the ultrasonic waves.

FIG. 19 illustrates operation of the high-voltage pulse driver 144- α that provides an output Vout at +VH (① in FIG. 20), which is then applied to the ultrasonic element ch α.

Then, as shown in (③ in FIG. 19), signals for driving the ultrasonic elements (ch α−1) and (ch α+1) at a rise edge in a next clock are delivered to the high-voltage pulse drivers 144- α−1 and 144−α+1. The phase difference between the ultrasonic elements (ch α) and each of its adjacent ultrasonic elements (ch α−1) and (ch α+1) is one clock, and these ultrasonic elements irradiate the same microcapsules with ultrasonic vibrations in synchronism with a next clock signal. The phase difference is based upon the difference in distance between the target and a respective one of the ultrasonic elements.

Although not shown, the further adjacent ultrasonic elements (ch α−2) and (ch α+2) are driven by a further next clock (at a timing ⑤ in FIG. 18) and then further next adjacent ultrasonic elements are driven sequentially at a still further next clock and so forth.

As described above, the number of clocks is set at "4" and the inputs A and B both switch to "L" at a fifth clock (at timing ⑥ in FIG. 18), which causes the high-voltage pulse driver 144−α to provide an output Vout of 0V (② in FIG. 19).

By such processing, first-pixel microcapsules (actually, positioned at the first pixel) are irradiated with the ultrasonic vibrations and broken to thereby produce a desired color.

Then, in the processing of a second pixel the high-voltage pulse driver 144 α+1 is driven that drives the ultrasonic element (ch α+1) in synchronism with a clock signal outputted at a timing ⑦ in FIG. 18. The high-voltage pulse driver 144 α is driven that drives the ultrasonic element (ch α) at a timing ⑧ in FIG. 18. The high-voltage pulse driver 144 α+1 is driven that drives the ultrasonic element (ch α−1) at a timing ⑨ in FIG. 18. Briefly, the second pixel as the target is on the right of the first pixel in FIG. 17. The ultrasonic element (ch α+1) is first driven. Next, the ultrasonic element (ch α) is driven. Further, the ultrasonic element (ch α−1) is then driven.

This applies also to the ultrasonic elements (ch α−2), (ch α+2), etc. In this respect, the ultrasonic elements (ch α−2) and (ch α+2) start to be driven three and one clocks, respectively, behind the ultrasonic element ch α+1).

Figure 17C:
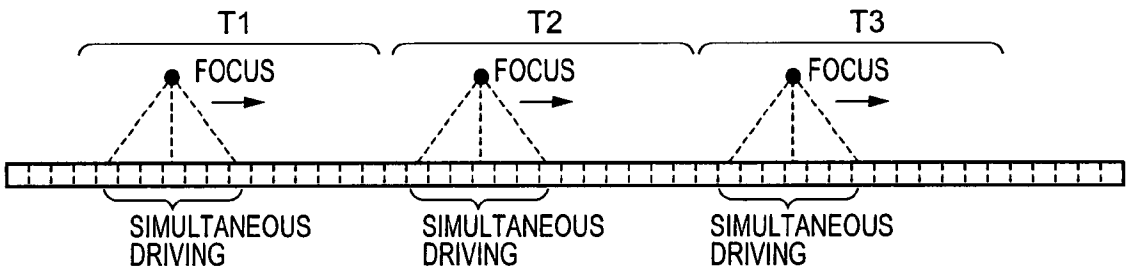
Figure 17D:
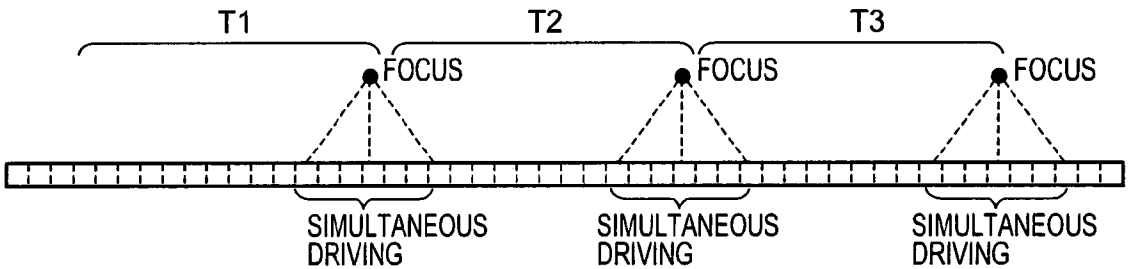

Then, this also applies to each of pixels at t=3, 4, 5, . . . . Although these cases are not shown, first, the ultrasonic element (ch α+2) starts to be driven. Then, both the adjacent ultrasonic elements (ch α+1) and (ch α+3) start to be driven one clock behind the ultrasonic element (ch α+2). Then, likewise, other ultrasonic elements are sequentially driven to thereby break microcapsules at the corresponding positions to produce relevant colors (FIGS. 17C and 17D).

As described above, in the particular embodiment a phase difference between adjacent pixels is beforehand calculated and stored in the phase difference setting value memory 134. After starting the printing process is started, the phase difference counter 140 counts the phase difference while outputting control signals to the high-voltage pulse drivers 144 to thereby sequentially drive the ultrasonic elements.

In such arrangement, a relatively low voltage is applied to the high-voltage pulse driver 144 to thereby break the microcapsules efficiently.

A clock frequency corresponding to the temperature sensed by the heat sensor 146 is set in the clock setting value memory 135. Even when the temperature of the ultrasonic line head 18 changes, the clock frequency can be calculated by the frequency operating unit 132 to thereby cope with such temperature change.

The ultrasonic elements irradiate the corresponding microcapsule with ultrasonic waves whose number is calculated by the gradation data operating unit 133 based upon the gradation value of the print data, as mentioned above. For example, when the gradation value is higher, the number of ultrasonic waves with which the microcapsules are irradiated is increased whereas when the gradation value is lower, the number of ultrasonic waves with which the microcapsules are irradiated is reduced so as to cope with the situation. By such processing, the number of microcapsules to be broken is controlled to thereby produce a color of a desired gradation value efficiently.

In the above description, the use of a so-called dry developing system has been described as a premise when capsule toners T are applied to the photosensitive drum 15 as the toner image carrier and the intermediate transfer belt 28 and the capsule toners T are colored by the ultrasonic line head 18. In addition, it has been described that the ultrasonic line head 18 is preferably placed in cross contact with the layer of capsule toners T in order to prevent the acoustic impedance from being adversely effected by a gas-phase material which would otherwise intervene.

In order to produce a color efficiently with the ultrasonic line head 18, the intervening gas phase material is preferably eliminated as much as possible. Since there is a limit to the dry developing system, a liquid developing system is preferably employed in place of the dry developing system. Rather, employment of the liquid developing system can cause the ultrasonic wave energy to act on the capsule toners easily and efficiently. Now, the liquid developing system will be illustrated.

Second Embodiment

This embodiment discloses the use of the liquid developing system. As shown in FIG. 20, in this system a developing roll 120 that feeds capsule toners T containing the smaller microcapsules 41M, 41C, 41Y, and 41K and a developer including a carrier liquid CL; and a squeeze roller 121 that collects an unnecessary carrier liquid CL adhering to the photosensitive drum 15 are provided on the outer periphery of the photosensitive drum 15. FIG. 21 shows the developing roll 120, the squeeze roller 121 and their vicinities in an enlarged view.

The developer is fed to the developing roll 120. The developer on the developing roll 120 is in contact with the photosensitive drum 15 to thereby cause the capsule toners T in the developer to statically adhere to a static latent image on the drum. In this developing process, a part of the carrier liquid CL on the developing roll 120 moves onto the photosensitive drum 15. The capsule toners T and an excess carrier liquid CL on the photosensitive drum 15 arrive by rotation of the photosensitive drum 15 at the position of the squeeze roller 121 disposed on the downstream side. The excess carrier liquid CL on the photosensitive drum 15 is collected by a collection bias applied to the squeeze roller 120 onto the squeeze roller 121 and only the capsule toners T corresponding to the image information remain on the photosensitive drum 15.

In the particular embodiment the grain size of the capsule toners T can be reduced by using the liquid developing system. More particularly, in the dry developing system it is difficult to use toners of a grain size less than 6 μm because toner splashes will be produced. In contrast, in the liquid developing system the capsule toners T are contained in the carrier liquid. Therefore, there is no problem of toner splashes, and the toners of a grain size of less than 4 μm contained in the microcapsules are usable to thereby provide a finer image.

While in the particular embodiment the ultrasonic line head 18 is illustrated as disposed outside the photosensitive drum 15, that is, on the side of the photosensitive drum 15 to which the capsule toners T adhere electrostatically, the ultrasonic line head 18 may be disposed within the photosensitive drum 15, as shown in FIG. 10C.

Third Embodiment

FIGS. 22 and 23 illustrate further compositions of the liquid developing system which are different from the second embodiment in that the ultrasonic line head 18 is disposed between the develop roll 120 and the squeeze roller 121. In this case, the ultrasonic line head 18 is in contact with the capsule toners T and the carrier liquid CL.

Therefore, in such arrangement the ultrasonic line head 18 is in contact with the carrier liquid CL on the photosensitive drum 15. Therefore, the ultrasonic waves are transmitted efficiently to the capsule toners T without being transmitted through air to thereby provide a clearer printed image.

Fourth Embodiment

FIG. 24 is a cross-sectional view of a color image forming apparatus that performs a coloring process on the capsule toners T through an ultrasonic transmitting member and not through a gas phase material. In the particular embodiment, an intermediate transfer roller 71 is disposed as an intermediate transfer medium in place of the intermediate transfer belt 28.

As shown in FIG. 24, in the particular color image forming apparatus 70 a static latent image formed by the optical write head 16 on the photosensitive drum 15 that is rotated clockwise in a direction of arrow e in FIG. 24 is visualized (developed) on an uncolored pixel group layer 69 of the capsule toners T by the developing unit 68.

The developed pixel group layer 69 of the capsule toners T is first transferred to the intermediate transfer roller 71, which has a periphery covered with a rubber layer 72 of a uniform thickness to thereby prevent a standing wave to be produced when coloring development is performed, which will be described later in more detail.

The pixel group layer 69 of capsule toners T first transferred to the intermediate transfer roller 71 is their conveyed by the intermediate transfer roller 71 that rotates counterclockwise as shown by an arrow f in FIG. 24, and irradiated with the ultrasonic waves selectively focused based upon the image data by the ultrasonic line head 18 to thereby produce a desired color.

The colored pixel group layer 69' of the capsule toners T is then transferred to recording paper P between the intermediate transfer roller 71 and the transfer roller 74, and conveyed into the fixing section (not shown) where it is fixed to the recording paper P.

The coloring process is devised in a peculiar manner in the particular embodiment.

First, the ultrasonic line head 18 is held and fixed in position by a plastic head case 76 and a metal pipe 77. The whole assembly of the ultrasonic line head 18, head case 76 and pipe 77 is contained within a sleeve 78 that rotates clockwise as shown by an arrow g in FIG. 24. The sleeve 78 contains a volume of liquid A79 in which the ultrasonic transmission section sinks sufficiently at which an end of the ultrasonic line head 18 in the head case 76 is situated. These elements compose the ultrasonic head 80 as a whole.

A coating roller 82 of a liquid coating unit 81 is in contact with the outer peripheral surface of the sleeve 78. The liquid B83 contained within the liquid coating unit 81 is coated by the coating roller 82 onto the outer periphery of the sleeve 78.

The ultrasonic head unit 80 is arranged so as to ensure that a desired pixel group layer 69 is irradiated with the ultrasonic waves, as shown in FIGS. 14 and 15, in consideration of the fact that the ultrasonic waves can transmit through the liquid phase very efficiently compared to the gas phase, which will be described in more detail below.

FIG. 25 is a cross-sectional view of a main portion of the color image forming apparatus involving the ultrasonic head unit 80 as its core. As shown in FIG. 25, the ultrasonic head unit 80 includes the ultrasonic line head 18 enclosed in a plastic head case 76 with a jelly-like or silicon ultrasonic transmission material 85 being filled as a sealing agent between a protruding end of the head case 76 and a lens 84 of the ultrasonic line head 18 (similar to the acoustic lens 90-1 of FIG. 13C).

A seamless cylindrical PET sleeve 78 having a thickness of one-several hundred micron is used to allow the ultrasonic waves to pass through. In a state where the sleeve 78 contains the fixed ultrasonic line head 18 and head case 76, only the sleeve 78 is rotated.

The sleeve 78 contains such a volume of liquid A79 that the protruding end of the head case 76 just sinks there, as described above. Thus, the space between the inner wall of the sleeve 78 and the protruding end of the head case 76 is always filled with the liquid A79 and a gas phase material cannot enter the space. The liquid A79 contained in the sleeve 78 has a low viscosity. The liquid 78 whose volume is about ½ of the inner volume of the sleeve 78 is required, so that the viscosity resistance of the liquid A79 contained within the sleeve 78 to rotation of the sleeve 78 is minimized.

In addition, the outer periphery of the sleeve 78 is coated with the liquid B83 by the liquid coating device 81 to control the impedance of the pixel group layer 69 of uncolored capsule toners T, as described above. Thus, the uncolored pixel group layer 69 of capsule toners T carried by the intermediate transfer roller 71 to the coloring/developing section sinks within the liquid B83 to thereby remove any gas phase material from the coloring/developing section.

The distance 1 between the back of the lens 84, that is, on which the ultrasonic elements are disposed and the coloring/developing section on the intermediate transfer roller 71 is set at an ultrasonic focusing distance of the ultrasonic line head 18, that is, at approximately 2 mm.

The uncolored toner pixel group layer 69 first transferred on the intermediate transfer roller 71 at the first step and conveyed to the ultrasonic illumining section or the coloring/developing section at the position of an arrow h is then irradiated efficiently with focused ultrasonic waves as shown by the arrow h, through a solid- and liquid-phase ultrasonic transmission of the ultrasonic transmission member 85, the protruding portion of the plastic head case 76, the liquid A79, the PET-plastic sleeve 78, and a liquid B83, while being conveyed as a colored toner pixel group layer 69' to the next transfer section.

The intermediate transfer roller 71 is composed of a hollow cylindrical extruded aluminum base 86 and a rubber layer 72 coating the outer periphery of the base 86. The rubber layer 72 ensures a flexible contact of the sleeve 78 to the intermediate transfer roller 71 to thereby aid in focusing the ultrasonic waves securely. At this time, the rubber layer 72 prevents the ultrasonic waves that have passed through the toner layer from arriving at the intermediate transfer roller 71 and being reflected by the aluminum base 86 to thereby prevent production of standing waves, as shown by an arrow I, which would adversely affect the toner layer.

When the standing waves occurred arrive at the toner layer, they have no ultrasonic energy enough to break the protective walls 43 of the smaller microcapsules 41 of the capsule toners T due to their mutual interference. Therefore, the uncolored pixel group layer 69 of capsule toners T can not be colored, undesirably. The rubber layer 72 has an optimal thickness m enough to prevent the effect of the standing waves.

The required thickness m (μm) of the rubber layer 72 is determined in accordance with the characteristic of ultrasonic waves to be used. More particularly, it can be represented as "m>CN/2f" where C is the velocity of sound (m/s), and N and f are the number and frequency (MHz), respectively, of ultrasonic waves with which the capsule toners are irradiated.

As described above, according to the present embodiment, in the seamless PET sleeve of the thickness of one-several hundred microns, the ultrasonic line head is disposed in such a volume of liquid A such that its ultrasonic irradiating section sinks in the volume of liquid A. The outer periphery of the sleeve is coated with another liquid B. Thus, the uncolored pixel group layer of capsule toners T is efficiently irradiated with focused ultrasonic waves only through the liquid and solid phases and not through the gas phase between the ultrasonic irradiating section of the ultrasonic line head and the toner layer in the coloring/developing section of the intermediate transfer roller. Thus, the uncolored pixel group layer of capsule toners T is colored efficiently.

Since the outer surface of the base of the intermediate transfer roller is covered with the rubber layer having a thickness enough to prevent interference of the standing waves, transmission of ultrasonic waves to the toner layer is performed efficiently to thereby provide stabilized coloring due to stabilized capsule breakage.

FIG. 26 is a cross-sectional view taken along line K–K' of FIG. 25 showing one example of a method of driving the sleeve 78.

As described above, the sleeve 78 is made of the seamless cylindrical PET one of the thickness of one-several hundred microns. Thus, its hardness is low and it would be twisted by rotation given at one end. Therefore, in the particular embodiment the sleeve 78 is driven at both ends.

As shown in FIG. 26, the ultrasonic line head 18 is held by the head case 76, which in turn is held at both ends by the pipe 77 extending through the head case 76. Holders for the pipe 77 at both ends of the pipe 77 are sealed by O-like sealing members 87 (87*a*, 87*b*). The pipe 77 is fixed at both ends by frames 88 (88*a*, 88*b*) of the color image forming apparatus. Pulled out partially from an open end (left end in FIG. 26) of the pipe 77 is a wiring harness 89 that sends drive signals from the controller of the apparatus to the ultrasonic line head 18.

As described above, since the harness 89 of the ultrasonic line head 18 is pulled out partially through the fixed pipe 77, there is no probability that the harness 89 will adversely affect the rotation of the sleeve 78.

The pipe 77 is contained in the sleeve 78 through gear flanges 99 (99*a*, 99*b*). Gears 101 (101*a*, 101*b*) are fitted over and fixed to both outer ends of the gear flanges 99, respectively. The gear flanges 99 are inserted at their inner ends into the respective ends of the sleeve 78 and fixed by adhesives 102 (102*a*, 102*b*) to the sleeve 78.

Two O-like ring sealing members 103 (103*a*, 103*b*) are disposed on opposite inner ends of the gear flanges 99 fitting over the pipe 77 fixed to the sleeve 78. These gear flanges 99 are slidable relative to the pipe 77.

The O-like sealing members 87 (87*a*, 87*b*) and 103 (103*a*, 103*b*) are provided to prevent the liquid A78 contained within the sleeve 78 from flowing into between the gear flange 99 and the pipe 77 in the sliding section or into the head case 76 due to the liquid A79 being made of a material of a low viscosity so as to follow the rotation of the sleeve 78 easily. If otherwise, a rotational load would increase and the inside of the apparatus would be contaminated or the ultrasonic line head 18 as an electrical part would malfunction.

Provided below the sleeve 78 is the intermediate transfer roller 71 that is rotatably supported at both ends of its base 86 by bearings 104 (104*a*, 104*b*) provided on a frame 88 of the apparatus body.

Gears 105 (105*a*, 105*b*) are fixed to the opposite end of the base 86 of the intermediate transfer roller 71 close to the corresponding bearings 104 with the gear 105*b* on one side (on the right side of FIG. 26) meshing with a drive gear 106 provided on the side of the apparatus body.

The base 86 of the intermediate transfer roller 71 is made of a rigid metal. When the base 86 is rotated at one end by the drive gear 96, the whole of the base 86 including the other end is simultaneously rotated without distortion. The gears 105*a* and 105*b* at the opposite ends of the intermediate transfer roller 71 mesh with the gears 101*a* and 101*b*, respectively, on the sleeve 78 side.

Abutting rolls 107 (107*a*, 107*b*) are disposed on the respective inner sides of the gears 105*a*, 105*b*, respectively, at the opposite ends of the intermediate transfer roller 71. The abutting rollers 107 rotate while abutting at all times on the peripheral portions of the corresponding gear flanges 99 for the sleeve 78 except on their peripheral portions over which the gears 101 fit.

Thus, it is ensured that contact between the intermediate transfer roller 71 and the sleeve 78 is maintained in a state where the pressure between these elements is constant and stabilized, and that the ultrasonic focal distance from the ultrasonic line head 18 to the periphery of the sleeve 78 is maintained at all times at a correct value.

Fifth Embodiment

Next, the invention for easily adjusting a discrepancy in printing position in the inventive color image forming apparatus will be described. This embodiment utilizes the image forming characteristic of the color image forming apparatus that uses capsule toners T, which will be described specifically.

As described above, the color image forming apparatus that uses capsule toners T performs an image forming process that includes forming a static latent image with the optical write head 16 and irradiating the capsule toners T, which statically adhere to the formed static latent image, with ultrasonic waves. In this case, a discrepancy between the position where the static latent image is formed by the optical write head 16 and the position where the capsule toners T are irradiated with the ultrasonic waves from the ultrasonic line head 18 would lead to a deterioration in the image quality.

FIG. 27 shows a picture "F" 151 that is obtained by developing the static latent image "F" 150, formed on the photosensitive surface of the photosensitive drum 15, with the capsule toner developing roller 25, irradiating the developed static latent image with ultrasonic waves from the ultrasonic line head 18 to thereby color the latent image, and then transferring the colored image to recording paper P.

FIGS. 28A, 28B and 28C compare the image "F" 151 transferred on the recording paper P, the static latent "F" 150 and the colored image 152 produced with irradiation of ultrasonic waves from the ultrasonic line head 18. FIG. 28A shows the static latent image "F" 150 and the colored developed image "F" 152. FIG. 28B shows the image "F" 151 produced when the latent image "F" 150 coincides in position with the colored developed image "F" 152 and hence there is no deterioration in the printed quality.

FIG. 28C shows that there is a discrepancy in position between the latent image "F" 150 and the colored developed image "F" 152 where in FIG. 28C the colored developed image "F" 152 has deviated downward compared to the latent image "F" 150. Such printing would lead to a deterioration in the printed quality.

FIGS. 29A, 29B and 29C illustrate a method of eliminating a discrepancy in position between the latent image "F" 150 and the colored developed image "F" 152. As shown in FIG. 29A, in this method the latent image "F" 150 to be formed on the photosensitive drum 15 is set, for example, so as to have pixels which are larger by a predetermined number of pixels (dots) in each of X- and Y-axis directions than those of the corresponding colored developed image "F" 152 formed with irradiation of focused ultrasonic waves from the ultrasonic line head 18 in accordance with image data.

Originally, when the apparatus is assembled in a factory, there is no extremely large discrepancy but only a small discrepancy, for example, of several dots or so, in position between the optical write head 16 and the ultrasonic line head 18. Thus, if the number of pixels (dots) of the ultrasonic line head in the X-Y-axis directions are set so as to cope sufficiently with discrepancies in position in a range assumable in the assembling technique, the capsule toner is colored exactly in accordance with the irradiation with the ultrasonic waves since the colored developed image 150 produced by the optical write head 16 is formed with sufficient vertical and horizontal margin compared to the colored developed image 152 produced by the ultrasonic line head 18, as shown in FIG. 29A, even if there is some discrepancy in position between the optical write head 16 and the ultrasonic line head 18. Thus, no discrepancy occurs in printing position between the optical write head 16 and the ultrasonic line head 18 and no printed quality is impaired.

FIG. 29B shows that there is no discrepancy in print position between the optical write head 16 and the ultrasonic line head 18, wherein the colored developed image "F" 152 (image "F" 151) fits in the larger sized static latent image "F" 150. FIG. 29C shows that even when the ultrasonic line head 18 deviates slightly downward compared to the optical write head 16, a discrepancy in printing position is eliminated because the discrepancy is within a predetermined presumed allowance.

By such arrangement, a discrepancy in printing position between the optical write position of the optical write head 16 and the irradiation position of ultrasonic waves by the ultrasonic line head 18 can be reduced in the predetermined allowance to thereby provide a color printed image free from unevenness and discrepancy.

Other microcapsule toners used in the present invention, and a relationship between the structure of a smaller microcapsule and ultrasonic waves to be used for breaking the protective wall of the smaller microcapsule will be described next.

Sixth Embodiment

FIG. 30 shows the composition of a capsule toner T slightly different from that of the first example.

The capsule toner T of this example has basically the same composition as the capsule toner T of the first embodiment. However, as shown in FIG. 30, the developer 45 is not present as a layer on each of the peripheries of the smaller microcapsules 41M, 41C, 41Y and 41K, but mixed with a holding material 42. This composition serves to simplify manufacturing capsule toners T.

In this case, the grain sizes of the larger microcapsule 40 and smaller microcapsules 41M, 41C, 41Y and 41K are identical to those of the first embodiment. The resonant frequencies are settable for the respective smaller capsules 41M, 41C, 41Y and 41K depending upon their diameters, protective wall thickness and materials such that they can be selectively broken to be colored in accordance with the image data used.

Seventh Embodiment

FIGS. 31A and 31B show further compositions of capsule toners T different from the above-mentioned ones.

As shown in FIG. 31A, a smaller microcapsule (for example, 41M) contains a color former 44 inside its protective wall 43 and a developer 45 outside its protective wall 43. A shell 92*a* containing an air bubble 92 is enclosed inside the protective wall 43.

By containing the air bubble 92 like this, the acoustic impedance around the air bubble 92 is changed. More specifically, the acoustic impedance changes depending upon the diameter of the air bubble 92 and the thickness and material of the shell 92*a* containing the air bubble 92. By combining these factors, the resonant frequency is changed. For example, when the shell 92*a* contains the air bubble 92, the resonant frequency set depending upon the diameter, thickness and material of the protective wall 43 is also greatly changed depending upon the radius of the air bubble 92 and the thickness and material of the shell 92*a*. Therefore, by changing the size, radius, etc., of the air bubble 92 for each of the smaller capsules 41M, 41C, 41Y and 41K, the resonant frequency can be changed greatly.

By such composition, a degree of freedom of coloring each of the smaller capsules 41M, 41C, 41Y and 41K increases and a range of selecting the resonant frequencies increases.

The above is applicable to all the smaller magenta, cyan, yellow and black capsules 41M, 41C, 41Y and 41K containing an air bubbles 92. This is also applicable when three kinds of smaller capsules 41M, 41C, 41Y are used or when two kinds of ones selected from the smaller capsules 41M and 41C or 41Y and 41K are used.

While the shell 92*a* is formed for the air bubble 92 in the case of each of the smaller microcapsules 41M, 41C, 41Y and 41K of FIG. 31A, a shell such as 92*a* may not be provided, as shown in FIG. 31B.

Eighth Embodiment

This example relates to the material of the color former 44 contained in each of the smaller microcapsules 41M, 41C, 41Y and 41K and the developer 45 disposed on the outer surface of the smaller microcapsule.

First, the color formers 44 usable are leuco dyes that include fluoran, triphenylmethane, henothiazine, auramine, and spiropyran compounds. More specifically, they may be, for example, rhodamine B lactam, 3-diethylamino-5,7-dimethylfluoran, 3-dimethylamino-6-methoxyfluoran, 3, 3-bis (p-dimethylanilino)-6-aminophthalide, and benzoil leucomethylene blue.

The developers 45 usable are phenols including α-naphtol, β-naphtol, resorcinol, hydroxynol, catechol and pyrogallol; activated clay; organic carboxylic acids or their metal salts; bisphenol-S(4,4-dihydroxy diphenyl sulfone) compounds and salicylic acid compounds.

It is necessary before reaction that the color former 44 and developer 45 are stabilized in a colorless state. To this end, they are shielded by the shell. That is, each of a plurality of types of smaller microcapsules is maintained colorless and transparent before being colored.

Transparent plastic such as polyester is preferred as the materials of the larger capsules 40 and the holding material 42. By using plastic such as polyester, physical characteristics such as combinability, fixability and frictional electrifyability are given to the capsule toner.

Ninth Embodiment

As described above, when a capsule toner T is colored, the protective walls 43 of the smaller microcapsules 41M, 41C, 41Y and 41K are broken. In this case, by irradiating the respective smaller microcapsules with ultrasonic waves of corresponding relevant resonant frequencies to thereby expand/shrink the protective walls 43 repeatedly a plurality of times to cause cracks finally.

First, a capsule that contains a gas in a liquid has the following features. By placing the capsule that contains a gas under specified conditions, very large vibrations occur. The moving state (or function) R (t) of the capsule's radius R with respect to time t is given by the following expressions (1) and (2):

$$\left.\begin{aligned}
&\left(1-\frac{\dot{R}}{C}\right)R\ddot{R}+\frac{3}{2}\dot{R}^2\left(1-\frac{\dot{R}}{3C}\right)=\left(1+\frac{\dot{R}}{C}\right)\frac{P}{\rho_0}+\frac{R\dot{P}}{\rho_0 C}\\
&P=P_{go}\left(\frac{R_0}{R}\right)^{3\Gamma}+P_v-P_0-\frac{2\sigma}{R}-\\
&\qquad 2S_p\left(\frac{1}{R_0}-\frac{1}{R}\right)-\delta_t(R,S_f)\omega\rho_0 R\dot{R}-P_a\\
&P_{go}=P_0+\frac{2\sigma}{R_0}-P_v\\
&\delta_t=\frac{4\mu}{\omega\rho_0 R^2}+\frac{\frac{\omega R_0}{C}}{1+\left(\frac{\omega R_0}{C}\right)^2}+\left(\frac{\omega_0}{\omega}\right)^2\cdot B+\frac{S_f}{4\pi R^3\rho_0\omega}\\
&B=(3\Gamma-1)\cdot\left[\frac{X(\sinh X+\sin X)-2(\cosh X-\cos X)}{X^2(\cosh X+\cos X)+(3\Gamma-1)X(\sinh X+\sin X)}\right]\\
&X=R_0\sqrt{\frac{2\omega\rho_{gA}(1+2\sigma/P_0R_0)C_g}{K_g}}
\end{aligned}\right\}\quad(1)$$

$$S_p=\frac{Et}{1-\mu}\quad(2)$$

where $R_0$ is the initial radius of the gas containing capsule in a standstill; R is an intantaneous radius of the gas containing capsule; C is the velocity of ultrasound; $\rho_0$ is the density of the liquid; P is the pressure of ultrasonic waves applied externally; $P_{go}$ is the pressure of the inner gas; $P_{gA}$ is the density of inner gas; Cg is a specific heat at constant pressure of the gas; Kg is the thermal conductivity of the inner gas; Γ is a ratio of specific heats; σ is a coefficient of surface tension of the liquid; $\omega_0$ is a resonant frequency; ω is the frequency of ultrasonic waves applied; μ is a coefficient of viscosity of the liquid; Et is Young's modulus of the shell thickness t; $P_0$ is an equilibrium pressure of the liquid; $P_a$ is the pressure of ultrasonic waves; $S_f$ is a frictional parameter of the capsule shell; $S_p$ is an elastic parameter of the capsule shell; and Pv is a vapor pressure inside the capsule, and $\dot{R}$ is a first derivative of R(t) and $\ddot{R}$ is a second derivative of R(t).

By the above expressions (1) and (2) and various experiments and selecting three or four kinds of selectively resonating frequencies, the present embodiment is realized.

The resonant frequency is calculated by the following expressions: * A resonant frequency $f_R$ of ultrasonic waves with which an air bubble capsule with no air bubble shell therein is irradiated is given by:

$$f_R=1/(2\pi)\cdot(4kP/\rho)^{1/2}$$

where k is a specific heat constant of the gas

* A resonant frequency $f_{shell}$ of ultrasonic waves with which an air bubble capsule with a bubble shell is irradiated is given by:

$$f^2_{shell}=f^2_R+(2/\pi\cdot(Sp/m) \quad (4)$$

$$m=4\pi R^3\rho \quad (5)$$

FIG. 32 shows an air-bubble containing smaller microcapsule's vibrating amplitude-frequency characteristic in which the respective amplitude-frequency characteristics of the smaller microcapsules 41M, 41C and 41Y obtained when change rates of the radii of the smaller microcapsules 41M, 41C and 41Y varied in expressions (1) are denoted by 41*f–m*, 41*f–c*, and 41*f–y*, respectively. The vertical axis of FIG. 32 shows a vibration amplitude change of the capsule (ΔR/Ro).

It was confirmed by repeating the above set experiments many times that cracks occurred in the protective walls 43 when a maximum amplitude exceeded 50%. Therefore, as shown in FIG. 32, by irradiating the smaller microcapsule 41 with ultrasonic waves of a (resonant) frequency that causes its protective wall 43 to change by more than 60% in expansion rate, its protective wall 43 is broken to cause the color former 44 to mix and react with the developer 45 to thereby produce a corresponding color.

FIG. 33 shows a characteristic similar to FIG. 32 obtained when a smaller black microcapsule 41K is contained in addition to the smaller microcapsules 41M, 41C, and 41Y. As will be seen in FIG. 33, the four kinds of smaller microcapsules 41M, 41C, 41Y and 41K can be selectively broken by irradiating these microcapsules with ultrasonic waves of the earlier-mentioned resonant frequencies and a resonant frequency 41*f–k* for the smaller microcapsule 41K.

FIG. 34 illustrates that the smaller microcapsules 41M, 41C, 41Y and 41K vibrate due to being irradiated with ultrasonic waves. The vertical axis shows expansions and shrinks on the plus and minus sides, respectively, of a reference 0 that represents the initial radius R of the smaller microcapsule. The horizontal axis represents a time axis. As shown by the above-mentioned expressions (1), the ultrasonic waves entering the respective smaller microcapsules are applied as vibrating compressional waves to their protective walls 43 and cause their diameters to change in response to the cycle of the compressional waves.

In this case, the influence of the entering ultrasonic waves gradually increases. The first entered wave does not directly produce a maximum amplitude, but several entered waves produce the maximum amplitude. Therefore, in order to obtain optimal effective vibrations, at least several waves need be applied to the protective wall 43. It has been understood by many experiments that irradiating the protective wall 43 with 4–6 waves leads to the maximum amplitude. In the particular embodiment the respective smaller microcapsules 41M, 41C, 41Y and 41K are irradiated with at least the number of ultrasonic waves, just mentioned above.

As will be also seen in FIG. 34, the vibrating amplitude is extremely different between resonant frequency Rt–1 or Rt–1' and non-resonant frequency Rt–2. Thus, when any particular one of the smaller microcapsules 41M, 41C, 41Y and 41K is irradiated with ultrasonic waves of the corresponding resonant frequency, the other of the smaller microcapsules 41M, 41C, 41Y and 41K are hardly influenced by the ultrasonic waves of that resonant frequency. That is, by irradiating any particular target of these smaller microcapsules 41M, 41C, 41Y and 41K with ultrasonic waves of the corresponding resonant frequency in a short time, the target one can be broken efficiently.

FIG. 35 shows an output burst of ultrasonic waves for irradiation. As described above, the smaller capsule is irradiated, for example, with bursts of several ultrasonic waves (in the case of FIG. 35, four ultrasonic waves) per pixel and not with a single ultrasonic wave, in order to break the protective wall 43 effectively.

Several specified examples of the present embodiment will be described next.

EXAMPLE 1

According to this particular example, the resonant frequency conditions of the ultrasonic waves are studied from various experiments based upon the above calculation expressions to thereby provide materials and coloring processes selected to satisfy the resonant frequency conditions.

FIG. 36 shows other conditions for breaking the protective wall 43, using the expression (4). The conditions include the capsule radius Ro and a shell parameter Sp. From the specified numerical values of FIG. 36, a maximum amplitude frequency f shown in the lowest column of FIG. 36 is obtained. For example, when the radius Ro of the smaller magenta microcapsule 41M is 1.0 μm and an elastic parameter (shell parameter Sp) of its protective wall 43 is 0.5, its vibration is shown by a characteristic 41*f–m* of FIG. 37. In this case, the maximum amplitude frequency f is 7.0 MHz. The vertical axis of FIG. 37 represents the ratio of the maximum diameter to the initial diameter of each smaller microcapsule.

Similarly, in the case of the smaller cyan microcapsule 41C, when its radius Ro is 1.0 μm and the elastic parameter (shell parameter So) of its protective wall 43 is 2, its vibration is shown by a characteristic 41*f–c* of FIG. 37. In this case, the maximum amplitude frequency f is 11.0 MHz.

Likewise, in the case of the smaller yellow microcapsule 41Y, its maximum resonant frequency (4.0 MHz) is obtained based upon the conditions of FIG. 36. FIG. 38 shows a characteristics (dependent on the shell parameter) obtained in this case.

EXAMPLE 2

FIG. 39 shows another example of the conditions for breaking smaller magenta, cyan, yellow and black microcapsules. The frequency characteristic of the smaller cyan and black microcapsules are shown by 41*f–c* and 41*f–k*, respectively, in FIG. 40. Also, when a shell parameter Sp of the capsule is added to the conditions, there is a great difference in vibration level between resonant frequencies Rt–1 and Rt–2, as in FIG. 34. Thus, the respective target smaller microcapsules 41M, 41C, 41Y and 41K can be broken efficiently and selectively without affecting the other smaller microcapsules adversely.

Also in this example, the protective wall 43 of the smaller microcapsule is irradiated with an output burst of several ultrasonic waves per pixel and not with an output of a single ultrasonic wave for effectively breaking purposes.

EXAMPLE 3

This example relates to selection of the breaking resonant frequency f of each of yellow, magenta and cyan smaller microcapsules in a combination of the radius Ro of its protective wall 43, and an elastic parameter Sp related to the thickness t of the outer shell (for example, see FIG. 31B), and its ultrasonic pressure P selected such that the respective maximum amplitudes of the yellow, magenta and cyan microcapsules are the same.

FIG. 41 shows the resonant frequencies of ultrasonic waves with which the respective smaller microcapsules 41M, 41C, 41Y are irradiated when change rates of their radii (initial radii Rm, Rc and Ry) are different in the above expression (1).

For example, when in the case of the smaller yellow microcapsule 41Y, its radius Ro is 2.0 μm, the elastic parameter (shell parameter Sp) of its protective wall 43 is 0, and its applied ultrasonic pressure is 70 KPa, changes in the vibration of the smaller microcapsule 41Y are represented by a characteristic 41*y–m* of FIG. 42. The maximum amplitude frequency f in this case is 1.6 MHz.

Similarly, when in the case of the smaller magenta microcapsule 41M, its radius Ro is 1.5 μm, the elastic parameter (shell parameter Sp) of its protective wall 43 is 0, and the applied ultrasonic pressure is 90 KPa, changes in the vibration of the smaller microcapsule 41Y are represented by a characteristic 41*y–m* of FIG. 42. The maximum amplitude frequency f in this case is 2.2 MHz.

This applies to the smaller cyan microcapsules 41C and the resonant frequency of FIG. 42 is obtained based upon the conditions of FIG. 41.

EXAMPLE 4

FIG. 43 shows characteristics of yellow, magenta, cyan and black microcapsules similar to those of FIG. 42 and based upon the corresponding conditions set in FIG. 44. When experiments were conducted, the maximum amplitude frequencies f of the smaller microcapsules 41Y, 41M, 41C and 41K were 2.2, 3.5. 8.3 and 1.6 MHz, respectively.

As in FIG. 34, in this case the vibration levels of the resonant and non-resonant frequencies Rt−1 and Rt−2 are extremely different and can break the respective target microcapsules selectively and efficiently without adversely affecting the other smaller capsules.

Also, in this case the protective wall 43 of the smaller microcapsule is broken efficiently with a burst of several relevant ultrasonic waves per pixel and not with a single ultrasonic output.

EXAMPLE 5

This example relates to selection of the breaking resonant frequency f of each of yellow, magenta and cyan smaller microcapsules in a combination of the radius Ro of its protective wall 43, and its elastic parameter Sp related to the thickness t of the outer shell (for example, FIG. 31B), and its ultrasonic pressure P selected such that the respective maximum amplitudes of the yellow, magenta and cyan microcapsules are the same.

This example contains a shell parameter Sp condition additionally, as shown in FIG. 45. For example, in the case of a smaller yellow microcapsule 41Y, when its radius Ro is 1.0 μm, the elastic parameter (shell parameter Sp) of its protective wall 43 is 2.0, and the ultrasonic pressure applied is 1,000 KPa, the maximum amplitude frequency f is 12 MHz. For magenta and cyan, corresponding condition data are as shown in FIG. 45.

EXAMPLE 6

FIG. 46 shows a further example of the conditions for breaking the four different-colored smaller microcapsules similar to FIG. 45.

Tenth Embodiment

A relationship between the number and size of smaller microcapsules contained in a larger microcapsule will be described next.

In the color image forming apparatus, when the smaller microcapsule 41 (41M, 41C, 41Y or 41K) of the capsule toner T are irradiated with ultrasonic waves of a resonant frequency, only the outer protective wall 41 of a smaller microcapsule of a color corresponding to resonant frequency is broken by the ultrasonic waves in the capsule toner T because the smaller microcapsules 41 are different in shell diameter, and the breaking resonant frequencies are different for the respective microcapsules, as described above. Assume that the smaller microcapsules are the same in thickness and material. As the diameter of the microcapsule increases, the resonant frequency of the ultrasonic waves decreases. As the thickness of its protective wall 43 increases, its resonant frequency increase, as described above.

When the smaller microcapsules for the respective colors contained in the larger microcapsule are the same in number, their volumes are the same if their diameters are the same. Thus, the respective colors have the same density. When the smaller microcapsules for the respective colors are the same in thickness, material and diameter, all the colors would be produced with only one kind of breaking resonant frequency. Therefore, the smaller microcapsules for the respective colors need be changed in diameter and respective desired colors need be produced with the corresponding breaking resonant frequencies for their respective different diameters.

In that case, if the smaller microcapsules of different diameters for the respective colors are the same in number, the respective color densities would become different. In this case, software control is needed to correct the density difference between the respective colors to be produced, which is troublesome. In order to avoid this situation, the smaller microcapsules for the respective colors in the larger microcapsule should be different in diameter and also their color densities should be the same.

In that case, the problem with the whole larger microcapsule is that if the respective quantities of color formers increase to ensure the densities of the respective colors, the quantity of the developer decreases whereas if a sufficient quantity of the developer is secured, the quantity of the developer decreases. Thus, in the particular embodiment an appropriate number of smaller microcapsules for each color contained in the larger microcapsule is set such that the quantities of color formers for the respective colors are the same.

FIG. 47A schematically illustrates the composition of a capsule toner T in this embodiment.

As shown in FIG. 47A, the larger microcapsule 40 of a capsule toner T contains a holding material 42 as a coloring capsule within an outer shell 95 as a protective layer. The holding material 42 contains a plurality of smaller magenta, cyan, yellow and black microcapsules 41. Each of The smaller microcapsule 41 contains an air bubble 92.

In FIG. 47A, a single smaller microcapsule 41 is shown for each color for convenience of explanation, but there is actually a plurality of smaller microcapsules 41 for each color. The outer shell 95 as the protective layer absorbs ultrasonic rays received externally and protects larger microcapsule itself from being broken by external pressure.

In order to ensure that the respective colors of the same density are produced within the larger microcapsule, the quantities of color formers for the respective colors should be equal. If a total volume of smaller microcapsules 41 for each color is identical to that for another color, the total quantities of color formers of the respective colors are the same even when the radii of the smaller microcapsules 41 of the respective colors are different.

Now, let radii of the smaller microcapsules 41M, 41C, 41Y and 41K containing magenta, cyan, yellow and black color formers be $r_1$, $r_2$, $r_3$ and $r_4$, respectively. A filling rate of an air bubble 92 contained in each of the smaller microcapsules is, for example, 60%. If a relationship among their diameters is given by $$r_1 \leqq r_2 \leqq r_3 \leqq r_4$$

the ratio in number between the respective smaller color microcapsules of magenta, cyan, yellow and black contained in each larger microcapsule 40, Nm:Nc:Ny:Nk, is set so as to satisfy $$Nm:Nc:Ny:Nk = r_4^3/r_1^3 : r_4^3/r_2^3 : r_4^3/r_3^3 : 1 \quad (6)$$

That is, the smaller microcapsules of each color are equal in total volume to those of another color. In this case, the total quantities of the different color formers are equalized even when the radii of the smaller microcapsules 41 of the respective colors are different.

Thus, colors of appropriate densities are produced only by performing the coloring process in according with the image data without correcting the densities of the respective colors in software.

In order to achieve the respective target densities in the printer in consideration of a difference in coloring characteristic between the respective color formers, the ratio in number between the microcapsules of magenta, cyan, yellow and black may be modified by multiplying the numbers of smaller microcapsules of magenta, cyan and yellow by coefficients $k_1$, $k_2$, and $k_3$, respectively, so as to be $$Nm:Nc:Ny:Nk = k_1 r_4^3/r_1^3 : k_2 r_4^3/r_2^3 : k_3 r_4^3/r_3^3 : 1 \quad (6')$$

In these expressions, some elements of the ratio can not be an integer as a result of its calculation. In that case, the nearest whole number to which each of the ratio members concerned is rounded off to zero decimal places should be employed.

Eleventh Embodiment

When the total quantities of the magenta, cyan, yellow and black color formers are the same within one larger microcapsule 40, and three colors of the four colors should be produced simultaneously, the volume of the developer = (the volume of a larger microcapsule to be colored) − (the volume of a single smaller microcapsule) × number ($n$) × 4 (colors)

should be not less than the total quantity of the color formers that need be colored simultaneously=(the volume of a smaller microcapsule)×a percentage of the volume of color former in the smaller microcapsule×number ($n$)×the number of colors to be produced.

Now, let the outer and inner diameters of the larger microcapsule 40 be 2Br (Br is the radius) and 2Hr (Hr is the radius of a ball of the protective material 42), and also assume that an air bubble filling rate is 60%. Then, the following inequality should be satisfied:

$$4\pi Hr^3/3 - (4\pi r^3/3) \times n \times 4 (\text{for colors}) \geqq (4\pi r_1^3/3) \times (1-0.6) \times n \times 3 \ (\text{colors})$$

Simplifying this expression, $$Hr^3 \geqq r_1^3 \times n \times ((1-0.6) \times 3 + 4)$$

Thus, $$Hr^3 > r_1^3 \times n \times 5.2$$

That is, $$n \leqq Hr^3/(r_1^3 \times 5.2) \quad (7)$$

The percentage of the volume of the color former in the whole larger microcapsule should be not less than q %. That is, the following inequality should be satisfied:

$$4\pi Br^3/3 \times q/100 \leqq (4\pi r_1^3/3) \times (1-0.6) \times n$$

Therefore, $$q/0.4) \times Br^3/r_1^{31} \leqq n \quad (8)$$

The number of smaller microcapsules of radius $r_1$, n, should be fall within the following range:

$$(q/0.4) \times Br^3/r_1^3 \leqq n \leqq Hr^3/(r_1^3 \times 5.2) \quad (9)$$

When the number of microcapsules of radius $r_{1,n}$, is determined, the number of microcapsules of each of radii $r_2$, $r_3$ and $r_4$ can be easily determined.

In this embodiment, while the air bubble filling rate is assumed to be 60%, it will be easily seen that when the filling rate is changed to another, the numerical values of expression (8) are changed accordingly. While the quantities of respective different color formers are considered to be the same, the range of n can be easily determined similarly, also when coefficients are introduced as shown in expression (6').

In this respect, let the air bubble filling rate be P (in a range of 0–1). Then, it can be easily confirmed that n must be in the following range:

$$(Br^3 r_1^3) \times (q/(1-p) \leqq n \leqq Hr^3/(r_1^3 \times (1-p) \times 3 + 4) \quad (10)$$

Generally, the developer is often required to be more than two times the quantity of the color former. Thus, when the respective color formers of one larger microcapsule are the same in quantity, the quantity of the developer in the larger microcapsule need be more than two times a total of the quantities of the respective color formers.

In this case, when it is assumed that three colors are produced simultaneously, the number of smaller microcapsules of radius $r_1$, n, must be set such that the volume of the developer [ = (the volume of a larger microcapsule to be colored) − (the volume of a single smaller microcapsule) × number × 4 (for colors)]

is not less than two times the total quantity of the color formers to be colored simultaneously

[ = (the volume of one smaller microcapsule) × percent of a color former volume rate × number × the number of colors to be produced × 2].

In that case, it is assumed that the air bubble filling rate is 60%. The following expression should then be satisfied:

$$4\pi Hr^3/3-(4\pi r_1^3/3)\times n\times 4(\text{for colors})\geqq(4\pi r_1^3/3)\times(1-0.6)\times n\times 3\ (\text{colors})\times 2$$

Simplifying this inequality, $$Hr^3\geqq r_1^3\times n\times((1-0.6)\times 6+4)$$

Thus, $$Hr^3\geqq r_1^3\times n\times 6.4$$

That is, $$n\leqq Hr^3/(r_1^3\times 6.4) \tag{11}$$

From the inequalities (11) and (8), the inequality (9) can be rewritten as $$q/0.4)\times Br^3/r_1^3\leqq n\leqq Hr^3/(r_1^3\times 6.4) \tag{9'}$$

That is, a larger microcapsule satisfying the above condition (9') should be formed.

Twelfth Example

If four kinds of smaller microcapsules 41 to be resonantly broken with ultrasonic waves of the four corresponding resonant frequencies have grain sizes, one different from another by a given value, the grain sizes of the four smaller microcapsules 41 and the four corresponding breaking resonant frequencies need have respective high accuracies.

Then, the following problems arise: (1) The ultrasonic pressure characteristic for each frequency need be very sharp; (2) The difference between the maximum and minimum frequencies increases to thereby render it difficult to produce the piezoelectric materials that generate ultrasonic waves; and, (3) The maximum frequency increases to thereby render it difficult to produce the piezoelectric materials that generate ultrasonic waves.

In order to avoid these problems, in the present embodiment the four smaller microcapsules 41 have radii with a common error, which will be described next.

The four smaller microcapsules 41 (41Y, 41M, 41C, 41K), each of which contains a corresponding color former and an air bubble, contained in the larger microcapsule 41 of the emboidment shown in FIG. 47A have different grain sizes, wherein the differences between their grain sizes are not constant, but uneven such that an unevenness rate of the grain size is common to the four different-colored smaller microcapsules 41.

It is assumed that for example, as in the case where the four smaller microcapsules 41 have grain radii of 0.5, 1.0, 1.5 and 2.0 μm, respectively, they differ sequentially by a constant value, for example, of 0.5 μm in diameter in this order. The resonant frequencies that break the four smaller microcapsules 41 are 6.4, 3.2, 2.13 and 1.6 MHz because the relationship between the resonant frequency f and radius r of a single air bubble is given by "f×r=3.2" approximately. Thus, the resonant frequency bandwidth is 4.8 MHz, which is the difference between 6.4 and 1.6 MHz to thereby require a very wide frequency bandwidth. Since the highest resonant frequency needed is 6.4 MHz, which is a very high frequency.

As shown in FIG. 47B, let the smallest, second smallest, third smallest and fourth smallest radii of the smaller microcapsules 41 be a (radius $r_1$), b (radius $r_2$), c (radius $r_3$) and d (radius $r_4$), respectively. Also, let the difference between the radii $r_4$ and $r_1$ of the largest and smallest capsules d and a be w, and also let an error in radius between the capsules a, b, c and d be p.

If smaller and larger grain sizes "$r_1(1+p)$" and "$r_2(1-p)$" of two smaller microcapsules adjoining in radius dimension, for example, a and b, and based upon outward and inward errors p become involved and interface with each other beyond a boundary between then, this situation is out of the question. Thus, if the microcapsules having these grain sizes are at most in contact with each other at a boundary between them, an expressions $r_1(1+p)=r_2(1-p)$ holds in the case of microcapsules a and b, as shown in FIG. 47B. Similarly, an expression $r_2(1+p)=r_3(1-p)$ holds in the case of the smaller microcapsules b and c, and an expression $r_3(1+p)=r_4(1-p)$ holds in the case of the capsules c and d.

Rearranging these expressions, the following expressions are given:

$$r_2=r_1(1+p)/(1-p) \tag{12}$$

$$r_3=r_2(1+p)/(1-p) \tag{13}$$

$$r_4=r_3(1+p)/(1-p) \tag{14}$$

From these expressions (12)–(14) and $w=r_4-r_1$, the following expressions are obtained:

$$\begin{aligned} r_4 &= r_3(1+p)/(1-p) \\ &= (1+p)/(1-p)\times r_2(1+p)/(1-p) \\ &= (1+p)^2/(1-p)^2\times r_1(1+p)/(1-p) \\ &= (1+p)^3/(1-p)^3\times r_1 \end{aligned} \tag{15}$$

Thus, $$\begin{aligned} r_1 &= r_4(1-p)^3/(1+p)^3 \\ &= (r_1+w)\times(1-p)^3/(1+p)^3 \end{aligned} \tag{16}$$

It will be known from these expressions that the preferable grain sizes of the smaller microcapsules 47 that contain Y, M, C and K color formers and air bubbles should basically satisfy the expressions (16), (12)–(14) and that the actual error should be set at a value somewhat smaller than p.

For example, the range of radii of the four different-colored smaller microcapsules a, b, c and d should be 0.5–0.75, 0.8–1.1, 1.2–1.7 and 1.8–2.6 μm, respectively. Alternatively, they may be 0.7–0.95, 1.0–1.35, 1.4–1.9 and 2.0–2.5 μm. It could be considered that they may be 0.4–0.5, 0.6–0.8, 1.0–1.4 and 1.7–2.3 μm, respectively.

For reference, FIG. 48 shows a relationship between the radii of the four-color smaller microcapsules a, b, c and d that can assume various values, and the difference w between the radii $r_4$ and $r_1$ of the largest and smallest microcapsules d and a. In FIG. 48, the horizontal axis represents the difference w between the radii $r_4$ and $r_1$ of the largest and smallest microcapsules d and a while the vertical axis represents the radii of the four different-colored smaller microcapsules a, b, c and d.

While in the embodiments a so-called electrophotographic system using the photosensitive drum 15 as an image carrier has been illustrated as an example of forming a toner image on the image carrier using microcapsule toners according to the present invention, the present invention is, of course, not limited to such electrophotographic system.

As described above, according to the present invention, the smaller microcapsule is broken by giving a predetermined stimulus such as ultrasonic waves to the smaller microcapsule, and the color former and developer contained in the microcapsule are mixed and react with each other to thereby form a color image.

By using the smaller microcapsules containing air bubbles, ultrasonic vibrations can be transmitted efficiently to the microcapsules without being adversely affected by the acoustic impedance.

The resonant frequencies of ultrasonic waves to be used for breaking the smaller microcapsules are determined, for example, depending upon the diameters and wall thickness of the microcapsules and the pressure of the ultrasonic waves with which the microcapsules are irradiated.

A color image can be formed on recording paper P by using the microcapsule toner as a developer to cause the developer to electrostatically adhere to an electrostatic latent image formed on an carrier such as, for example, the photosensitive drum, irradiating the electrostatic latent image with ultrasonic waves in accordance with the image data to thereby cause the smaller microcapsules to emit light selectively, transferring and fixing the capsule toners to the recording paper P.

By containing color formers of three colors, for example, yellow, magenta and cyan in the smaller microcapsules, a printing process is possible depending upon the type of the image data. A document is preferably printed, using only a black toner without using microcapsule toners of the three colors because an ebony color cannot be obtained even by mixing the three colors of the microcapsule toners.

Various embodiments and changes may be made thereunto without departing from the broad spirit and scope of the invention. The above-described embodiments are intended to illustrate the present invention, not to limit the scope of the present invention. The scope of the present invention is shown by the attached claims rather than the embodiments. Various modifications made within the meaning of an equivalent of the claims of the invention and within the claims are to be regarded to be in the scope of the present invention.

This application is based on Japanese Patent Applications Nos. 2002-201855 filed on Jul. 10, 2002, 2002-363341 filed on Dec. 16, 2002, 2002-378829 filed on Dec. 27, 2002 and 2003-059128 filed on Mar. 5, 2003, and including specification, claims, drawings and summary. The disclosure of the above Japanese Patent Application is incorporated herein by reference in its entirety.

What is claimed is:

1. A color image forming method using microcapsule toner which includes a plurality of larger microcapsules each of which contains a plurality of kinds of smaller microcapsules dispersed therein, the plurality of kinds of smaller microcapsules being different in at least one of outer diameter, shell thickness and material so as to be broken by ultrasonic waves of different resonant frequencies respectively, each smaller microcapsule containing an air bubble and having a protective wall breakable with an ultrasonic wave of a corresponding predetermined resonant frequency, each smaller microcapsule containing inside its protective wall one of two reacting substances that react with each other when mixed to thereby cause a coloring reaction and the other of the two reacting substances being disposed outside the protective wall, the method comprising the steps of:

forming a toner image on an image carrier by applying the microcapsule toner to the image carrier in accordance with ORed items generated by OR operation means of image information about respective colors or forming a toner image pattern on the image carrier depending on the ORed items generated by OR operation means of the image information about the respective colors and then applying the microcapsule toner to the toner image pattern to thereby form a toner image;

transferring the toner image, formed on the image carrier, directly or through an intermediate transfer medium to paper;

irradiating the toner image applied to the image carrier with ultrasonic waves of different predetermined resonant frequencies corresponding to respective color component items of the image information, the ultrasonic waves being focused within a width of one pixel in a primary scan direction, between the time when the toner image was formed on the image carrier and the time when the toner image was transferred to the paper such that the protective wall of relevant ones of the plurality of kinds of smaller microcapsules of the toner image is broken by the ultrasonic waves of the predetermined resonant frequencies to thereby cause the two reacting substances to mix and react with each other to thereby color the toner image; and fixing the colored toner image to the paper whereby a color image based upon the toner image is formed on the paper.

2. A color image forming method using microcapsule toner that includes a plurality of larger microcapsule each of which contains a plurality of kinds of smaller microcapsules dispersed therein, the plurality of kinds of smaller microcapsules being different in at least one of outer diameter, shell thickness and material so as to be broken by ultrasonic waves of different resonant frequencies respectively, each smaller microcapsule containing an air bubble and having a protective wall breakable with an ultrasonic wave having a corresponding predetermined resonant frequency, each smaller microcapsule containing one of two reacting substances that react with each other when mixed to thereby cause a coloring reaction and the other of the two reacting substances being disposed outside the protective wall thereof, the method comprising the steps of:

electrically charging the image carrier to a predetermined voltage level;

forming a static latent image of a voltage level pattern in accordance with ORed items generated by OR operatioon means of image information about respective colors on the image carrier charged in the charging step;

applying the microcapsule toner to the latent image formed on the image carrier to form a toner image;

irradiating the toner image formed on the image carrier with ultrasonic waves of different predetermined resonant frequencies corresponding to respective color component items of the image information, the ultrasonic waves being focused within a width of one pixel in a primary scan direction, to break the protective wall of relevant ones of the plurality of kinds of smaller microcapsules of the toner image such that the reacting substances mix and react with each other to thereby color the toner image;

transferring the colored toner image on the image carrier directly or through an intermediate medium to paper; and fixing the transferred toner image to the paper whereby a colored image based upon the colored toner is formed on the paper.

3. A color image forming method using microcapsule toner which includes a plurality of larger microcapsules each of which contains a plurality of kinds of smaller microcapsules dispersed therein, the plurality of kinds of smaller microcapsules being different in at least one of outer diameter, shell thickness and material so as to be broken by ultrasonic waves of different resonant frequencies respectively, each smaller microcapsule containing an air bubble and having a protective wall breakable with an ultrasonic wave of a corresponding predetermined resonant frequency, each smaller microcapsule containing inside its protective wall one of two reacting substances that react with each other when mixed to thereby cause a coloring reaction and the other of the two reacting substances being disposed outside the protective wall, the method comprising the steps of:

electrically charging the image carrier to a predetermined voltage level;

forming a static latent image of a voltage level pattern in accordance with ORed items generated by OR operation means of image information about respective colors on the image carrier charged in the charging step;

applying the microcapsule toner to the latent image formed on the image carrier to thereby form a toner image;

transferring the toner image formed on the image carrier in the applying step to an intermediate transfer medium;

irradiating the toner image transferred to the intermediate transfer medium with ultrasonic waves of different predetermined resonant frequencies corresponding to respective color component items of the image information, the ultrasonic waves being focused within a width of one pixel in a primary scan direction, to break the protective wall of relevant ones of the plurality of kinds of smaller microcapsules of the toner image such that the reacting substances mix and react with each other to thereby color the toner image;

transferring the colored toner directly or through an intermediate medium to paper; and fixing the transferred toner image to the paper whereby a color image based upon the colored toner is formed on the paper.

4. A color image forming apparatus using microcapsule toner which includes a plurality of larger microcapsules each of which contains a plurality of kinds of smaller microcapsules dispersed therein, the plurality of kinds of smaller microcapsules being different in at least one of outer diameter, shell thickness and material so as to be broken by ultrasonic waves of different resonant frequencies respectively, each smaller microcapsule containing an air bubble and having a protective wall breakable with an ultrasonic wave of a corresponding predetermined resonant frequency, each smaller microcapsule containing inside its protective wall one of two reacting substances that react with each other when mixed to thereby cause a coloring reaction and the other of the two reacting substances being disposed outside the protective wall, the apparatus comprising:

toner image forming means for forming a toner image on an image carrier by applying the microcapsule toner to the image carrier in accordance with ORed items generated by OR operation means of image information concerned about respective colors or forming a toner image pattern depending on the ORed items generated by OR operation means of the image information about the respective colors and for applying the microcapsule toner to the toner image pattern to thereby form a toner image;

transfer means for transferring the toner image formed on the image carrier directly or through an intermediate transfer medium to paper;

coloring means for irradiating the toner image formed on the image carrier with ultrasonic waves of different predetermined resonant frequencies corresponding to color component items of the image information, the ultrasonic waves being focused within a width of one pixel in a primary scan direction, between the time when the toner image was formed on the image carrier and the time when the toner image was transferred to the paper such that the protective wall of a relevant one of the plurality of kinds of smaller microcapsules of the toner image is broken by the ultrasonic wave of a predetermined resonant frequency to cause the reacting substances to mix and react with each other to thereby color the toner image; and fixing means for fixing the colored toner image to the paper whereby a color image based upon the toner image is formed on the paper.

5. The color image forming apparatus according to claim 4, wherein the toner image forming means comprises:

charging means for charging the image carrier to a predetermined voltage level;

static latent image forming means for forming a static latent image of a voltage level pattern in accordance with image information on the image carrier charged by the charging means; and developing means for applying the microcapsule toner to the latent image formed on the image carrier.

6. The color image forming apparatus according to claim 5, wherein the coloring means is disposed at a position where it colors the toner image between the development by the developing means and the transfer of the toner image by the transferring means.

7. The color image forming apparatus according to claim 4, wherein the transferring means comprises intermediate transfer means for transferring the toner image on the image carrier to an intermediate transfer medium, and the coloring means is disposed at a position where it colors the toner image transferred to the intermediate transfer medium.

8. The color image forming apparatus according to claim 7, wherein the coloring means irradiates the toner image transferred to the intermediate transfer medium with an ultrasonic wave of a predetermined resonant frequency from the side of the toner image.

9. The color image forming apparatus according to claim 8, wherein the coloring means irradiates the transferred toner image with the ultrasonic wave of the predetermined frequency through an ultrasonic transmission material of a liquid- or solid-phase material and not through a gas phase material.

10. The color image forming apparatus according to claim 4, wherein the coloring means comprises an ultrasonic line head.

11. The color image forming apparatus according to claim 10, wherein the ultrasonic line head comprises a multiplicity of ultrasonic elements arranged in a primary scan direction and supplied with ultrasonic output signals based upon image information from a plurality of individual applying electrodes to thereby irradiate the plurality of kinds of smaller microcapsules with ultrasonic waves of different resonant frequencies corresponding to the respective color component items of the image information.

12. The color image forming apparatus according to claim 11, wherein those of the plurality of ultrasonic elements disposed in any adjacent limited range of each side of any particular ultrasonic element produce respective ultrasonic waves so as to be focused at the same timing on the same position as the ultrasonic waves produced by the particular ultrasonic element are focused.

13. The color image forming apparatus according to claim 12, wherein the production of the respective ultrasonic waves so as to be focused at the same timing on the same position is performed by sequentially shifting the timing of outputting the ultrasonic waves based upon the distance between the focusing position and each of the ultrasonic elements.

14. The color image forming apparatus according to claim 11, wherein the ultrasonic element comprises a piezoelectric element.

* * * * *

UNITED STATES PATENT AND TRADEMARK OFFICE

CERTIFICATE OF CORRECTION

PATENT NO. : 7,022,444 B2
APPLICATION NO. : 10/617243
DATED : April 4, 2006
INVENTOR(S) : Kazumasa Kawada et al.

It is certified that error appears in the above-identified patent and that said Letters Patent is hereby corrected as shown below:

Under Item (75) Inventors:

delete "Kenji Kobayashi, Hino (JP);".

Signed and Sealed this

Twenty-fourth Day of November, 2009

David J. Kappos

David J. Kappos
*Director of the United States Patent and Trademark Office*